US006123876A

United States Patent [19]

Kobayashi et al.

[11] Patent Number: 6,123,876

[45] Date of Patent: Sep. 26, 2000

[54] METAL-CONTAINING COMPOSITION FOR FORMING ELECTRON-EMITTING DEVICE

[75] Inventors: Shin Kobayashi; Tsuyoshi Furuse, both of Atsugi; Satoshi Yuasa, Yokohama; Naoko Miura, Kawasaki; Takashi Iwaki, Machida; Yasuko Tomida, Atsugi, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/627,566

[22] Filed: Apr. 4, 1996

[30] Foreign Application Priority Data

| | | | |
|---|---|---|---|
| Apr. 4, 1995 | [JP] | Japan | 7-101619 |
| Oct. 9, 1995 | [JP] | Japan | 7-286344 |
| Oct. 11, 1995 | [JP] | Japan | 7-288167 |
| Dec. 28, 1995 | [JP] | Japan | 7-352440 |
| Mar. 7, 1996 | [JP] | Japan | 8-078164 |
| Apr. 3, 1996 | [JP] | Japan | 8-104807 |
| Apr. 3, 1996 | [JP] | Japan | 8-104808 |

[51] Int. Cl.[7] ..... H01B 1/06; H01B 1/14; H01B 1/22

[52] U.S. Cl. ..... 252/519.2; 252/512; 252/513; 252/514; 252/519.21; 423/23

[58] Field of Search ..... 252/513, 514, 252/518, 519, 520, 521, 519.21, 519.2; 106/1.25, 1.26, 1.27, 1.28, 1.29; 423/22, 23; 427/77, 145

[56] References Cited

U.S. PATENT DOCUMENTS

| | | | |
|---|---|---|---|
| 4,113,507 | 9/1978 | McHenry et al. | 252/518 |
| 4,434,084 | 2/1984 | Hicks et al. | 252/512 |
| 4,740,449 | 4/1988 | Yuasa et al. | 430/270 |
| 4,771,215 | 9/1988 | Munakata et al. | 313/483 |
| 4,798,694 | 1/1989 | Sugata et al. | 264/60 |
| 4,798,740 | 1/1989 | Tomida et al. | 427/43.1 |
| 4,840,821 | 6/1989 | Miyazaki et al. | 427/430 |
| 4,939,556 | 7/1990 | Eguchi et al. | 357/4 |
| 4,952,035 | 8/1990 | Yuasa et al. | 350/354 |
| 4,957,851 | 9/1990 | Tomida et al. | 430/272 |
| 5,001,598 | 3/1991 | Constantine | 361/305 |
| 5,011,644 | 4/1991 | Haruta et al. | 264/184 |
| 5,041,224 | 8/1991 | Ohyama et al. | 210/500 |
| 5,183,879 | 2/1993 | Yuasa et al. | 528/503 |
| 5,292,551 | 3/1994 | Jacobson | 427/215 |
| 5,384,076 | 1/1995 | Sato et al. | 252/518 |
| 5,491,093 | 2/1996 | Yamamoto et al. | 436/71 |
| 5,516,458 | 5/1996 | Lelental et al. | 252/518 |
| 5,518,810 | 5/1996 | Nishihara et al. | 428/328 |

FOREIGN PATENT DOCUMENTS

| | | | |
|---|---|---|---|
| 0660359 | 6/1995 | European Pat. Off. | H01J 9/02 |
| 1031332 | 7/1987 | Japan | H01J 29/48 |
| 2257552 | 3/1989 | Japan | H01J 31/15 |
| 1283749 | 11/1989 | Japan | H01J 11/30 |

OTHER PUBLICATIONS

"Electroforming And Electron Emission Of Carbon Thin Films", Hisashi Araki, et al., Journal of the Vacuum Society of Japan, vol. 26, No. 1, pp. 22–29 (received Sep. 24, 1981) (published Jan. 20, 1983).

Thin Solid Films, vol. 9, p. 317 (1972), G. Dittmer, "Electrical Conduction and Electron Emission of Discontinous Thin Films". No Month Available.

International Electron Devices Meeting, M. Hartwell et al., (1975), pp. 519–521, "Strong Electron Emission From Patterned Tin–indium Oxide Thin Films". No Month Available.

Journal of the Vacuum Society Of Japan, vol. 26, No. 1, p. 22, H. Araki et al., "Electroforming and Electron Emission of Carbon Thin Films". Jan. 1983.

*Primary Examiner*—Mark Kopec

*Attorney, Agent, or Firm*—Fitzpatrick, Cella, Harper & Scinto

[57] ABSTRACT

A metal-containing composition contains an organic acid group, a transition metal, an alcohol amine, and water. The alcohol amine is preferably expressed by chemical formula (1):

$$NH_mR1_n(R2OH)_{3-m-n} \quad (1)$$

where R1 is an alkyl group having 1 to 4 carbon atoms, R2 is an alkyl carbon chain having 1 to 4 carbon atoms and m and n are integers of 0 to 2 that satisfy the relationship of (m+n)<3, or by chemical formula (2):

$$NH_2CR3R4CHR5(CH_2)_kOH \quad (2)$$

where R3 is a substituent selected from H, $CH_3$, $CH_2OH$ and $CH_2CH_3$, R4 is H or $CH_2OH$, R5 is H or $CH_3$ and k is an integer of 0 to 2. The composition may further contain a water soluble polymer and/or a water soluble poly- or monohydric alcohol. The composition is used for forming an electron-emitting device.

74 Claims, 14 Drawing Sheets

METAL-CONTAINING COMPOSITION FOR FORMING ELECTRON-EMITTING DEVICE

BACKGROUND OF THE INVENTION

1. Field of the Invention

This invention relates to a metal-containing composition that can be used effectively for manufacturing an electron-emitting device comprising an electroconductive film containing therein an electron-emitting region and arranged between a pair of device electrodes and it also relates to an electron-emitting device formed by using such a composition, an electron source comprising a number of such devices and an image-forming apparatus realized by using such an electron source.

2. Related Background Art

The use of surface conduction electron-emitting devices in a cold cathode type electron source is known. A surface conduction electron-emitting device is realized by utilizing the phenomenon that electrons are emitted out of a small thin film formed on a substrate when an electric current is forced to flow therethrough in parallel with the film surface. While Elinson proposes the use of $SnO_2$ thin film for a device of this type, the use of Au thin film is proposed in [G. Dittmer: "Thin Solid Films", 9, 317 (1972)] whereas the use of $In_2O_3/SnO_2$ and that of carbon thin film are discussed respectively in [M. Hartwell and C. G. Fonstad: "IEEE Trans. ED Conf.", 519 (1975)] and [H. Araki et al.: "Vacuum", Vol. 26, No. 1, p. 22 (1983)].

FIG. 17 of the accompanying drawings schematically illustrates a typical surface conduction electron-emitting device proposed by M. Hartwell. In FIG. 17, reference numeral 171 denotes a substrate. Reference numeral 174 denotes an electroconductive film, part of which eventually makes an electron-emitting region 173 when it is subjected to an electrically energizing process referred to as "energization forming" as will be described hereinafter. In FIG. 17, the device electrode has a length L of 0.5 to 1 mm and a width W of 0.1 mm.

Conventionally, an electron emitting region 173 is produced in a surface conduction electron-emitting device by subjecting the electroconductive film for forming an electron-emitting region of the device to a current conduction treatment, which is referred to as "energization forming". In an energization forming process, a voltage is applied to the opposite ends of the electroconductive thin film for forming an electron-emitting region by way of the device electrodes to partly destroy, deform or transform the film and produce an electron-emitting region 173 which is electrically highly resistive. A fissure or fissures may be produced in the electroconductive film 174 as a result energization forming to make an electron-emitting region 173 of fissure so that electrons may be emitted from the fissure itself or from an area surrounding the fissure.

Note that, once subjected to an energization forming process, a surface conduction electron-emitting device comes to emit electrons from its electron emitting region 173 whenever an appropriate voltage is applied to the electroconductive film 124 to make an electric current run through the device.

Since a surface conduction electron-emitting device having a configuration as described above is structurally simple, a large number of such devices can advantageously be arranged over a large area. Efforts have been made to exploit this advantage and the devices proposed to exploit this characteristic feature of surface conduction electron-emitting device include charged beam sources and display apparatuses. Japanese Patent Applications Laid-Open Nos. 64-31332, 1-283749 and 2-257552 proposes an electron source comprising a large number of surface conduction electron-emitting devices arranged in parallel rows, where the devices of each row are commonly wired in a ladder-like arrangement. While flat-type displays using a liquid crystal have come into the mainstream of image-forming apparatuses to push out, at least partly, CRT displays, the liquid crystal display has a drawback of requiring the use of a back light because it is not of emission type and does not beam unless irradiated with light. Therefore, there is a consistent demand for emission type displays. The U.S. Pat. No. 5,066,883 discloses an image-forming apparatus realized by combining an electron source comprising a large number of surface conduction electron-emitting devices and an fluorescent body that emits visible light when irradiated with electrons emitted from the electron source.

An electroconductive film for forming an electron-emitting region is typically produced by depositing an electroconductive material on an insulating substrate directly by means of an appropriate deposition technique such evaporation or sputtering. An electroconductive film for forming an electron-emitting region may also be produced by applying, drying and baking a solution of a metal compound to remove the non-metal components of the solution by pyrolysis and form a thin film of metal or metal oxide. The latter technique is advantageous for producing a large number of devices on a substrate having a large surface area because it does not involve the use of a vacuum apparatus.

Materials that can be used for forming an electroconductive film of metal or a metal compound by way of an liquid applying, drying and baking process include a liquid containing a metal resinate or a compound of precious metal such as gold and resin and a solution prepared by dissolving an organic complex of organic amine and transition metal into an organic solvent. In short, electron-emitting devices can be manufactured from various different solutions.

It is well known, on the other hand, that many halides and oxyacid salts of transition metals are water soluble and produce corresponding metals or metal oxides by pyrolysis when heated to high temperature.

However, known metal compositions that can be used for manufacturing electron-emitting devices comprising an electroconductive film that contains an electron-emitting region such as surface conduction electron-emitting devices are accompanied by a number of problems as will be described hereinafter.

While it is true that many halides and oxyacid salts of transition metals are water soluble and produce corresponding metals or metal oxides by pyrolysis when heated to high temperature, the temperature for pyrolyzing such compounds is typically higher than 800° C., although it is not desirable to prepare electroconductive films for surface conduction electron-emitting devices by pyrolysis involving such high temperature. A number of surface conduction electron-emitting devices are formed on the surface of an appropriate substrate that carries a pattern of wires for wiring the devices. In other words, if such a pattern of wires is prepared on the substrate along with the electrodes of surface conduction electron-emitting devices before the electroconductive films of the devices are formed, the conditions for producing the electroconductive films by baking have to be carefully selected in order to avoid damages that may be given rise to the patterned wires and/or the electrodes by heat. More specifically, if the substrate is a silicon wafer or a glass substrate, the heating and baking process for producing electroconductive films on the substrate has to be conducted at temperature lower than 600° C., preferably at about 500° C., where the material of the wires such as copper or silver is not thermally degraded. Thus, any materials that have to be heated to temperature higher than 500° C. for producing electroconductive films may not suitably be used for manufacturing surface conduction electron-emitting devices. Aqueous solutions of halides or oxyacid salts of transition metals that require high baking temperature may not be used for preparing electroconductive films in the manufacture of surface conduction electron-emitting devices if such compounds are easily soluble to water.

Meanwhile, a number of organic metal complexes of a metal resinate or organic amine and a transition metal that may be easily decomposed at relatively low temperature lower than 500° C. are known. Since most of the organic metal compounds that decompose at relatively low temperature are easily soluble in ordinary organic solvents, they are typically dispersed or dissolved in an organic solvent for use. When a compound containing a metal to be used for forming a thin film is dispersed into an appropriate solvent to produce a liquid material, which is then applied to the surface of a substrate and baked to produce an electroconductive film for a surface conduction electron-emitting device, the solvent is preferably harmless to human and poorly inflammable from the view point of the environment and security of the process of manufacturing electron-emitting devices. In other words, the use of water as a solvent is preferable for the security of the process of manufacturing electron-emitting devices. Unfortunately, the organic metal compounds that are decomposed at relatively low temperature and hence can be used for manufacturing electroconductive films of surface conduction electron-emitting devices are mostly not sufficiently water soluble and it has been difficult to date to obtain an aqueous solution containing a metal compound to such a ratio that is appropriate for manufacturing electroconductive films of surface conduction electron-emitting devices.

Some of the organic metal complexes of an organic amine and a transition metal that are decomposed at relatively low temperature can evaporate or sublimate when heated for baking. If such an organic metal complex is used in the process of manufacturing surface conduction electron-emitting devices and applied to the substrate at a given rate, part of the metal can be lost while the substrate is baked and the amount of the metal left on the substrate after baking is dependent on the baking conditions and hence unstable and unreliable. Additionally, the vapor of a transition metal compound generated in the process of manufacturing surface conduction electron-emitting devices can damage the environment and hence undesirable.

Some of the organic metal complexes of an organic amine and a transition metal that are decomposed at relatively low temperature can form a crystalline structure having a size of several micrometers or more when dissolved into an organic solvent and applied to the surface of a substrate. When the applied solution is baked and dried, the pattern of the crystal can be left on the electroconductive film. Such an uncontrolled pattern can obviously obstruct the formation of an electroconductive film having a uniform thickness and a uniform electric resistance particularly when combined with the above problem of evaporation of the organic metal complex.

Many organic acid salts of metals such as metal carboxylates decompose at temperature under 500° C. to produce metals and/or metal compounds. If the molecule of an organic salt of a metal has a relatively small number of carbon atoms, it can more often than not dissolve into water. Meanwhile, an electron-emitting device has to operate stably for a long period of time. Therefore, the electroconductive film of the surface conduction has to be made of a material that is thermally and structurally stable and hardly change with time in the operating environment. Thus, the metal component of the electroconductive film of a surface conduction electron-emitting device has to be selected from chemically and thermally stable metals having a high melting point. However, many organic acid salts of metals, particularly metal carboxylates, do not satisfactorily dissolve into water and are often accompanied by the problem of evaporation or sublimation as they only partly dissolve into water if heated.

Electron-emitting devices can be arranged on a substrate in large numbers in order to form an electron source for an image-forming apparatus. For such an application, a large number of identical electron-emitting devices have to be formed at regular intervals over a large area on a highly reproducible basis. The technique of photolithography has been popularly used to form a large number of devices on a substrate as in the case of manufacturing semiconductors. However, this technique is not suited to produce a large number of devices on a substrate having a large surface area and it is often costly.

A technique of applying a solution that contains a metal compound little by little on a given pattern on a substrate and baking it to form small pieces of electroconductive film that are arranged according to the given pattern may be used in place of photolithography in order to produce a large number of identical electron-emitting devices on a substrate on a highly reproducible basis. An ink-jet system may be effectively used for applying a solution on a substrate. However, this technique is accompanied by the problem of crystallization and deposition of the metal compound that can take place during the ink-jet operation and/or in the time interval before the next operation starts. The net result will then be electroconductive films having a remarkably uneven thickness and electron-emitting devices that would not operate uniformly.

There has been proposed the use of a bubble-jet system, which is a type of ink-jet system, for manufacturing electroconductive films. (See, inter alia, Japanese Patent Applications Laid-Open Nos. 6-313439 and 6-313440.) A bubble-jet system can produce and apply a fine drop of liquid efficiently and accurately in a highly controlled manner and hence is effective for the above purpose. However, an ink-jet system is most effectively used with an aqueous solution of an organic metal compound in view of the durability of the nozzle head and the generation of fine drops. Conversely, it is not suited for an organic metal compound that hardly dissolve into water. This drawback on the part of ink-jet is still to be dissolved.

Printing may provide a less costly method for producing device electrodes for electron-emitting devices if compared with a technique using evaporation, sputtering and lithography in combination. However, a thin film prepared by printing shows a low film density if compared with a film produced by evaporation so that, when a solution is applied to the electrodes to produce an electroconductive film for forming an electron-emitting region, it can permeate, at least partly, into the electrodes and become lost. Then, the result will be an unintended and uneven thickness of the electroconductive film after baking. Thus, if a large number of such electroconductive films are produced on a same substrate, they operate very unevenly for electron emission to the detriment of the performance the electron source formed by the electroconductive films.

As described above, a metal-containing solution is desirably applied to a substrate according to a given pattern before they are baked to become small pieces of electroconductive film for electron-emitting devices. However, the inventors of the present invention have found that, if such a solution is applied to a substrate, it does not necessarily show an intended pattern nor a uniform film thickness after it is baked.

As a result of intensive research efforts on the performance various metal-containing compositions, the inventors of the present invention have discovered that a desired pattern cannot be obtained mainly due to either one of two phenomena. Firstly, the solution applied to the substrate can be repelled by the substrate and drops of the solution can be formed on the substrate to deform the pattern. Secondly and conversely, the solution applied to the substrate can excessively adhere to the substrate to wet unintended areas of the latter. It is obvious that either of these phenomena appears as a function of the cohesiveness of the solution or the adhesiveness of the solution relative to the substrate. Therefore, it may conceivably be possible to select a liquid composition that shows an optimum contact angle relative to the substrate by observing the contact angle of the solution and the substrate. However, as a result of a further study, it has been found that a solution that shows an optimum contact angle relative to a substrate does not necessarily provide a desired pattern of electroconductive film.

Additionally, the surface of the substrate on which electron-emitting devices are formed is not necessarily flat and smooth because wires and electrodes for supplying power to the devices are already there. When a metal-containing composition is applied to the surface of an insulating substrate that already carries device electrodes, the metal-containing composition has to adhere appropriately to both the surface of the metal electrodes and that of the insulating substrate. However, since the metal surface and the surface of an insulating substrate have respective properties that are so different from each other, it is not easy to find an appropriate metal-containing composition that adheres appropriately to both of them.

SUMMARY OF THE INVENTION

In view of the above identified problems, it is therefore an object of the present invention to provide a metal-containing composition for forming an electron-emitting device that can produce an electroconductive film at relatively low baking temperature.

It is another object of the present invention is to provide a metal-containing composition for forming an electron-emitting device from which the metal compound contained therein is not lost by evaporation and/or sublimation at the time of baking.

It is still another object of the present invention to provide a metal-containing composition for forming an electron-emitting device that can be effectively prevented from depositing crystal if applied to the surface of a substrate and dried.

It is still another object of the present invention to provide a metal-containing composition for forming an electron-emitting device that can be applied onto the surface of a substrate according to a given pattern by means of an ink-jet system.

It is a further object of the present invention to provide a metal-containing composition for forming an electron-emitting device that can produce a film having a uniform thickness when applied to the surface of a substrate and is not affected by the nature of the surface of the substrate so that it can produce a patterned film if applied according to a given pattern.

It is also an object of the present invention to provide a method of manufacturing electroconductive films for forming electron-emitting regions that have a desired profile and are uniform and homogeneous in order to produce electron-emitting devices that operate stably as well as methods of manufacturing such an electron-emitting device, an electron source comprising a large number of such devices and an image-forming apparatus comprising such an electron source.

According to an aspect of the present invention, there is provided a metal-containing composition for forming an electron-emitting device characterized in that it contains an organic acid group, a transition metal, an alcohol amine and water.

For the purpose of the present invention, the alcohol amine may preferably be expressed by the chemical formula of $NH_mR1_n(R2OH)_{3-m-n}$, where R1 is an alkyl group having 1 to 4 carbon atoms, R2 is an alkyl carbon chain having 1 to 4 carbon atoms and m and n are integers of 0 to 2 that satisfy the relationship of $(m+n)<3$.

Alternatively, the alcohol amine may preferably be expressed by the chemical formula of $NH_2CR3R4CHR5(CH_2)_kOH$, where R3 is a substituent selected from H, $CH_3$, $CH_2OH$ and $CH_2CH_3$, R4 is H or $CH_2OH$, R5 is H or $CH_3$ and k is an integer of 0 to 2, the composition containing three to five carbon atoms in a molecule.

According to another aspect of the present invention, there is provided a method of manufacturing an electron-emitting device comprising an electroconductive film containing an electron-emitting region arranged between a pair of device electrodes, said method being characterized in that the process of forming the electroconductive film containing an electron-emitting region comprises a step of applying a metal-containing composition also containing the substance of the electroconductive film on a substrate and heating the composition and that the composition is a metal-containing composition according to the first aspect of the invention.

According to a still another aspect of the present invention, there is provided a method of manufacturing an electron source having a number of electron-emitting devices arranged on a substrate, each of the devices comprising an electroconductive film containing an electron-emitting region, characterized in that the electron-emitting devices are manufactured by a method according to the preceding aspect of the invention.

According to a further aspect of the present invention, there is provided a method of manufacturing an image-forming apparatus comprising an electron source having a number of electron-emitting devices arranged on a substrate, each of the devices comprising an electroconductive film containing an electron-emitting region, and an image-forming member for producing images as irradiated with electron beams emitted from the electron source, characterized in that the electron source is manufactured by a method according to the preceding aspect of the invention.

DETAILED DESCRIPTION OF THE PREFERRED EMBODIMENTS

Figure 1A:
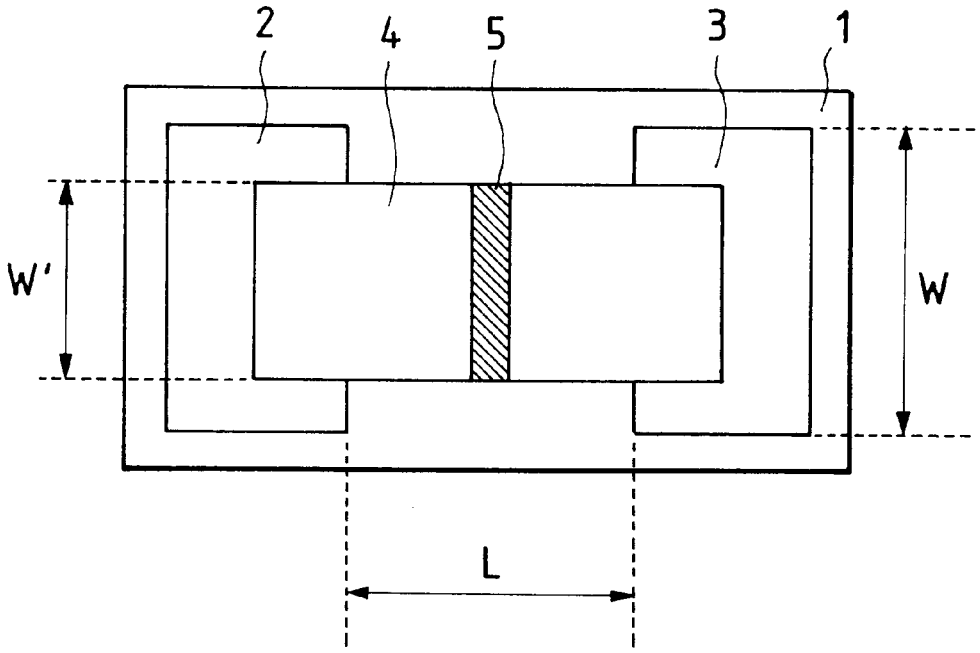
FIGS. 1A and 1B are respectively a schematic plan view and a schematic sectional view, illustrating the basic configuration of a surface conduction electron-emitting device according to the invention.

As a result of intensive research efforts for solving the above identified problems of known electron-emitting devices, the inventors of the present invention came to find that a solution of an organic acid group, a transition metal, one or more than one alcohol amines and water can be used as an aqueous composition having a sufficient content of a metal for producing an electroconductive film of an electron-emitting device that can be baked at relatively low temperature and is substantially free from crystal deposition when applied to the surface of a substrate and then dried.

For the purpose of the present invention, an alcohol amine expressed by chemical formula (1) below can be particularly suitably used;

$$NH_mR1_n(R2OH)_{3-m-n} \quad (1)$$

where R1 is an alkyl group having 1 to 4 carbon atoms, R2 is an alkyl carbon chain having 1 to 4 carbon atoms and m and n are integers of 0 to 2 that satisfy the relationship of $(m+n)<3$.

For the purpose of the present invention, an alcohol amine expressed by chemical formula (2) below can also suitably be used;

$$NH_2CR3R4CHR5(CH_2)_kOH \quad (2)$$

where R3 is a substituent selected from H, $CH_3$, $CH_2OH$ and $CH_2CH_3$, R4 is H or $CH_2OH$, R5 is H or $CH_3OH$ and k is an integer of 0 to 2, the composition containing three to five carbon atoms in a molecule.

A solution that can be used for the purpose of the present invention may contain an alcohol amine expressed by formula (1) or an alcohol amine expressed by formula (2) or the both in a mixed state.

Specific examples of alcohol amines expressed by formula (1) include monoethanolamines, diethanolamines and triethanolamines, of which monoalcoholamines with m=2 and n=0 such as monoethanol amine may particularly suitably be used for the purpose of the invention.

As an alcohol amine expressed by formula (2), trishydroxymethylaminomethane which is an alcohol amine with R3 and R4 are $CH_2OH$, R5 is H and r=0 is preferably used.

An organic acid group to be contained in a solution for manufacturing an electron-emitting device according to the invention may effectively be selected from alkylcarboxylic acid groups having 1 to 5 carbon atoms, preferably 2 to 5 carbon atoms, of which an acetic acid group is most effective. The requirement of the number of atoms is based on the water solubility of the organic acid group and carboxylic acid groups having 6 or more than 6 carbon atoms may not suitably be used for the purpose of the present invention.

The alcohol amine content of a solution for manufacturing an electron-emitting device according to the invention is between 0.1 and 10 wt % and preferably between 0.25 and 6 wt %. If the alcohol amine content is lower than the above range, the solution would not effectively and stably disperse the transition metal it contains. If, on the other hand, the alcohol amine content is higher than the above range, the solution would not effectively and stably disperse the transition metal it contains and, what is worse, the organic components of the solution would remain unbaked to a large extent in the subsequent baking step and the eject of the solution by means of an ink-jet system would become incomplete.

While any of the group VIII metals can be used for the transition metal contained in a solution for manufacturing an electron-emitting device according to the invention, platinum and palladium of the platinum group and nickel and cobalt of the iron group provide preferable candidates.

Other preferable candidates for the transition group contained in a solution for manufacturing an electron-emitting device according to the invention include ruthenium, gold, silver, copper, chromium, tantalum, iron, tungsten, lead, zinc and tin.

The content of the transition metal in a solution for manufacturing an electron-emitting device according to the invention is between 0.01 and 10 wt % and preferably between 0.1 and 2 wt %. If the metal content is lower than the above range, the solution has to be applied to the surface of the substrate at an enhanced rate in order to deposit a sufficient amount of metal on the substrate. If such a solution is applied in the form of drops, the objective of applying the metal only to desired locations would be unachievable. If, to the contrary, the metal content is higher than the above range, the solution applied to the substrate may be baked and/or dried unevenly in the subsequent steps to consequently produce unevenly profiled electron-emitting regions, which by turn deteriorate the performance of the electron-emitting devices comprising them.

The molar ratio of the alcohol amine relative to the transition metal contained in a solution for manufacturing an electron-emitting device according to the invention is between 1.5 and 16 and preferably between 1.8 and 10. If the alcohol amine content is lower than this range, the stability of the solution containing the transition metal cannot be improved. If, to the contrary, the alcohol amine content exceeds the above range, the dissolution stability of transition metal does not improve significantly and a rough electroconductive film can be produced when the solution for preparing electron-emitting devices is baked.

The organic acid radical content of a solution for manufacturing an electron-emitting device according to the invention is between 0.1 and 2.5 wt % and preferably between 0.12 and 2.2 wt %.

A metal-containing composition according to the invention and described above operate in a following manner. To begin with, one of the objectives of the present invention is to disperse a transition metal which becomes a component of the electroconductive film of a surface conduction electron-emitting device. Transition metal compounds dissolve into a solution containing water as a principal ingredient. However, it is known that, if the transition metal is a high melting point precious metal such as palladium, it can be combined with various ligands to form a complex. While elements that can participate the coordinate bond of a ligand include sulfur, halogen, phosphorus, nitrogen and oxygen, the nitrogen atoms in an amine participate in the coordinate bond with a transition metal for the purpose of the present invention.

In a metal-containing liquid composition containing an organic acid group, a transition metal, one or more than one alcohol amines and water according to the invention preferably also contains an aqueous resin. For the purpose of the present invention, an aqueous resin refers to a hydrophilic polymer that may be a water soluble polymer such as polyvinylalcohol or methylcellulose. The use of partially esterified polyvinylalcohol can be particularly advantageous for the purpose of the invention. Partially esterified polyvinylalcohol is polyvinylalcohol that is partially turned to carboxylic ester. From the viewpoint of the balance of hydrophilicity and hydrophobicity, the molecule of the esterified carboxylic acid preferably has 2 to 5 carbon atoms. The rate of esterification is preferably 5 to 25% relative to a unit of vinylalcohol. A metal-containing liquid composition for manufacturing an electron-emitting device according to the invention that also contains an aqueous resin has advantages including an improved applicability to a substrate, an improved film forming property and a reduced permeability into a porous electrode pattern formed on a substrate by printing.

If the molecule of the aqueous resin is too small, it may not be effective for forming a film and suppressing the permeability of the composition. If the molecule is too large, on the other hand, the applicability and solubility of the solution will be degraded. In short, the average degree of polymerization of an aqueous resin that can be used for a metal-containing liquid composition for manufacturing an electron-emitting device according to the invention is between 450 and 1,200 and its weight average molecular weight is between 20,000 and 100,000. A metal-containing liquid composition for manufacturing an electron-emitting device according to the invention can contain such an aqueous resin by 0.01 to 3 wt % and by 0.01 to 0.5 wt % if it is used with an ink-jet method.

If a water soluble polyhydric alcohol is added to a metal-containing liquid composition for manufacturing an electron-emitting device according to the invention, the drying rate of the composition can be controlled during the operation of applying it onto a substrate to form a film as the composition can be handled with a greater ease and the crystallizing tendency of the solute in the drying step can be suppressed to improve the uniformity of thickness and the quality of the formed film. The polyhydric alcohol that can be used for the purpose of the invention is an alcohol having 2 to 4 carbon atoms that is liquid at room temperature. Ethyleneglycol, propyleneglycol and glycerol are among the alcohols that can be used for the purpose of the invention. The content of such a polyhydric alcohol in a metal-containing liquid composition for manufacturing an electron-emitting device according to the invention is between 0.2 and 3 wt %. If the content of a polyhydric alcohol exceeds the above range, the solution dries with difficulty after application to damage the uniformity of the electroconductive film after a baking step.

A monohydric alcohol can also be added to a metal-containing liquid composition for manufacturing an electron-emitting device according to the invention in order to reduce the surface tension of the liquid composition and improve its wetting to a substrate. A metal-containing liquid composition containing a monohydric alcohol is additionally advantageous because it can be stably ejected by means of an ink-jet system, particularly a bubble-jet system. Such a monohydric alcohol may be selected from monohydric alcohols having 1 to 4 carbon atoms that is liquid at room temperature. Specific examples of such alcohols include methanol, ethanol, 1-propanol, 2-propanol and 2-butanol. The content of such a monohydric alcohol in a metal-containing liquid composition for manufacturing an electron-emitting device according to the invention is between 5 and 35 wt %.

For the purpose of the present invention, a metal-containing liquid composition containing an organic acid group, a transition metal and one or more than one alcohol amines is prepared by using a step of dissolving an organic metal complex comprising as components an organic acid group, a metal and one or more than one alcohol amine into liquid. The components of the organic metal complex have to meet the requirements that the components of a metal-containing liquid composition for manufacturing an electron-emitting device according to the invention should meet. More specifically, the organic acid group of the organic metal complex is an alkylcarboxylic acid group having 1 to 5 carbon atoms, which is preferably an acetic acid group. The alcohol amine of the organic metal complex is an amine expressed by formula (1) above, where R1 is an alkyl group having 1 to 4 carbon atoms, R2 is an alkyl carbon chain having 1 to 4 carbon atoms and m and n are integers of 0 to 2 that satisfy the relationship of $(m+n)<3$. For the purpose of the present invention, it is preferable that m and n are 2 and 0 respectively. Specifically, the use of a monoethanol amine is preferably. Alternatively, the alcohol amine of the organic metal complex may be an amine expressed by chemical formula (2), where R3 is a substitute selected from H, $CH_3$, $CH_2OH$ and $CH_2CH_3$, R4 is H or $CH_2OH$, R5 is H or $CH_3OH$ and k is an integer of 0 to 2, the composition containing three to five carbon atoms in a molecule. Specific examples include trishydroxymethylaminomethane.

A method of manufacturing a surface conduction electron-emitting device according to the invention and comprising an electron-emitting region arranged between a pair of oppositely disposed electrode comprises a step of applying a metal-containing liquid composition onto a substrate and a subsequent step of baking the substrate that carries the metal-containing liquid composition in order to produce an electron-emitting region.

While any ordinary application techniques such as dipping and spin coating may be used for applying the metal-containing liquid composition onto a substrate, the use of a technique of applying drops of a liquid composition such as an ink-jet system is particularly advantageous because the metal-containing liquid composition can be applied onto a substrate on a drop by drop basis. The metal-containing liquid composition may be applied onto a substrate to form a desired pattern not by evenly applying it but by applying a number of drops onto a same spot of the substrate or side by side with a given area to make it consequently wet with the liquid composition.

When the metal-containing liquid composition applied onto the substrate is baked, a thin film of the metal or the metal oxide is produced on the substrate and can be used for a surface conduction electron-emitting device. If a large number of surface conduction electron-emitting devices are formed on the substrate, they can be used as an electron source, which by turn may be used for an image-forming apparatus or a display apparatus.

Now, a method of preparing various organic metal complexes that can advantageously be used for a metal-containing liquid composition and a method of manufacturing electron-emitting devices will be described along with a method of manufacturing an electron source and that of manufacturing a display apparatus or an image-forming apparatus.

The inventors of the present invention have found that an organic metal complex expressed by chemical formula (3) below is easily soluble into water and decomposable through heat treatment at relatively low temperature but would not sublimate and hardly crystallize so that it can suitably be used for forming an electroconductive film by appropriate application means such as an ink-jet system;

$$(R^2COO)_m M\{NH_n(R^1OH)_{(3-n)}\}_l \quad (3)$$

where $R^1$ is an alkylene or polymethylene group having 1 to 4 carbon atoms, $R^2$ is an alkyl group having 1 to 4 carbon atoms, l and m are integers of 1 to 4, n is an integer of 0 to 2 and M is a metal element.

$R^1$ in formula (3) above for an organic metal complex represents an alkylene or polymethylene group having 1 to 4 carbon atoms. While specific examples of such groups include a methylene group, a methylmethylene group, an ethylene group, an ethylmethylene group, a dimethylmethylene group, a methylethylene group, a trimethylene group, n-propylmethylene group, an isopropylmethylene group, a ethylmethylmethylene group, a ethylethylene group, a 1,1-dimethyethylene group, a 1,2-dimethylethylene group, a 1-methyltrimethylene group, 2-methyltrimethylene group and a tetramethylene group, an ethylene group (—$CH_2CH_2$—) or a dimethylmethylene group (—$(CH_3)_2C$—) is preferable. An organic metal complex expressed by formula (3) is advantageously dissolved into water with ease when $R^1$ is an ethylene group or a dimethylmethylene group.

$R^2$ in formula (3) above for an organic metal complex represents an alkyl group having 1 to 4 carbon atoms. While specific examples of such groups include a methyl group, an ethyl group, an n-propyl group, an isopropyl group, an n-butyl group, a sec-butyl group, an isobutyl group and a tert-butyl group, a methyl group is preferable. An organic metal complex expressed by formula (3) is advantageously dissolved into water with ease when $R^2$ is a methyl group.

The metal element (M) that takes a central role in an organic metal complex according to the invention has to be liable to emit electrons when a voltage is applied thereto. In other words, it has to be an element that has a low work function and is stable. Specific examples include elements of the platinum group such as Pt, Pd and Ru as well as Au, Ag, Cu, Cr, Ta, Fe, Co, W, Pb, Zn, Sn, Ti, In, Sb, Hf, Zr, La, Ce, Y, Gd, Si and Ge. Preferably, the metal element is selected from Pt, Pd, Ru, Au, Ag, Cu, Cr, Ta, Fe, W, Pb, Zn and Sn.

A organic metal complex that can be used for the purpose of the invention can be formed by adding an alcohol-substituted amine to a metal salt of alkylcarboxylic acid. For example, palladium acetate-ethanol amine complex can be obtained by dissolving palladium acetate into a solvent and adding ethanol amine to the solution.

In an organic metal complex that can be used for the purpose of the invention, the valence number of the metal ion (M) or the number of molecules of carboxylic acid combined with a molecule of the metal can vary from 1 to 4 depending on the specific metal used. For example, when silver and acetic acid are combined, silver monoacetate most typically appears. When palladium and acetic acid are combined, palladium diacetate is most typical. Similarly, yttrium triacetate is the most typical form that takes place when yttrium and acetic acid are combined and lead tetraacetate most typically appears as a combination of lead and acetic acid.

The number of alcohol-substituted amine molecules to be coordinated with a molecule of a metal salt of alkylcarboxylic acid in an organic metal complex that can be used for the purpose of the invention can also vary from 1 to 4 depending on the valence number of the metal ion (M), the coordination form or the alkylation degree of the amine. If the metal is palladium, it varies from 2 to 4. For example, 4 molecules of monoethanole amine or 2 molecules of diethanol amine are coordinated with a molecule of palladium.

Since N in formula (3) above can be easily coordinated with the metal atom (M) and OH has a strong affinity to water, an organic metal complex that can be used for the purpose of the invention will be easily dissolved into water. Therefore, an aqueous solution of an organic metal complex that can be used for the purpose of the invention is particularly adapted to the formation of thin film by means of an ink-jet system or a bubble-jet system as will be described hereinafter. An organic metal complex that can be used for the purpose of the invention hardly crystallizes and this fact is evidenced by an X-ray diffraction test, where an aqueous solution of an organic metal complex is applied to form a thin film. Like many organic acid salts of metals such as palladium acetate, an organic metal complex that can be used for the purpose of the invention does not have a definite melting point and a thin film of the complex is easily pyrolyzed without melting when heated, although it does not sublimate unlike palladium acetate.

A second organic metal compound that can be used for the purpose of the invention like the first organic metal compound described above is expressed by chemical formula (4) below;

$$(R^2COO)_m M\{NH_n R^3_k(R^1OH)_{(3-n-k)}\}_l \quad (4)$$

where each of $R^1$, $R^2$ and $R^3$ is an alkyl group having 1 to 4 carbon atoms, l is an integer of 2 to 4, m is an integer of 1 to 4, k is an integer of 1 to 2, n is an integer of 0 to 1 and M is a metal element.

The metal element that takes a central role in an organic metal complex according to the invention has to be liable to emit electrons when a voltage is applied thereto. In other words, it has to be an element that has a low work function and is stable. Specific examples include elements of the platinum group such as Pt, Pd and Ru and those of the iron group such as Fe, Ni and Co as well as Au, Ag, Cu, Cr, Ta, Co, W, Pb, Zn and Sn.

A third organic metal compound or a hydrate thereof that can be used for the purpose of the invention like the first and second organic metal compounds described above is expressed by chemical formula (5) below;

$$(R^1COO)_nNi\{NH_1(R^2)_{3-m-1}(R^3OH)_m\}_e \quad (5)$$

where $R^1$ a hydrogen atom or an alkyl group having 1 to 4 carbon atoms, $R^2$ is an alkyl group having 1 to 4 carbon atoms, $R^3$ is an alkylene group having 2 to 4 carbon atoms, n is an integer of 1 to 4, m is an integer of 1 to 3, l is an integer of 0 to 2 and n is an integer of 2 to 4.

A fourth organic metal compound composed of an organic acid, a metal and aminoalcohol that can be used for the purpose of the invention like the first through third organic metal compounds described above is expressed by chemical formula (5) below;

$$(R^1COO)_mM\{NH_2C(R^2)(R^3)CH(R^4)(CH_2)_kOH\}_l \quad (6)$$

where $R^1$ a hydrogen atom or an alkyl group having 1 to 4 carbon atoms, $R^2$ is a substituent selected from H, $CH_3$, $CH_2OH$ and $CH_2CH_3$, $R^3$ is H or $CH_2OH$, $R^4$ is H or $CH_3$ and k is an integer of 0 to 2, the sum of the numbers of carbon atoms in $R^2$, $R^3$ and $R^4$ and k being 1 to 3, m is an integer of 1 to 4 and l is an integer of 2 to 4.

Specific examples of organic acid that can be used for the purpose of the present invention include those having a carboxylic group with 1 to 4 carbon atoms such as formic acid, acetic acid, propionic acid, lactic acid, isolactic acid, oxalic acid, malonic acid and succinic acid, of which acetic acid and propionic acid are preferable. Metal salts of acids having 5 or more than 5 carbon atoms are not suitable for the purpose of the present invention because such salts are poorly soluble to water and the metal content of a solution to be applied onto a substrate for manufacturing an electron-emitting device inevitably becomes low if the solution contains such a salt.

Organic metal complexes comprising organic acids such as acetic acid are well known and can be used for manufacturing electron-emitting devices that operate excellently for electron emission. However, it is also known that, when manufacturing a large number of electron-emitting devices on a large substrate by using such an organic metal complex, the organic metal complex can aggregate or deposit crystal to make it difficult to uniformly produce devices. Thus, the inventors of the present invention have carried out extensive researches to find out organic metal complexes that do not deposit crystal, while maintaining the electron-emitting property, and found that an organic metal complex comprising aminoalcohol or aminoalcohol and palladium and an acetic acid group is most effective for the purpose of the invention.

While no specific limitations exist for aminoalcohols that can be used for the purpose of the present invention, those having 3 to 5 carbon atoms may preferably be used. Examples of aminoalcohol that can be used for the purpose of the present invention include aminomethylpropanol, aminomethylpropanediol, trishydroxymethylaminomethane, 1-amino-2-propanol, 3-amino-1-propanol, 2-amino-1-propanol, 2-amino-1-butanol and 4-amino-1-butanol. Of these aminoalcohols, trishydroxymethylaminomethane is most preferably used.

An organic metal complex according to the invention can be prepared by mixing aminoalcohol and a metal salt of alkylcarboxylic acid in a solvent and causing them to react with each other.

Metals that can be used for organic metal compounds for the purpose of the present invention include elements of platinum group such as platinum, palladium and ruthenium as well as gold, silver, copper, chromium, tantalum, iron, nickel, cobalt, tungsten, lead, zinc and tin.

As described above, an organic metal complex according to the invention can be prepared by causing aminoalcohol and a metal salt of alkylcarboxylic acid to react with each other, although the number of aminoalcohol molecules to be combined with the metal can vary from 1 to 4 depending on the valence number of the metal ion. When, for example, silver and acetic acid are combined, silver monoacetate most typically appears. When palladium and acetic acid are combined, palladium diacetate is most typical. Similarly, yttrium triacetate is the most typical form that takes place when yttrium and acetic acid are combined and lead tetraacetate most typically appears as a combination of lead and acetic acid. Four molecules of trishydroxymethylaminomethane are coordinated with palladium acetate.

Most organic metal complexes are highly crystallizing. For example, when drops of their complex solution is applied onto a substrate, crystal can easily be deposited in a subsequent drying or baking step to produce highly uneven film. Contrary to this, an organic metal complex containing aminoalcohol according to the invention, particularly an organic metal complex containing therein aminoalcohol having 3 to 5 carbon atoms or an organic metal complex containing therein trishydroxymethylaminomethane as aminoalcohol hardly give rise to crystallization and therefore, if the solution of such an organic metal complex is applied onto a substrate in order to produce electroconductive film, no crystallization occurs in the applying step nor in a subsequent drying or baking step. This remarkable property of not depositing any crystal and producing uniform film is particularly effective when a large number of electron-emitting devices are manufactured on a large substrate because the manufacturing process takes a considerably long time.

Any of the organic metal compounds as described above can be dissolved into water or a solvent comprising water as a principal component. When such a solution is applied onto a substrate and dried, no remarkably crystallization takes place. The compound is thermally decomposed to produce the metal or an oxide of the metal at relatively low temperature of below 500° C. No sublimation occurs when heated. Such organic metal compounds may be used independently or a number of them may be combined for use.

A metal-containing solution to be used for the purpose of the present invention utilizes the advantageous properties of any of the above described organic metal compounds. Therefore, such a solution can be prepared by dissolving the organic metal compound into the solvent. With another method of preparing a metal-containing solution for the purpose of the present invention, the organic metal compound is not directly dissolved into the solvent but the components of the organic metal compound are added separately to the solvent to coexist therein and react with each other. More specifically, since the organic metal compound is formed from an organic acid group, a metal and an aminoalcohol, the organic metal compound can be prepared by adding a compound comprising the organic acid group, a compound comprising the metal and a compound comprising the aminoalcohol to the solvent. Note, however, that the organic acid group, the metal and the aminoalcohol should confirm to the respective definitions as described above.

Any of the above listed compounds may be added independently to produce a metal-containing liquid composition according to the invention. The addition of an organic salt of a metal and an alcohol-substituted amine is advantageous for the purpose of the invention.

While a metal-containing solution to be used for manufacturing an electron-emitting device according to the invention contains an organic metal complex as described above that is highly water-soluble, hardly crystallizing and decomposable at relatively low temperature, it does not need to necessarily contain the components of the organic metal complex or an organic acid group, a metal and an alcohol-substituted amine to a ratio that stoichiometrically agrees with the ratio of the components of the organic metal complex.

From the viewpoint of suppressing the formation of crystal at the time of drying and baking the solution, which constitutes an objective of the present invention, the metal-containing solution preferably contains a plurality of compounds that are structurally slightly different from each other rather than a single and pure organic metal complex. In other words, it can effectively suppress the formation of crystal when it contains an organic acid group, a metal and an alcohol amine at a ratio that does not stoichiometrically agree with that of the components of the organic metal complex rather than when it contains them at the stoichiometric ratio of the organic metal complex.

If a metal-containing solution is prepared for the purpose of the present invention by using an alcohol amine expressed by formula 2 in excess relative to the metal, it does not give rise to the formation of crystal if it is dried in ambient air or under a condition that can accelerate the formation of crystal.

Since a metal-containing solution that contains more than one alcohol amines for the purpose of the present invention shows the effect of containing more than one organic metal complexes, it can effectively suppress the formation of crystal by the same token.

Known additives that are used for preventing crystal deposition include, besides aminoalcohol, moisture-maintaining and crystallization-preventing agents such as trishydroxymethylethane, trimethyrolpropane and pentaerythritol, succharides such as glucose and sucrose and urea. However, compounds having no amino groups such as trishydroxymethylethane and trimethyrolpropane do not operate effectively for preventing crystal deposition for the purpose of the present invention. While succarides such as glucose and sucrose can prevent crystal deposition, they can give rise to uneven electroconductive films. If urea is used, the metal-containing solution that also contains urea is applied to be ejected unevenly in terms of rate and direction of ejection in the process of applying a metal-containing solution onto a substrate by means of a bubble-jet printer head and, therefore, no satisfactory electroconductive film can be produced. Contrary to this, a metal-containing solution that also contains aminoalcohol according to the invention would not give rise to any deposition of crystal of a metal compound in the process of applying drops of the solution onto a substrate to produce electron-emitting devices. Nor the solution is accompanied by the problem of uneven ejection from a bubble-jet printer head so that uniform electroconductive films can feasibly be prepared for the purpose of the present invention. Although the reason for this is not clear to date, the inventors of the present invention assumes that evaporation of the solvent of the metal-containing solution that is principally water is suppressed by the high hygroscopic property of aminoalcohol to prevent crystal deposition of the metal compound contained therein. Additionally, the ligand of the organic metal complex may be switched by the amino group of aminoalcohol and/or the vicinity of the ligand field may otherwise be affected by the amino group of aminoalcohol so that crystal deposition of the organic metal complex contained in the solution may be prevented from taking place.

When an alcohol amine is coordinated with a transition metal for the purpose of the present invention, it is most probably the nitrogen atoms that are actually coordinated with the transition metal and, therefore, the organic metal complex presumably has a structure where the hydroxyl group of the alcohol amine is exposed to the outside. This is probably the reason why the organic metal complex shows an enhanced degree of water solubility and molecules of the organic metal complex show a strong affinity relative to each other to suppress any possible sublimation.

In order to regulate the viscosity of the metal-containing liquid composition containing an organic acid group, a metal and one or more than one alcohol amines for manufacturing an electron-emitting device according to the invention, water soluble resin may be added to it. In the process of preparing a material for manufacturing an electron-emitting device according to the invention, an specific aqueous resin may be added to an aqueous solution of a specific organic metal complex in order to regulate the viscosity of the aqueous solution and prevent drops of the solution from permeating into the device electrodes that have been formed by printing and have a relatively small film density.

Generally, a thin film formed by printing has a film density lower than the one formed by some other technique such as evaporation and, therefore, the aqueous solution of the material for forming an electron-emitting region applied onto the printed electrodes of an electron-emitting device may partially permeate into the electrodes. If such a phenomenon takes place on some of a number of electron-emitting devices being collectively formed on a common substrate, the devices may show an uneven film thickness when they are dried or baked so that, consequently, the electroconductive films of the devices for forming an electron-emitting region can become uneven to give rise to deviations in the performance of the electron-emitting devices.

Water soluble resin is added to a metal-containing solution to be used for the purpose of the present invention in order to prevent such a phenomenon from taking place. By adding aqueous resin to the solution and regulating the viscosity of the solution, the latter can effectively be prevented from permeating into the device electrodes and maintain the profile of drops to consequently make it possible to produce uniform electroconductive films.

On the other hand, water soluble resin should not chemically react with the organic metal complex or the principal component of the solution. Resins that can be used for the purpose of the present invention include polyvinylalcohol, polyethyleneoxide, starch, methylcellulose and hydroxyethylcellulose. Water soluble resins that can be used for the purpose of the present invention are required to be completely decomposed at the baking temperature so that no residue may be found after the baking operation.

Any technique may be used for applying aqueous solution of an organic metal compound so long as it can apply the solution in the form of drops, although an ink-jet system may preferably be used because it can produce fine drops efficiently and accurately in a controlled manner. An ink-jet system may use a piezoelectric device that generates mechanical impact to produce fine liquid drops or a bubble-jet (BJ) device that generates liquid drops by heating the solution by means of minute heaters until it bubbles up. In any case, fine liquid drops between several nanograms to tens of several nanograms can be generated in a well reproducible manner and applied onto a substrate.

When applying liquid drops by means of a BJ device or the piezoelectric device, the viscosity of the aqueous solution is preferably between 10 and 20 centipoise at 25° C. so that resin has to be added to bring the viscosity of the solution within this range. The concentration of the added water soluble resin is preferably between 0.01 and 0.5 wt % and more preferably between 0.03 and 0.1 wt %. The solution cannot be used for the purpose of the present invention if the concentration is less than 0.01 wt %, whereas it cannot be ejected continuously by means of an ink-jet system if the concentration is greater than 0.5 wt %.

A metal-containing solution for manufacturing an electron-emitting device for the purpose of the present invention may contain a water soluble metal compound and partially esterified polyvinylalcohol.

For the purpose of the present invention, partially esterified polyvinylalcohol is a polymer comprising both vinylalcohol units and vinylester units. Such partially esterified polyvinylalcohol can be obtained by partially esterifying commercially available "perfectly" hydrolyzed polyvinylalcohol by means of any of various acylating agents, which may be carboxylic anydrides such as acetic anhydride or acyl halides such as acetyl chloride. Partially hydrolyzed polyvinylalcohol can also be obtained by suspending midway of the hydrolysis of polyvinylacetate in the process of manufacturing polyvinylalcohol by hydrolyzing polyvinylacetate. From the viewpoint of availability and cost, partially hydrolyzed polyvinylalcohol provides a most promising source of partially esterified polyvinylalcohol for the purpose of the present invention.

Acyl groups that can be used for producing esters for the purpose of the present invention include, besides the above described acetyl group, those derived from aliphatic carboxylic acids such as propionyl, butyroyl and stearoyl groups. An acyl group to be used for the purpose of the present invention has to have 2 or more than 2 carbon atoms. On the other hand, any clear upper limit of the number of carbon atoms of the acyl group has not been found and acyl groups having 18 carbon atoms have been proved to be effective for the purpose of the present invention.

For the purpose of the present invention, the extent of esterification is very important for the above described partially esterified polyvinylalcohol. For instance, commercially available "perfectly" hydrolyzed polyvinylalcohol, where the acetyl groups have been removed by 99%, does not show any effect of chemically stabilizing the film formed by applying a metal-containing liquid composition according to the invention. On the other hand, perfectly esterified polyvinylalcohol such as polyvinylacetate is not water soluble and hence cannot be used in a metal-containing liquid composition according to the invention. The rate of esterification of the partially esterified polyvinylalcohol that can be used for the purpose of the present invention is between 5 and 25 mol %. It will be very effective particularly when the rate of esterification is found between 8 and 22 mol %. For the purpose of the present invention, the rate of esterification refers to the ratio of the number of combined acyl groups relative to the number of repetition units of polymeric total vinylalcohol. This rate can be quantitatively determined by means of an appropriate technique such as elementary analysis and infrared radiation absorption analysis.

For the purpose of the present invention, the degree of polymerization of the partially esterified polyvinylalcohol should be between 400 and 2,000. If the degree of polymerization is lower than the above range, film of the metal composition cannot stably be formed. If, on the other hand, the degree of polymerization exceeds the above range, the metal composition can provide difficulties in the process of applying the solution and the produced film may become too thick. The use of partially esterified polyvinylalcohol with a degree of polymerization between 450 and 1,200 is most preferable for forming an electroconductive film containing an electron-emitting region having a suitable film thickness.

The concentration of partially esterified polyvinylalcohol in the metal-containing liquid composition to be used for the purpose of the present invention is between 0.01 and 0.5%. If the concentration is lower than the above range, the effect of adding the polymer is not satisfactory apparent. If, on the other hand, the concentration exceeds the above range, the viscosity of the metal-containing liquid composition becomes too high for it to be applied appropriately and the polymer may not be completely dissolved and removed and remain in the produced electron-emitting region after the baking operation.

A metal-containing liquid composition according to the invention preferably contains water soluble polyhydric alcohol. For the purpose of the present invention, polyhydric alcohol refers to a compound having a plurality of alcohol-related hydroxyl groups within a molecule. Polyhydric alcohols that have 2 to 4 carbon atoms within a molecule and is liquid at room temperature may suitably be used with a metal-containing liquid composition for the purpose of the present invention. Specific examples include ethyleneglycol, propyleneglycol, 1,3-propanediol, 3-methoxy-1,2-propanediol, 2-hydroxymethyl-1,3-propanediol, diethyleneglycol, glycerol and 1,2,4-butanetriol. The polyhydric alcohol content of a metal-containing liquid composition according to the invention is less than 5% and preferably between 0.2 and 3%. If the content exceed the above limit, the metal-containing liquid composition densely applied to the surface of a substrate takes an undesirably long time for drying.

It is desirable that a metal-containing liquid composition according to the invention additionally contains water soluble monohydric alcohol. Water soluble monohydric alochols that can be used for the purpose of the present invention have 1 to 4 carbon atoms within a molecule and are liquid at room temperature. Specific examples include methanol, ethanol, 1-propanol, 2-propanol and 2-butanol.

The content of such water soluble monohydric alcohol in a metal-containing liquid composition according to the invention is not greater than 40 wt %. If the content exceeds that limit, the solubility of the water soluble organic metal compound of the composition can remarkably fall and, when the composition is applied to the surface of a substrate, it can extend limitlessly to make it difficult to form a film having a desired pattern. The content of the water soluble monohydric alcohol in a metal-containing liquid composition according to the invention is preferably between 5 and 35 wt %.

A metal-containing liquid composition that additionally contains partially esterified polyvinylalcohol for forming an electron-emitting device for the purpose of the present invention has a remarkable property of being evenly applied onto a substrate to form a uniform film thereon. The most remarkable advantages of such a composition is that it can evenly adhere to the substrate if the surface of the substrate is not smooth and uniform.

As described earlier, one of the objectives of the present invention is to provide a liquid composition that can evenly adhere to the surface of a substrate regardless of the material of the substrate. The solvent of a small drop of the metal-containing liquid composition according to the invention and applied to the surface of the substrate is volatile and starts drying immediately after the application of the composition to raise the concentration of the dispersed non-volatile components. Normally, this rise in the concentration will intensify the interaction of the components of the metal-containing liquid composition to consequently not only raise the viscosity of the entire composition but also change the surface tension of the liquid composition. While the surface tension of the metal-containing liquid composition may be mainly governed by the composition of the solvent because the solvent takes a large part of the composition at the time of application, the non-volatile components may increase its influence on the surface tension as the solvent is gradually lost by evaporation and the concentration of the non-volatile components rises with time.

The phenomenon that the surface of a solid object wet by liquid is given rise to by the surface energy (surface tension) of the liquid. Thus, in order to a metal-containing liquid composition to form a stable film on the surface of a substrate without being neither repelled by the substrate nor excessively extended after it is applied, the surface energy of the metal-containing liquid composition densified with time in the course of drying has to be maintained to an appropriate level. On the other hand, the texture and the state of the surface of the substrate (and therefore the surface tension of the applied metal-containing liquid composition) is not necessarily uniform and constant in the manufacture of electron-emitting devices. In short, the appropriate range of the surface energy of the metal-containing liquid composition applied to the surface of the substrate and considerably dried cannot be specifically referred to and it is impossible to define an appropriate range of surface energy that makes the applied metal-containing liquid composition suitably adhere to the intended area of the surface of the substrate because the substrate can carry different textures and states on the surface.

However, in a series of experiments using a metal-containing liquid composition that also contains partially esterified polyvinylalcohol, excellent film could be formed on the surface of the substrate regardless of the texture and the state of the surface. It should be noted that the use of perfectly esterified polyvinylalcohol or scarcely esterified polyvinylalcohol did not give rise to this effect and only partially esterified polyvinylalcohol was effective. Since partially esterified polyvinylalcohol refers to the coexistence of a vinylalcohol portion and a vinylester portion in a same solution, it will be safe to assume that this remarkable effect on the part of partially esterified polyvinylalcohol arises from the surface activity of an amphiphilic polymer comprising a hydrophylic vinylalcohol portion and a hydrophobic vinylester portion. In other words, the inventors of the present invention assume that an amphiphilic polymer is made to exist in the solid/liquid interface depending on the nature of the surface of the substrate to which it is applied and help the formation of stable film regardless of the texture and the state of the surface of the substrate.

The effect of stabilizing the applied film forming solution clearly differs from a reduced surface tension of the applied solution that can be brought forth by the use a surface-active agent. For instance, while a typical surface-active agent such as a polyethyleneglycol type or some other type non-ion surface-active agent can remarkably reduce the surface tension of the applied solution, it does not show a stabilizing effect as described above. On the basis of this and other observations obtained from experiments, it can be concluded that the stabilizing effect of partially esterified polyvinylalcohol is something special and differs from the ordinary effect of surface-active agents. From the fact that partially esterified polyvinylalcohol having an average degree of polymerization of as low as 300 does not show any remarkable stabilizing effect, it may be safe to assume that only partially esterified polyvinylalcohol having a large molecule size can show the effect. Ordinary surface-active agents and partially esterified polyvinylalcohol having a low degree of polymerization probably do not show any rise of viscosity and the film may be damaged or become uneven in the course of drying the applied solution. Only partially esterified polyvinylalcohol having a large molecular size that is amphiphilic and provides the applied solution with a sufficiently high viscosity can stabilize the film in the course of drying the applied solution.

In general, the solution of a polymer shows a high viscosity when the solution is partly evaporated and become dense. As the solution is almost dried and appears as if a solid film, it still shows resistance against bending and tension. Thus, a metal-containing liquid composition for manufacturing an electron-emitting device that also contains partially esterified polyvinylalcohol produces a stable and uniform film as it is applied on a substrate and dried and the formed film would not show any damage or crack in the course of drying. Then, an uniform electroconductive film can be produced by baking the film. Such an electroconductive film can be used for manufacturing an electron-emitting device that operates stably.

A metal-containing liquid composition for manufacturing an electron-emitting device according to the invention shows, when polyhydric alcohol is further added thereto, an effect of unifying the thickness of the film applied on the surface of a substrate. While the mechanism of this effect is not clear yet, experiments shows that, if polyhydric alcohol is added to the metal-containing liquid composition for manufacturing an electron-emitting device at a reduced rate, it controls the film thickness from the periphery toward the center to produce a uniformly distributed film thickness.

While the mechanism of controlling the distribution of film thickness of polyhydric alcohol is not clear yet, the distribution of film thickness may be affected by the drying rate of the applied solution in view of the fact that polyhydric alcohol having a high boiling point and a hygroscopic property is effective in the respect. In other words, as the applied solution is condensed by drying, the concentration of the poorly evaporating polyhidric alcohol rises and consequently increases its influence on the regulation of the surface tension and the viscosity of the solution. Additionally, since polyhydric alcohol interacts with polyvinylalcohol to soften the polymer film, it may reduce the stress generated in the film forming solution in the course of drying.

If water soluble monohydric alcohol is added, a metal-containing liquid composition for manufacturing an electron-emitting device according to the invention adheres well to the substrate immediately after it is applied to the substrate. This may be because the added water soluble monohydric alcohol reduces the surface tension of the liquid composition. This effect of water soluble monohydric alcohol is important when the metal-containing liquid composition is applied to the surface of a substrate to form a desired pattern by means of an ink-jet system. In order to apply fine drops to the surface of a substrate to form a desired pattern by means of an ink-jet system, the drops shot at the substrate have to hit the respective targets and produce minute pools there and adjacent pools have to unite with each other to form a larger pool.

In other words, when a plurality of drops are put to the surface of a substrate simultaneously or successively, each of the drops has to extend on the surface without displacing any of the remaining drops but adjacent drops have to unite with each other to form a relatively large pool. This effect can be obtained when water soluble monohydric alcohol is added to a metal-containing liquid composition according to the invention by 5 to 40 wt %. The addition of water soluble monohydric alcohol brings forth the effect of reducing the surface tension of a metal-containing liquid composition for manufacturing an electron-emitting device according to the invention so that drops of the liquid composition can quickly wet the surface of the substrate to which it is applied and extend themselves.

While partially esterified polyvinylalcohol also shows a certain degree of surface activity, a satisfactory effect can be achieved by combining it with water soluble monohydric alcohol. This is probably because large molecules such as those of partially esterified polyvinylalcohol takes time before the effect of their surface activity becomes apparent since the chain of the polymer has to be rotated and relocated to reduce the surface energy and do not effectively operate immediately after drops containing them get to the targets. On the other hand, water soluble monohydric alcohol does not take such a long time before it exerts its effect of surface activity and hence the effect becomes apparent immediately after drops containing them get to the targets to extend the pools formed there.

After a metal-containing liquid composition according to the invention is applied onto an insulating substrate, it is dried and baked to dissipate the organic components and produce an electroconductive film on the substrate. Means that can be used for applying the composition include known techniques such as dipping, spin coating and spraying. If the metal-containing liquid composition comprises a solvent containing water as a principal component and partially esterified polyvinylalcohol is added thereto as described above, it can be easily and effectively applied to the substrate to form a uniform film regardless of the texture of the surface of the substrate and the means used for applying the composition.

In the manufacture of an electron-emitting device, an electroconductive film has to be formed on a predetermined position of the substrate to show a predetermined contour. Such an electroconductive film may be prepared by forming an electroconductive film over an excessive large area on the substrate and then removing any unnecessary portions of the film, leaving the film only in the predetermined boundary. Alternatively, it may be prepared by applying the material composition only in within a predetermined boundary and baking the composition.

While a mask may be used in combination with a known application technique such as dipping, spin coating or spraying in order to apply a metal-containing liquid composition only to a predetermined area, such a composition may alternatively be applied only to a predetermined area without using a mask.

While a metal-containing liquid composition according to the invention can be applied to a predetermined area of the surface of a substrate by any appropriate means if such means applies the composition in the form of fine drops, an ink-jet system provides an effective and efficient means for applying such a composition in the form of fine drops in a highly controlled manner. An ink-jet system may use a piezoelectric device that generates mechanical impact to produce fine liquid drops or a bubble-jet (BJ) device that generates liquid drops by heating the solution by means of minute heaters until it bubbles up. In any case, fine liquid drops between several nanograms to tens of several nanograms can be generated in a well reproducible manner and applied onto a substrate.

For the purpose of the present invention, applying fine drops of a metal-containing liquid composition does not necessarily means that a single fine drop is applied to a spot on the surface of the substrate only once and a plurality of fine drops may be applied to a same spot repeatedly until the spot comes to carry a desired amount of the composition. When a drop is applied independently to a spot on the surface of the substrate, it typically becomes a round film. However, a thin film having a desired contour can be formed by applying fine drops of the composition in a successive manner to locations slightly displaced from each other by a distance smaller than the diameter of the round area to be occupied by each drop.

The metal composition applied to the substrate by any of the above described means forms an electroconductive film of inorganic fine particles for electron emission on the substrate when it is subjected to a baking operation. The term a "film of fine particles" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between a tenth of a nanometer and hundreds of several nanometers and preferably between a nanometer and twenty nanometers.

For the drying process, techniques such as natural drying, blow drying and heat drying may be used. The metal composition contained in the solution and applied to the substrate can be dried, for example, by leaving the substrate in an electric drier heated to 70 to 130° C. for 30 seconds to 2 minutes. The subsequent baking process can be carried out by using any ordinary heating means. While the baking temperature has to be selected so as to decompose the applied organic metal compound into inorganic fine particles, it is typically between 150 and 500° C. The baking operation may be conducted in a reducing gas atmosphere, a oxidizing gas atmosphere, an inert gas atmosphere or in vacuum. In a reducing gas atmosphere or in vacuum, metal fine particles are typically produced as the organic metal compound is thermally decomposed. On the other hand, in an oxidizing gas atmosphere, metal oxide fine particles are typically formed. However, it should be noted that the baking atmosphere is not the sole determinant of the oxidized condition of the produced fine particles. For instance, metal fine particles may be firstly produced as the organic metal compound is thermally decomposed in the baking process and then, as the baking is carried on, the metal fine particles may be oxidized to make metal oxide fine particles. For the purpose of the present invention, it does not matter if the final product is metal fine particles or metal oxide fine particles so long as an electroconductive film of fine particles is formed for an electron-emitting device. The baking process is preferably conducted in air so that a simple baking apparatus may be used to reduce the manufacturing cost. While the baking time may vary depending on the type of the organic metal compound involved, the baking atmosphere and the baking temperature, it is typically between 2 and 40 minutes. While the baking temperature may be held to a constant level, it may alternatively be varied according to a predetermined program. The drying process and the baking process do not necessarily be distinct processes and may be carried out successively.

(A Method of Manufacturing an Electron-emitting Device)

Now, a method of manufacturing an electron-emitting device according to the invention will be described. While a flat type electron-emitting device is described here, the method of the present invention may be applied to electron-emitting devices of other types.

Figure 1B:
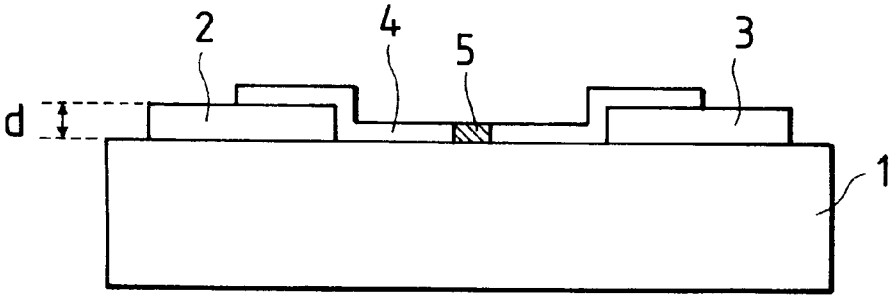

FIGS. 1A and 1B schematically shows a plane type surface conduction electron-emitting device to which the present invention can be applied. A plan view is shown in FIG. 1A, while FIG. 21 shows a cross sectional view. The basic configuration of a surface conduction electron-emitting device according to the invention will firstly be described.

Referring to FIGS. 1A and 1B, the device comprises a substrate 1, a low potential side device electrode and a high potential side device electrode 2 and 3, an electroconductive thin film 4 and an electron-emitting region 5.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina.

While the oppositely arranged device electrodes 2 and 3 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as polysilicon.

The distance L separating the device electrodes, the length W of the device electrodes, the contour of the electroconductive film 4 and other factors for designing a surface conduction electron-emitting device according to the invention may be determined depending on the application of the device.

The distance L separating the device electrodes 2 and 3 is preferably between hundreds nanometers and hundreds micrometers and, still preferably, between several micrometers and tens of several micrometers depending on the voltage to be applied to the device electrodes.

The length W of the device electrodes is preferably between several micrometers and hundreds of several micrometers depending on the resistance of the electrodes and the electron-emitting characteristics of the device. The film thickness d of the device electrodes 2 and 3 is between tens of several nanometers and several micrometers.

A surface conduction electron-emitting device according to the invention may have a configuration other than the one illustrated in FIGS. 1A and 1B and, alternatively, it may be prepared by laying a thin film 4 on a substrate 1 and then a pair of oppositely disposed device electrodes 2 and 3 on the thin film.

The electroconductive thin film 4 is preferably fine particle films in order to provide excellent electron-emitting characteristics. The thickness of the electroconductive thin film is determined as a function of the stepped coverage of the electroconductive thin films on the device electrodes 2 and 3, the electric resistance between the device electrodes 2 and 3 and the parameters for the forming operation that will be described later as well as other factors and preferably between a tenth of a nanometer and hundreds of several nanometers and more preferably between 10 A and 500 A . The electroconductive thin film 4 normally shows a sheet resistance between $10^2$ and $10^7\Omega/\square$.

The electroconductive thin film 4 is made of fine particles of a material selected from metals such as Pd, Ru, Ag, Au, Ti, In, Cu, Cr, Fe, Zn, Sn, Ta, W and Pb and oxides such as PdO, $SnO_2$, $In_2O_3$, PbO and $Sb_2O_3$.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between several A and thousands of several A and preferably between 10 A and 200 A.

The electron-emitting region 5 is formed as part of the electroconductive thin film 4 comprises an electrically highly resistive fissure, although its performance is dependent on the thickness and the material of the electroconductive thin film 4 and the energization forming process which will be described hereinafter. The electron emitting region 5 may contain in the inside electroconductive fine particles having a diameter between several times of a tenth of a nanometer and tens of several nanometers. The material of such electroconductive fine particles may be selected from all or part of the materials that can be used to prepare the thin film 4 including the electron emitting region 5. The electron-emitting region 5 and neighboring areas of the electroconductive film 4 may contain carbon and carbon compounds.

While a surface conduction electron-emitting device may be manufactured by a variety of different methods, FIGS. 2A through 2E are schematic cross sectional side views of a surface conduction electron-emitting device according a first aspect of the invention, showing different manufacturing steps. A method of manufacturing an electron-emitting device will not be described by referring to FIGS. 1A, 1B and 2A through 2E. Throughout these figures, same components are denoted by same reference symbols.

Figure 2A:
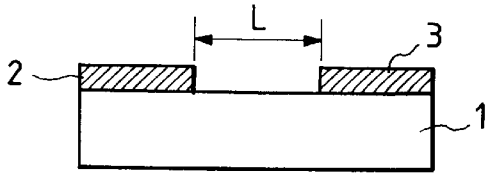
FIGS. 2A through 2E are schematic views of a surface conduction electron-emitting device according to the invention in different manufacturing steps.
Figure 2B:
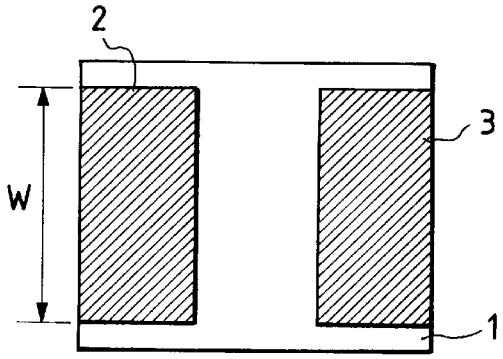

1) After thoroughly cleansing a substrate 1 with detergent, pure water and organic solvent, a material for the device electrodes is deposited on the substrate 1 by means of vacuum deposition, sputtering or some other appropriate technique for a pair of device electrodes, which are then actually produced by photolithography (FIGS. 2A and 2B).

Figure 2C:
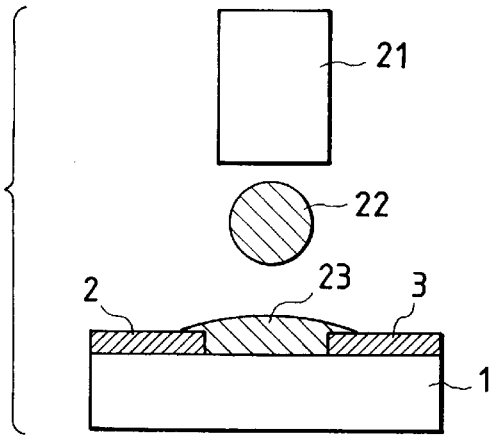

2) An metal-containing liquid composition for manufacturing an electron-emitting device according to the invention is applied onto the substrate 1 carrying thereon the pair of device electrodes 2 and 3. Any ordinary application means may be used for applying the composition and include spin coating, dipping and spraying. Fine drop application means using a piezoelectric device or a fine drop application means such as an ink-jet system that involves heating and generating bubbles (bubble-jet) may also be used (FIG. 2C). Thereafter, the applied composition is thermally decomposed by baking to produce an electroconductive film 4. Then, the electroconductive film 4 is processed to show a desired profile by removing unnecessary areas by appropriate patterning means such as lift-off, etching or laser trimming. When fine drop application means is used, an electroconductive film 4 having a desired profile may be directly formed to eliminate the patterning operation.

Fine drop application means typically produces fine drops with a diameter between 1 and 1,000 $\mu$m, which are then applied independently or successively to cover a predetermined area. An ink-jet system shoots such fine drops toward the targets and covers a predetermined area by utilizing the inertia of the drops. The operation of covering a predetermined area by an ink-jet system can be carried out by moving the targets relative to the ink-jet system or by applying external force to the fine drops to control and, if necessary, modify the trajectories of the fine drops. The above described two techniques may be combined for use.

The above means of using a piezoelectric device may also be categorized as an ink-jet system. A piezoelectric body is used and the force generated in it to deform it when a voltage is applied thereto is utilized for forming and shooting fine liquid drops. A bubble-jet system is also categorized as an ink-jet system and utilizes the force of the bubbles generated when liquid is heated in a small space.

When the applied organic metal is baked, the organic components thereof are decomposed totally at temperature lower than 1,000° C. and mostly at temperature at about 300° C. to produce the metal, the oxide thereof and simple organic substances having a small number of carbon atoms that are adsorbed to the surface of the metal and the metal oxide. One of the features of a metal containing composition according to the invention is that it contains partially esterified polyvinylalcohol. Polyvinylalcohol starts decomposing at about 200° C. when heated in the air and all the organic components become lost at about 500° C. Additionally, if the organic components are heated as they are mixed with the metal compound, they seem to be lost at about 300° C. This may be because the thermal decomposition of polyvinylalcohol is accelerated by the metal compound or the metal and the metal oxide produced by baking. Therefore, the temperature of baking the substrate is between 200 and 500° C. for most metals that can be used for the purpose of the present invention and an electroconductive film 4 can be produced with such low pyrolysis temperature.

When observed through an electronic microscope, it is found that the produced electroconductive film comprises fine particles, each containing several to several thousand atoms of the metal comprised in the metal composition.

Figure 2D:
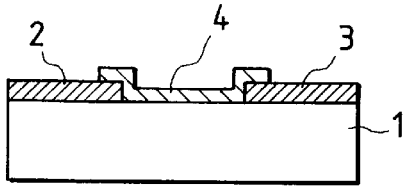
Figure 2E:
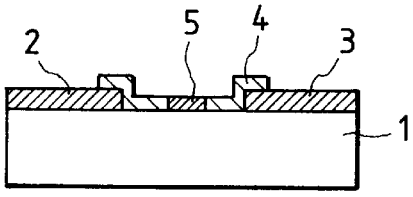

3) Thereafter, the device is subjected to a process referred to as "energization forming". "Energization forming" is a process, where a voltage is applied between the device electrodes 2, 3 from a power source (not shown) to produce an electron-emitting region 5 having a structure different from that of the electroconductive film 4 at a give position of the latter (FIG. 2E). As a result of energization forming, the electroconductive film 4 is partly destroyed or structurally deformed at a given position to produce an electron-emitting region 5.

Figure 3A:
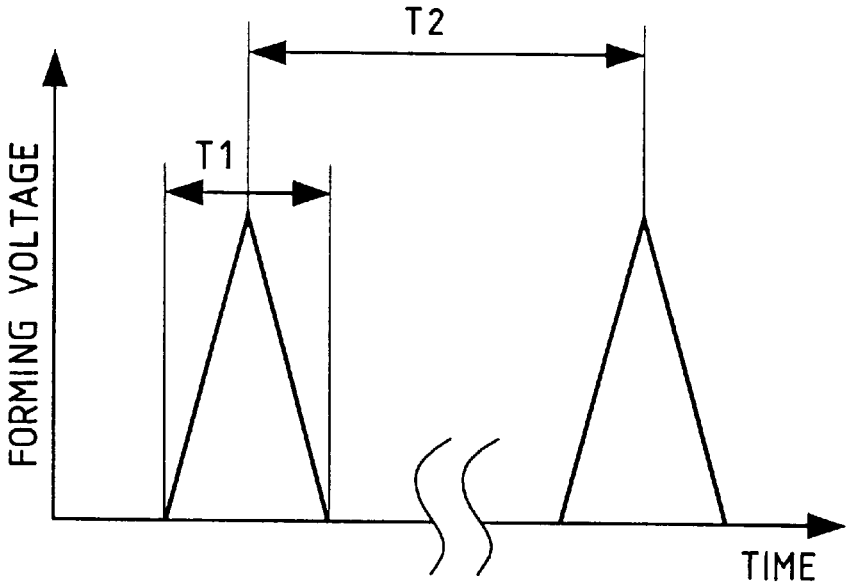
FIGS. 3A and 3B are graphs showing voltage waveforms that can suitably be used in the process of energization forming for the purpose of the invention.
Figure 3B:
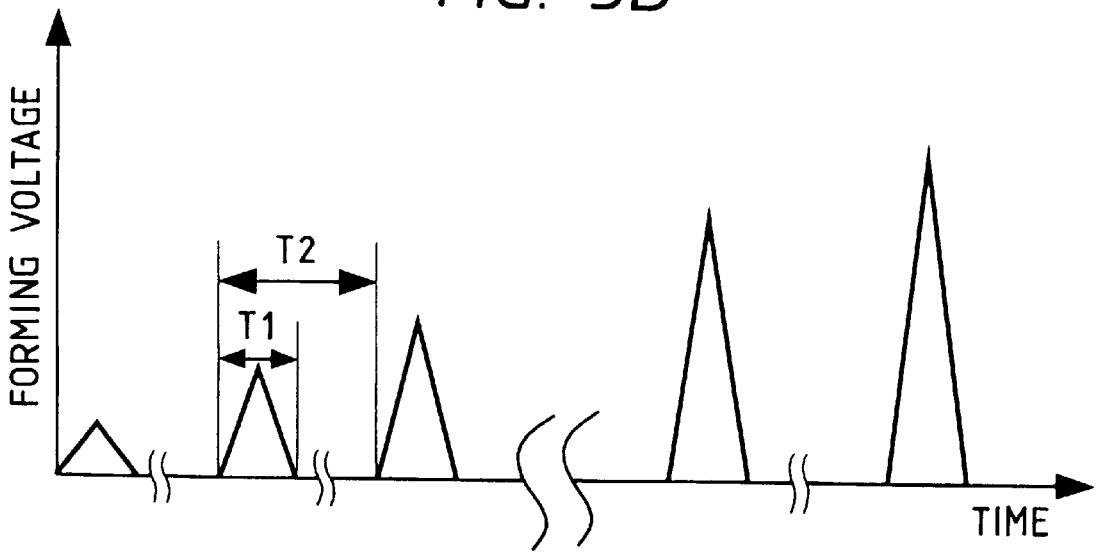

FIGS. 3A and 3B shows two different pulse voltages that can be used for energization forming. The voltage to be used for energization forming preferably has a pulse waveform. A pulse voltage having a constant height or a constant peak voltage may be applied continuously as shown in FIG. 3A or, alternatively, a pulse voltage having an increasing height or an increasing peak voltage may be applied as shown in FIG. 3B.

In FIG. 3A, the pulse voltage has a pulse width T1 and a pulse interval T2, which are typically between 1 sec. and 10 msec. and between 10 sec. and 100 msec. respectively. The height of the triangular wave (the peak voltage for the energization forming operation) may be appropriately selected depending on the profile of the surface conduction electron-emitting device. The voltage is typically applied for tens of several minutes. Note, however, that the pulse waveform is not limited to triangular and a rectangular or some other waveform may alternatively be used.

FIG. 3B shows a pulse voltage whose pulse height increases with time. In FIG. 3B, the pulse voltage has an width T1 and a pulse interval T2 that are substantially similar to those of FIG. 3A. The height of the triangular wave (the peak voltage for the energization forming operation) is increased at a rate of, for instance, 0.1V per step.

The energization forming operation will be terminated by measuring the current running through the device electrodes when a voltage that is sufficiently low and cannot locally destroy or deform the electroconductive thin film 12 is applied to the device during an interval of the pulse voltage. Typically the energization forming operation is terminated when a resistance greater than 1M ohms is observed for the device current running through the electroconductive thin film while applying a voltage of approximately 0.1V to the device electrodes.

4) After the energization forming operation the device is preferably subjected to an activation process. An activation process is a process by means of which the device current If and the emission current Ie are changed remarkably.

In an activation process, a pulse voltage may be repeatedly applied to the device in an atmosphere of the gas of an organic substance. The atmosphere may be produced by utilizing the organic gas remaining in a vacuum chamber after evacuating the chamber by means of an oil diffusion pump or a rotary pump or by sufficiently evacuating a vacuum chamber by means of an ion pump and thereafter introducing the gas of an organic substance into the vacuum. The gas pressure of the organic substance is determined as a function of the profile of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid. As a result of an activation process, carbon or a carbon compound is deposited on the device out of the organic substances existing in the atmosphere to remarkably change the device current Ie and the emission current Ie.

The time of terminating the activation process is determined appropriately by observing the device current If and the emission current Ie. The pulse width, the pulse interval and the pulse wave height of the pulse voltage to be used for the activation process will be appropriately selected.

For the purpose of the invention, carbon and carbon compounds include graphite (namely HOPG, PG and GC, of which HOPG has a substantially perfect graphite crystalline structure and PG has a somewhat distorted crystalline structure with an average crystal grain size of 20 angstroms, while the crystalline structure of GC is further distorted with an average crystal grain size as small as 20 angstroms) and noncrystalline carbon (refers to amorphous carbon and a mixture of amorphous carbon and fine crystal grains of graphite) and the thickness of the deposited film is preferably less than 50 nanometers, more preferably less than 30 nm. A carbon compound such as hydrogen carbide may be used in place of graphite.

5) An electron-emitting device that has been treated in an energization forming process and an activation process is then preferably subjected to a stabilization process. This is a process for removing any organic substances remaining in the vacuum chamber. The vacuuming and exhausting equipment to be used for this process preferably does not involve the use of oil so that it may not produce any evaporated oil that can adversely affect the performance of the performance of the treated device during the process. Thus, the use of a sorption pump or an ion pump may be a preferable choice.

If an oil diffusion pump or a rotary pump is used for the activation process and the organic gas produced by the oil is also utilized, the partial pressure of the organic gas has to be minimized by any means. The partial pressure of the organic gas in the vacuum chamber is preferably lower than $1\times10^{-6}$ Pa and more preferably lower than $1\times10^{-8}$ Pa if no carbon or carbon compound is additionally deposited. The vacuum chamber is preferably evacuated after heating the entire chamber so that organic molecules adsorbed by the inner walls of the vacuum chamber and the electron-emitting device in the chamber may also be easily eliminated. While the vacuum chamber is preferably heated to 80° C. or above, preferably to 250° C. or above, for as long as possible, other heating conditions may alternatively be selected depending on the size and the profile of the vacuum chamber and the configuration of the electron-emitting device in the chamber as well as other considerations. The pressure in the vacuum chamber needs to be made as low as possible and it is preferably lower than $1\times10^{-7}$ Pa and more preferably lower than $1\times10^{-8}$ Pa, although some other level of pressure may appropriately be selected.

After the stabilization process, the atmosphere for driving the electron-emitting device or the electron source is preferably same as the one when the stabilization process is completed, although a lower pressure may alternatively be used without damaging the stability of operation of the electron-emitting device or the electron source if the organic substances in the chamber are sufficiently removed.

By using such a low pressure atmosphere, the formation of any additional deposit of carbon or a carbon compound can be effectively suppressed and $H_2O$, $O_2$ and other substances that have been adsorbed by the vacuum chamber and the substrate can be effectively removed to consequently stabilize the device current If and the emission current Ie.

Figure 4:
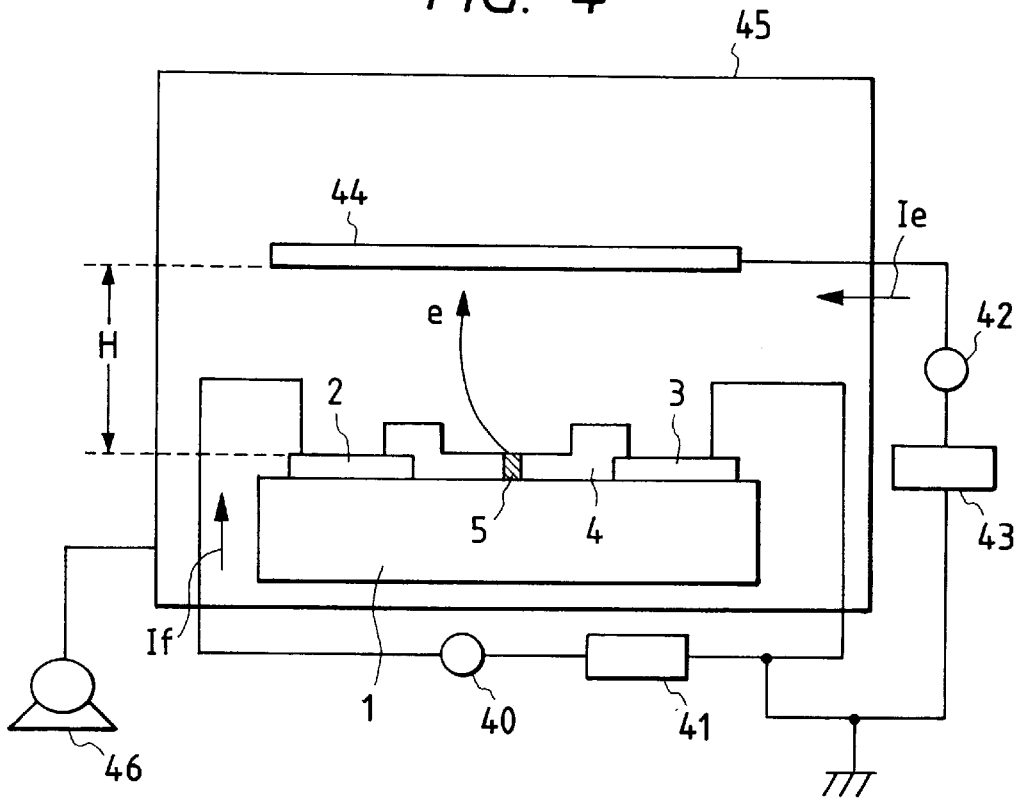
FIG. 4 is a schematic block diagram of a measuring system for determining the electron-emitting performance of an electron-emitting device according to the invention.
Figure 5:
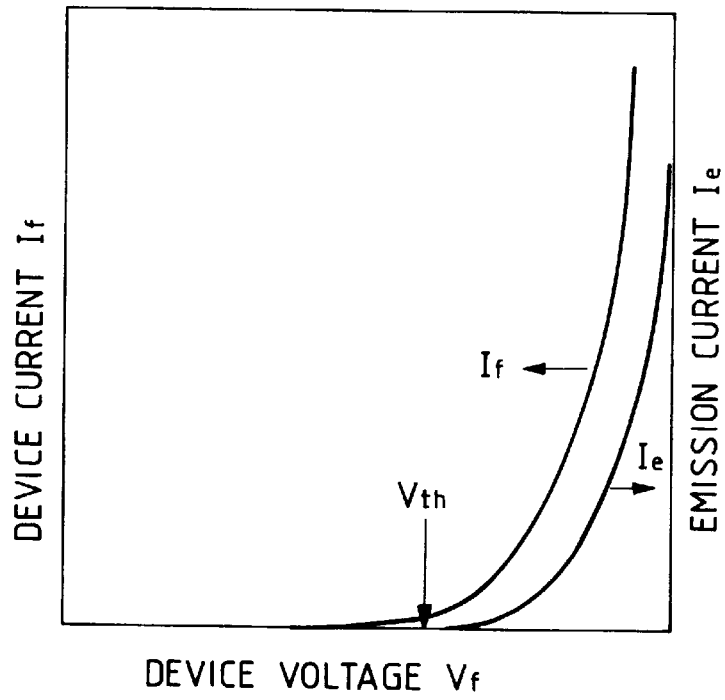
FIG. 5 is a graph showing the relationship between the device voltage Vf and the emission current Ie and between the device voltage Vf and the device current If of a surface conduction electron-emitting device according to the invention.

Basic characteristics of an electron-emitting device, to which the present invention is applicable, are described by referring to FIGS. 4 and 5.

FIG. 4 is a schematic block diagram of an arrangement comprising a vacuum chamber that can be used as a measuring system for determining the performance of an electron-emitting device of the type under consideration.

Referring to FIG. 4, those components that are similar to or same as those of FIGS. 1A and 1B are denoted by the same reference symbols. The measuring system includes a vacuum chamber 45 and a vacuum pump 46. An electron-emitting device is placed in the vacuum chamber 45. The device comprises a substrate 1, a pair of device electrodes 2 and 3, an electroconductive thin film 4 and an electron-emitting region 5. Otherwise, the measuring system has a power source 41 for applying a device voltage Vf to the device, an ammeter 40 for metering the device current If running through the thin film 4 between the device electrodes 2 and 3, an anode 44 for capturing the emission current Ie produced by electrons emitted from the electron-emitting region of the device, a high voltage source 43 for applying a voltage to the anode 44 of the measuring system and another ammeter 42 for metering the emission current Ie produced by electrons emitted from the electron-emitting region 5 of the device. For determining the performance of the electron-emitting device, a voltage between 1 and 10 KV may be applied to the anode, which is spaced apart from the electron emitting device by distance H which is between 2 and 8 mm.

The vacuum chamber 45 is equipped with a vacuum gauge (not shown) and other necessary instruments so that the performance of the electron-emitting device in the chamber may be properly tested in vacuum of a desired degree.

The vacuum pump 56 may be provided with an ordinary high vacuum system comprising a turbo pump or a rotary pump and an ultra-high vacuum system comprising an ion pump which can be used switchably as desired. The entire vacuum chamber 45 and the substrate of an electron-emitting device contained therein can be heated by means of a heater (not shown). Thus, this vacuum processing arrangement can be used for an energization forming process and the subsequent processes.

FIG. 5 shows a graph schematically illustrating the relationship between the device voltage Vf and the emission current Ie and the device current If typically observed by the measuring system of FIG. 4. Note that different units are arbitrarily selected for Ie and If in FIG. 5 in view of the fact that Ie has a magnitude by far smaller than that of If. Note that both the vertical and transversal axes of the graph represent a linear scale.

As seen in FIG. 5, an electron-emitting device according to the invention has three remarkable features in terms of emission current Ie, which will be described below.

Firstly, an electron-emitting device according to the invention shows a sudden and sharp increase in the emission current Ie when the voltage applied thereto exceeds a certain level (which is referred to as a threshold voltage hereinafter and indicated by Vth in FIG. 5), whereas the emission current Ie is practically undetectable when the applied voltage is found lower than the threshold value Vth. Differently stated, an electron-emitting device according to the invention is a non-linear device having a clear threshold voltage Vth to the emission current Ie.

Secondly, since the emission current Ie increases monotonically as highly dependent on the device voltage Vf, the former can be effectively controlled by way of the latter.

Thirdly, the emitted electric charge captured by the anode 44 (FIG. 4) is a function of the duration of time of application of the device voltage Vf. In other words, the amount of electric charge captured by the anode 44 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

On the other hand, the device current If either monotonically increases relative to the device voltage Vf (as shown in FIG. 5, a characteristic referred to as "MI characteristic" hereinafter) or changes to show a curve (not shown) specific to a voltage-controlled-negative-resistance characteristic (a characteristic referred to as "VCNR characteristic" hereinafter, although it is not illustrated). These characteristics of the device current are dependent on a number of factors including the manufacturing method, the conditions where it is gauged and the environment for operating the device.

Now, some examples of the usage of electron-emitting devices, to which the present invention is applicable, will be described. According to the invention, an electron source and hence an image-forming apparatus comprising such an electron source can be realized by arranging a plurality of electron-emitting devices.

Electron-emitting devices may be arranged on a substrate in a number of different modes.

For instance, a number of electron-emitting devices may be arranged in parallel rows along a direction (hereinafter referred to row-direction), each device being connected by wires as at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along a Y-direction to form a matrix, the X- and Y-directions being perpendicular to each other, and the electron-emitting devices on a same row are connected to a common X-directional wire by way of one of the electrodes of each device while the electron-emitting devices on a same column are connected to a common Y-directional wire by way of the other electrode of each device. The latter arrangement is referred to as a simple matrix arrangement. Now, the simple matrix arrangement will be described in detail.

In view of the above described three basic characteristic features of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 6:
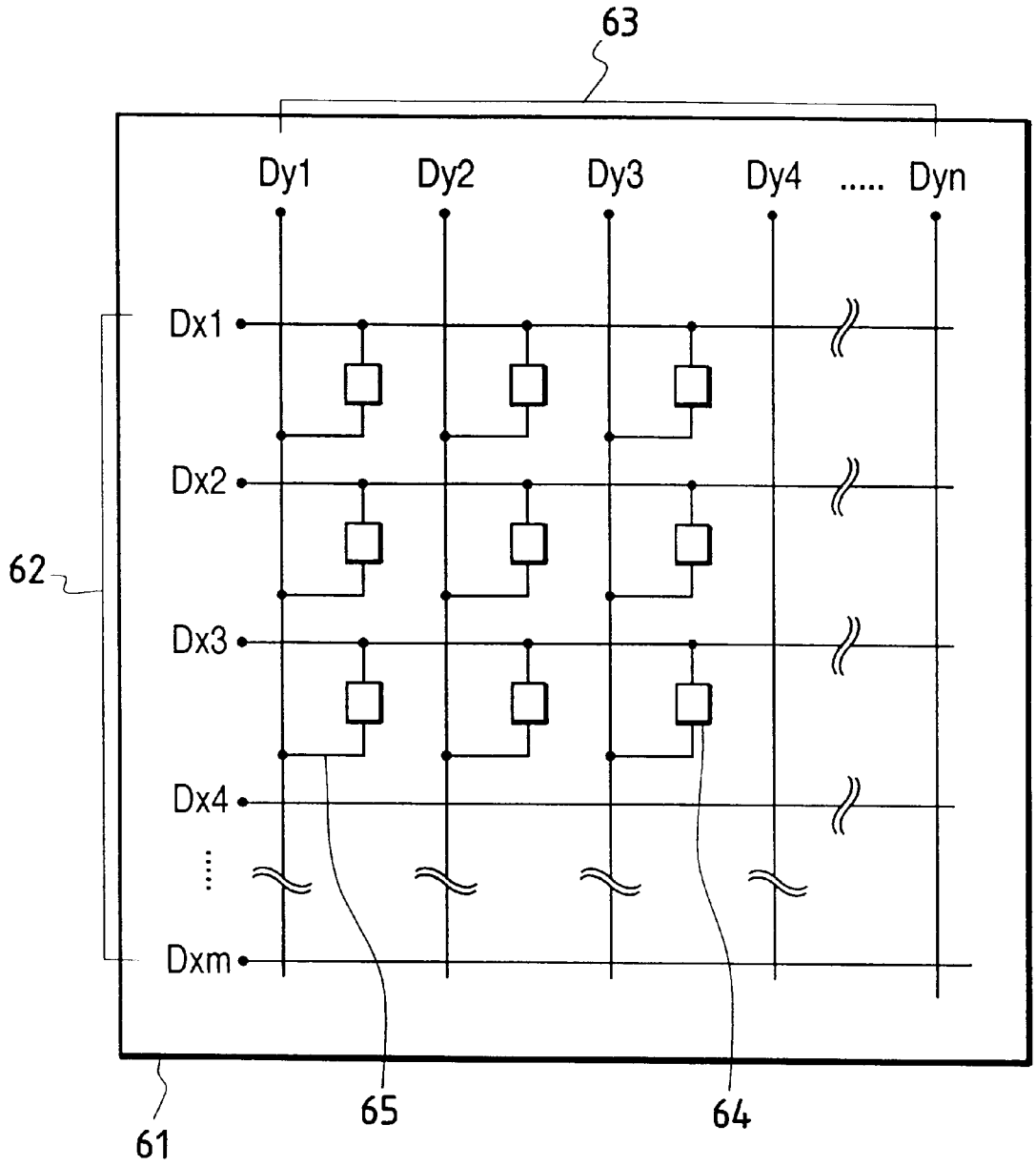
FIG. 6 is a schematic plan view of an electron source having a simple matrix arrangement.

FIG. 6 is a schematic plan view of the substrate of an electron source realized by arranging a plurality of electron-emitting devices, to which the present invention is applicable, in order to exploit the above characteristic features. In FIG. 6, the electron source comprises an electron source substrate 61, X-directional wires 62, Y-directional wires 63, surface conduction electron-emitting devices 64 and connecting wires 65. The surface conduction electron-emitting devices may be either of the flat type or of the step type described earlier.

There are provided a total of m X-directional wires 62, which are donated by Dx1, Dx2, . . . , Dxm and made of an electroconductive metal produced by vacuum evaporation, printing or sputtering. These wires are appropriately designed in terms of material, thickness and width. A total of n Y-directional wires 63 are arranged and donated by Dy1, Dy2, . . . , Dyn, which are similar to the X-directional wires 62 in terms of material, thickness and width. An interlayer insulation layer (not shown) is disposed between the m X-directional wires 62 and the n Y-directional wires 63 to electrically isolate them from each other. (Both m and n are integers.)

The interlayer insulation layer (not shown) is typically made of $SiO_2$ and formed on the entire surface or part of the surface of the insulating substrate 61 to show a desired contour by means of vacuum evaporation, printing or sputtering. For example, it may be formed on the entire surface or part of the surface of the substrate 61 on which the X-directional wires 62 have been formed. The thickness, material and manufacturing method of the interlayer insulation layer are so selected as to make it withstand the potential difference between any of the X-directional wires 62 and any of the Y-directional wire 63 observable at the crossing thereof. Each of the X-directional wires 62 and the Y-directional wires 63 is drawn out to form an external terminal.

The oppositely arranged paired electrodes (not shown) of each of the surface conduction electron-emitting devices 64 are connected to related one of the m X-directional wires 62 and related one of the n Y-directional wires 63 by respective connecting wires 65 which are made of an electroconductive metal by means of vaccum evaporation, printing or sputtering.

The electroconductive metal material of the wires 62 and 63, the device electrodes and the connecting wires 65 extending from the wires 62 and 63 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires.

The X-directional wires 62 are electrically connected to a scan signal application means (not shown) for applying a scan signal to a selected row of surface conduction electron-emitting devices 64. On the other hand, the Y-directional wires 63 are electrically connected to a modulation signal generation means (not shown) for applying a modulation signal to a selected column of surface conduction electron-emitting devices 64 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wire arrangement.

Figure 7:
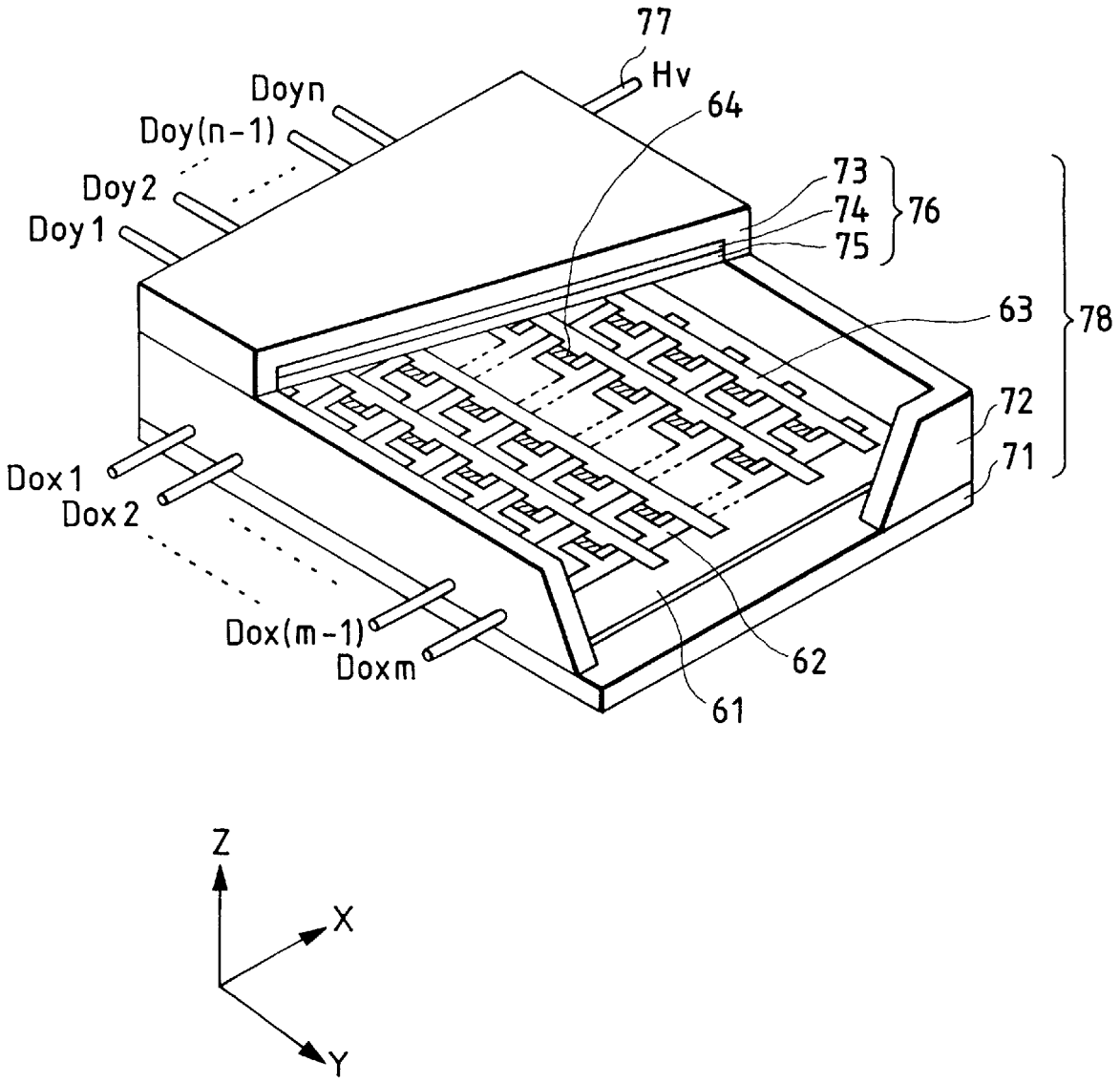
FIG. 7 is a schematic perspective view of the display panel of an image-forming apparatus according to the invention.
Figure 8A:
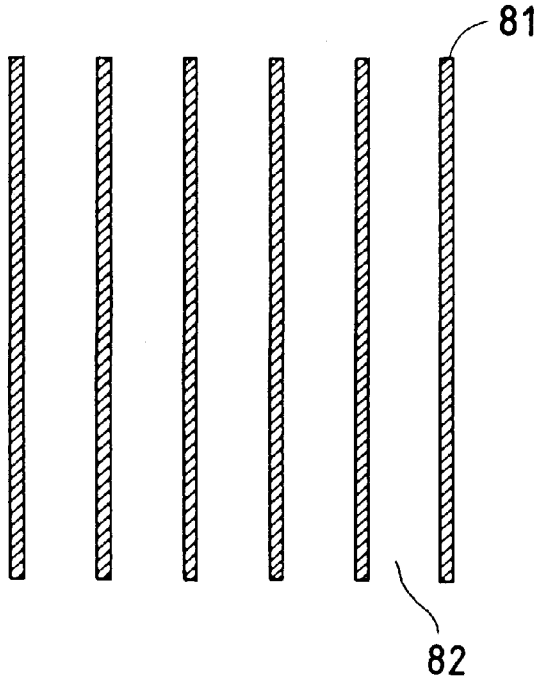
FIGS. 8A and 8B are two possible arrangements of fluorescent members that can be used for the purpose of the invention.
Figure 8B:
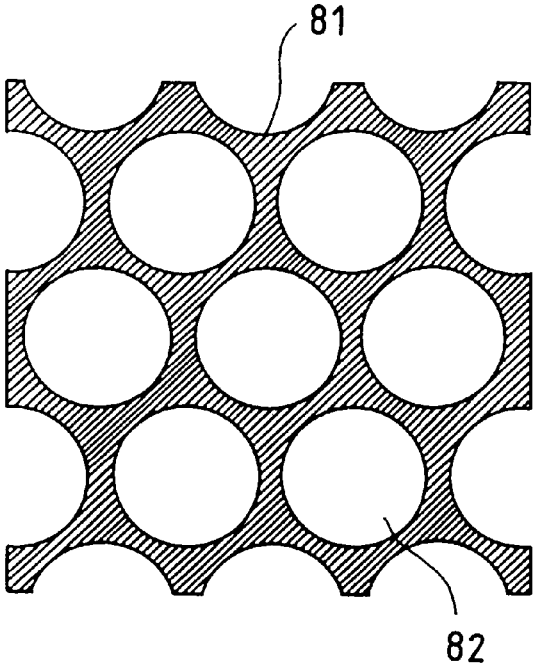
Figure 9:
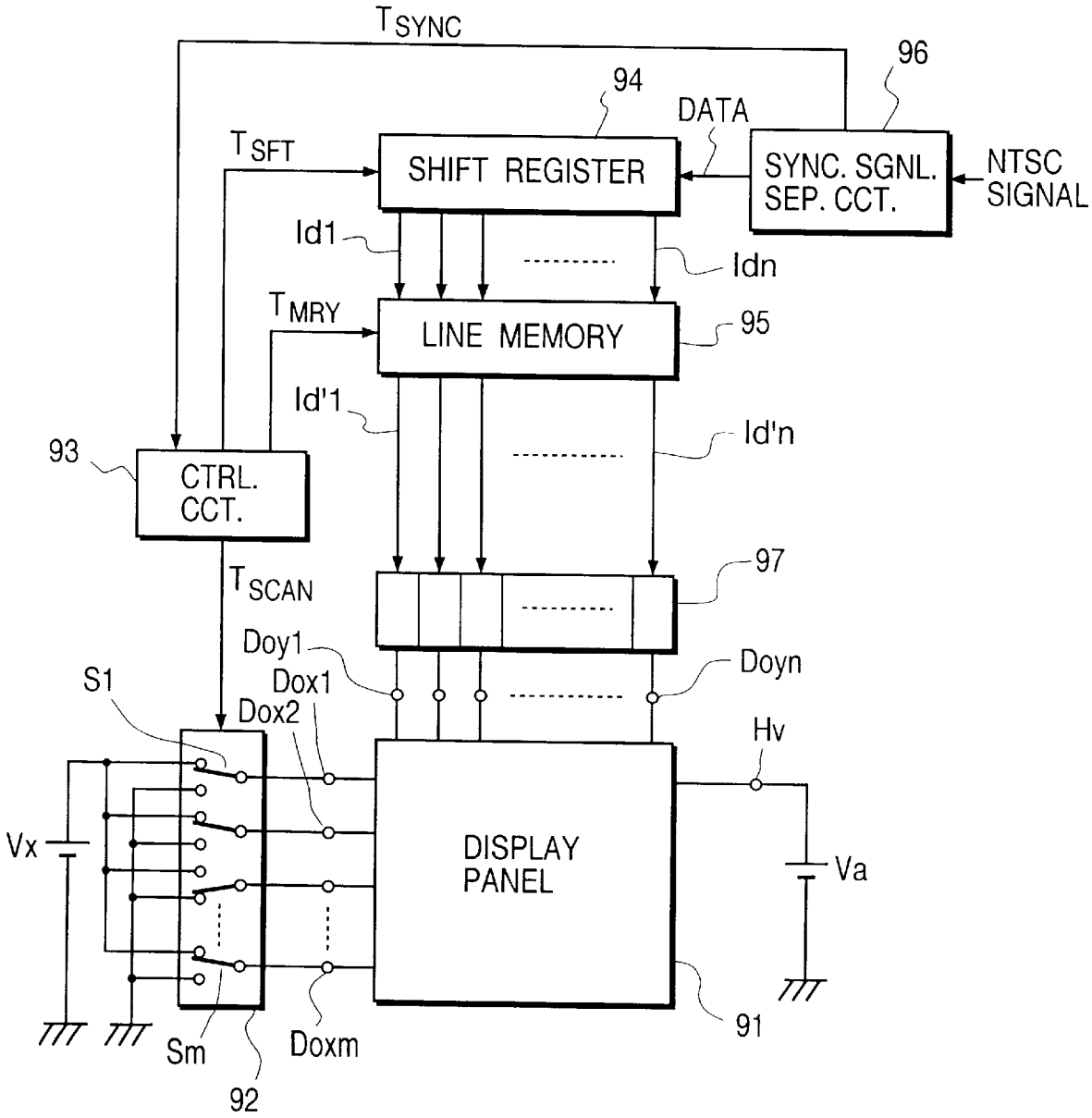
FIG. 9 is a schematic circuit diagram of a drive circuit that can be used for displaying images according to NTSC television signals as well as a block diagram of an image-forming apparatus having such a drive circuit.

Now, an image-forming apparatus comprising an electron source having a simple matrix arrangement as described above will be described by referring to FIGS. 7, 8A, 8B and 9. FIG. 7 is a partially cut away schematic perspective view of the image forming apparatus and FIGS. 8A and 8B show two possible configurations of a fluorescent film that can be used for the image forming apparatus of FIG. 7, whereas FIG. 9 is a block diagram of a drive circuit for the image forming apparatus of FIG. 7 that operates for NTSC television signals.

Referring firstly to FIG. 7 illustrating the basic configuration of the display panel of the image-forming apparatus, it comprises an electron source substrate 61 of the above described type carrying thereon a plurality of electron-emitting devices, a rear plate 71 rigidly holding the electron source substrate 61, a face plate 76 prepared by laying a fluorescent film 74 and a metal back 75 on the inner surface of a glass substrate 73 and a support frame 72, to which the rear plate 71 and the face plate 76 are bonded by means of frit glass. Reference numeral 78 denotes an envelope, which is baked to 400 to 500° C. for more than 10 minutes in the atmosphere or in nitrogen and hermetically and airtightly sealed.

In FIG. 7, reference numeral 64 denotes the electron-emitting region of each electron-emitting device that corresponds to the electron-emitting region 5 of FIGS. 1A and 1B and reference numerals 62 and 63 respectively denotes the X-directional wire and the Y-directional wire connected to the respective device electrodes of each electron-emitting device.

While the envelope 78 is formed of the face plate 76, the support frame 72 and the rear plate 71 in the above described embodiment, the rear plate 71 may be omitted if the substrate 61 is strong enough by itself because the rear plate 71 is provided mainly for reinforcing the substrate 61. If such is the case, an independent rear plate 71 may not be required and the substrate 61 may be directly bonded to the support frame 72 so that the envelope 78 is constituted of a face plate 76, a support frame 72 and a substrate 61. The overall strength of the envelope 78 may be increased by arranging a number of support members called spacers (not shown) between the face plate 76 and the rear plate 71.

FIGS. 8A and 8B schematically illustrate two possible arrangements of fluorescent film. While the fluorescent film 74 comprises only a single fluorescent body if the display panel is used for showing black and white pictures, it needs to comprise for displaying color pictures black conductive members 81 and fluorescent bodies 82, of which the former are referred to as black stripes (FIG. 8A) or members of a black matrix (FIG. 8B) depending on the arrangement of the fluorescent bodies. Black stripes or members of a black matrix are arranged for a color display panel so that the fluorescent bodies 82 of three different primary colors are made less discriminable by blackening the surrounding areas and the adverse effect of reducing the contrast of displayed images of external light is weakened. While graphite is normally used as a principal ingredient of the black stripes, other conductive material having low light transmissivity and reflectivity may alternatively be used.

Precipitation or printing is suitably be used for applying a fluorescent material on the glass substrate 73 regardless of black and white or color display. A metal back 75 is usually arranged on the inner surface of the fluorescent film 74. The metal back 75 is provided in order to enhance the luminance of the display panel by causing the rays of light emitted from the fluorescent bodies and directed to the inside of the envelope to turn back toward the face plate 76, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum evaporation after forming the fluorescent film.

A transparent electrode (not shown) may be formed on the face plate 76 facing the outer surface of the fluorescent film 74 in order to raise the conductivity of the fluorescent film 74.

Care should be taken to accurately align each set of color fluorescent bodies and an electron-emitting device, if a color display is involved, before the above listed components of the envelope are bonded together.

The envelope 78 is evacuated by way of an evacuating system using no oil comprising e.g. an ion pump and a sorption pump and an exhaust pipe (not shown) until the atmosphere in the inside is reduced to a degree of vacuum of $10^{-5}$ Pa, when it is hermetically sealed, while being heated appropriately as in the case of the above described stabilization process. A getter process may be conducted in order to maintain the achieved degree of vacuum in the inside of the envelope 78 after it is sealed. In a getter process, a getter arranged at a predetermined position (not shown) in the envelope 78 is heated by means of a resistance heater or a high frequency heater to form a film by evaporation immediately before or after the envelope 78 is sealed. A getter typically contains Ba as a principal ingredient and can maintain a degree of vacuum between $10^{-3}$ Pa and $10^{-5}$ Pa by the adsorption effect of the vapor deposition film. The processes of manufacturing surface conduction electron-emitting devices of the image forming apparatus after the forming process may appropriately be designed to meet the specific requirements of the intended application.

Now, a drive circuits for driving a display panel comprising an electron source with a simple matrix arrangement for displaying television images according to NTSC television signals will be described by referring to FIG. 9. In FIG. 9, reference numeral 91 denotes a display panel. Otherwise, the circuit comprises a scan circuit 92, a control circuit 93, a shift register 94, a line memory 95, a synchronizing signal separation circuit 96 and a modulation signal generator 97. Vx and Va in FIG. 9 denote DC voltage sources.

The display panel 91 is connected to external circuits via terminals Dox1 through Doxm, Doy1 through Doym and high voltage terminal Hv, of which terminals Dox1 through Doxm are designed to receive scan signals for sequentially driving on a one-by-one basis the rows (of N devices) of an electron source in the apparatus comprising a number of surface-conduction electron-emitting devices arranged in the form of a matrix having M rows and N columns.

On the other hand, terminals Doy1 through Doyn are designed to receive a modulation signal for controlling the output electron beam of each of the surface-conduction electron-emitting devices of a row selected by a scan signal. High voltage terminal Hv is fed by the DC voltage source Va with a DC voltage of a level typically around 10 kV, which is sufficiently high to energize the fluorescent bodies corresponding to the selected surface-conduction electron-emitting devices.

The scan circuit 92 operates in a manner as follows. The circuit comprises M switching devices (indicated schematically as S1 through Sm in FIG. 9), each of which takes either the output voltage of the DC voltage source Vx or 0[V] (the ground potential level) and comes to be connected with one of the terminals Dox1 through Doxm of the display panel 91. Each of the switching devices S1 through Sm operates in accordance with control signal Tscan fed from the control circuit 93 and can be prepared by combining switching devices such as FETs.

The DC voltage source Vx of this circuit is designed to output a constant voltage such that any drive voltage applied to devices that are not being scanned is reduced to less than threshold voltage due to the performance of the surface conduction electron-emitting devices (or the threshold voltage for electron emission).

The control circuit 93 coordinates the operations of related components so that images may be appropriately displayed in accordance with externally fed video signals. It generates control signals Tscan, Tsft and Tmry in response to synchronizing signal Tsync fed from the synchronizing signal separation circuit 96, which will be described below.

The synchronizing signal separation circuit 96 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 96 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 94, is designated as DATA signal.

The shift register 94 carries out for each line a serial/parallel conversion on DATA signals that are serially fed on a time series basis in accordance with control signal Tsft fed from the control circuit 93. (In other words, a control signal Tsft operates as a shift clock for the shift register 94.) A set of data for a line that have undergone a serial/parallel conversion (and correspond to a set of drive data for N electron-emitting devices) are sent out of the shift register 94 as N parallel signals Id1 through Idn.

The line memory 95 is a memory for storing a set of data for a line, which are signals Id1 through Idn, for a required period of time according to control signal Tmry coming from the control circuit 93. The stored data are sent out as I'd1 through I'dn and fed to modulation signal generator 97.

Said modulation signal generator 97 is in fact a signal source that appropriately drives and modulates the operation of each of the surface-conduction type electron-emitting devices according to image data I'd1 through I'dn and output signals of this device are fed to the surface-conduction electron-emitting devices in the display panel 91 via terminals Doy1 through Doyn.

As described above, an electron-emitting device, to which the present invention is applicable, is characterized by the following features in terms of emission current Ie. Firstly, there exists a clear threshold voltage Vth and the device emits electrons only a voltage exceeding Vth is applied thereto. Secondly, the level of emission current Ie changes as a function of the change in the applied voltage above the threshold level Vth. More specifically, when a pulse-shaped voltage is applied to an electron-emitting device according to the invention, practically no electron emission is caused so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either voltage modulation method or pulse width modulation method may be used for modulating an electron-emitting device in response to an input signal. With voltage modulation, a voltage modulation type circuit is used for the modulation signal generator 97 so that the peak level of the pulse shaped voltage is modulated according to input data, while the pulse width is held constant.

With pulse width modulation, on the other hand, a pulse width modulation type circuit is used for the modulation signal generator 97 so that the pulse width of the applied voltage may be modulated according to input data, while the peak level of the applied voltage is held constant.

Although it is not particularly mentioned above, the shift register 94 and the line memory 95 may be either of digital or of analog signal type so long as serial/parallel conversions and storage of video signals are conducted at a given rate.

If digital signal type devices are used, output signal DATA of the synchronizing signal separation circuit 96 needs to be digitized. However, such conversion can be easily carried out by arranging an A/D converter at the output of the synchronizing signal separation circuit 96. It may be needless to say that different circuits may be used for the modulation signal generator 97 depending on if output signals of the line memory 95 are digital signals or analog signals. If digital signals are used, a D/A converter circuit of a known type may be used for the modulation signal generator 97 and an amplifier circuit may additionally be used, if necessary. As for pulse width modulation, the modulation signal generator 97 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface conduction electron-emitting device according to the invention.

If, on the other hand, analog signals are used with voltage modulation, an amplifier circuit comprising a known operational amplifier may suitably be used for the modulation signal generator 97 and a level shift circuit may be added thereto if necessary. As for pulse width modulation, a known voltage control type oscillation circuit (VCO) may be used with, if necessary, an additional amplifier to be used for voltage amplification up to the drive voltage of a surface conduction electron-emitting device.

With an image forming apparatus having a configuration as described above, to which the present invention is applicable, the electron-emitting devices emit electrons as a voltage is applied thereto by way of the external terminals Dox1 through Doxm and Doy1 through Doyn. Then, the generated electron beams are accelerated by applying a high voltage to the metal back 75 or a transparent electrode (not shown) by way of the high voltage terminal Hv. The accelerated electrons eventually collide with the fluorescent film 74, which by turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is also suited for TV signals involving a larger number of scanning lines (typically of a high definition TV system such as the MUSE system).

Now, an electron source comprising a plurality of surface conduction electron-emitting devices arranged in a ladder-like manner on a substrate and an image-forming apparatus comprising such an electron source will be described by referring to FIGS. 10 and 11.

Figure 10:
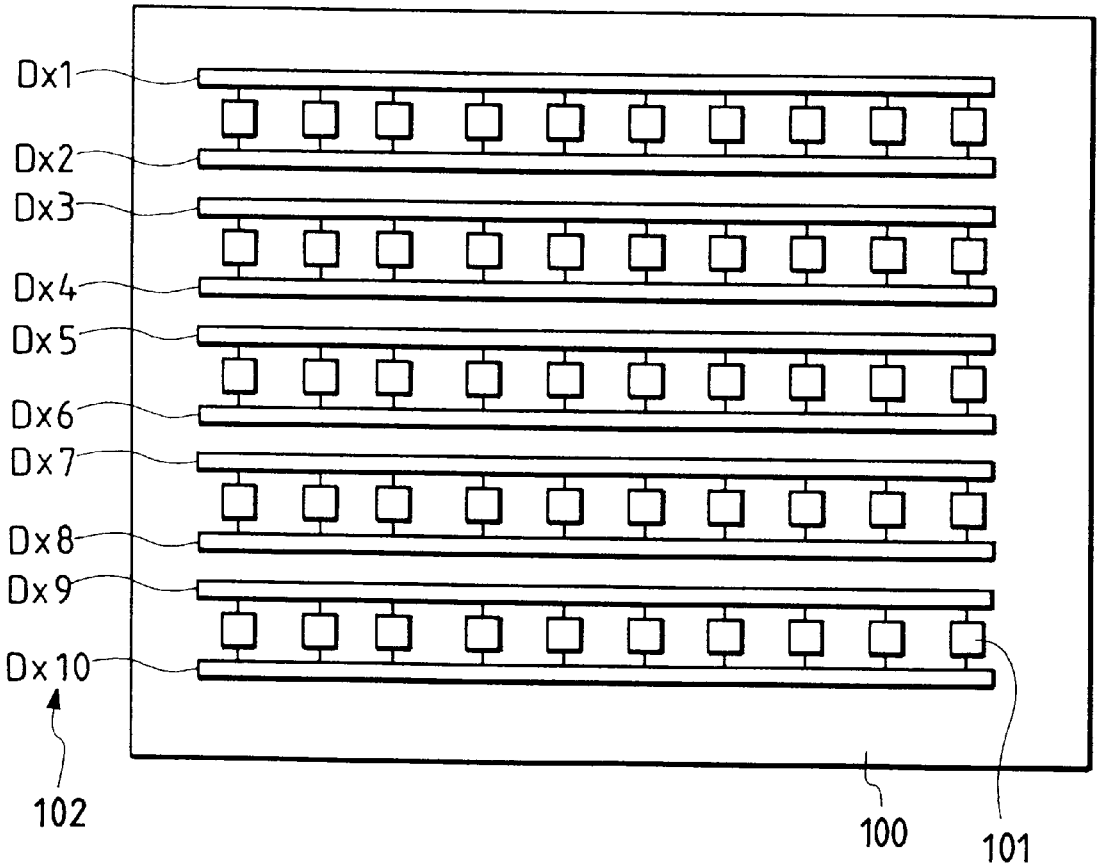
FIG. 10 is a schematic plan view of an electron source having a ladder-like arrangement.

Firstly referring to FIG. 10 schematically showing an electron source having a ladder-like arrangement, reference numeral 100 denotes an electron source substrate and reference numeral 101 denotes an surface conduction electron-emitting device arranged on the substrate, whereas reference numeral 102 denotes common (X-directional) wires Dx1 through Dx10 for connecting the surface conduction electron-emitting devices 101. The electron-emitting devices 101 are arranged in rows (to be referred to as device rows hereinafter) on the substrate 100 to form an electron source comprising a plurality of device rows, each row having a plurality of devices in the X-direction. The surface conduction electron-emitting devices of each device row are electrically connected in parallel with each other by a pair of common wires so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, for example, of the common wires Dx2 through Dx9, Dx2 and Dx3 can share a single common wire instead of two wires.

Figure 11:
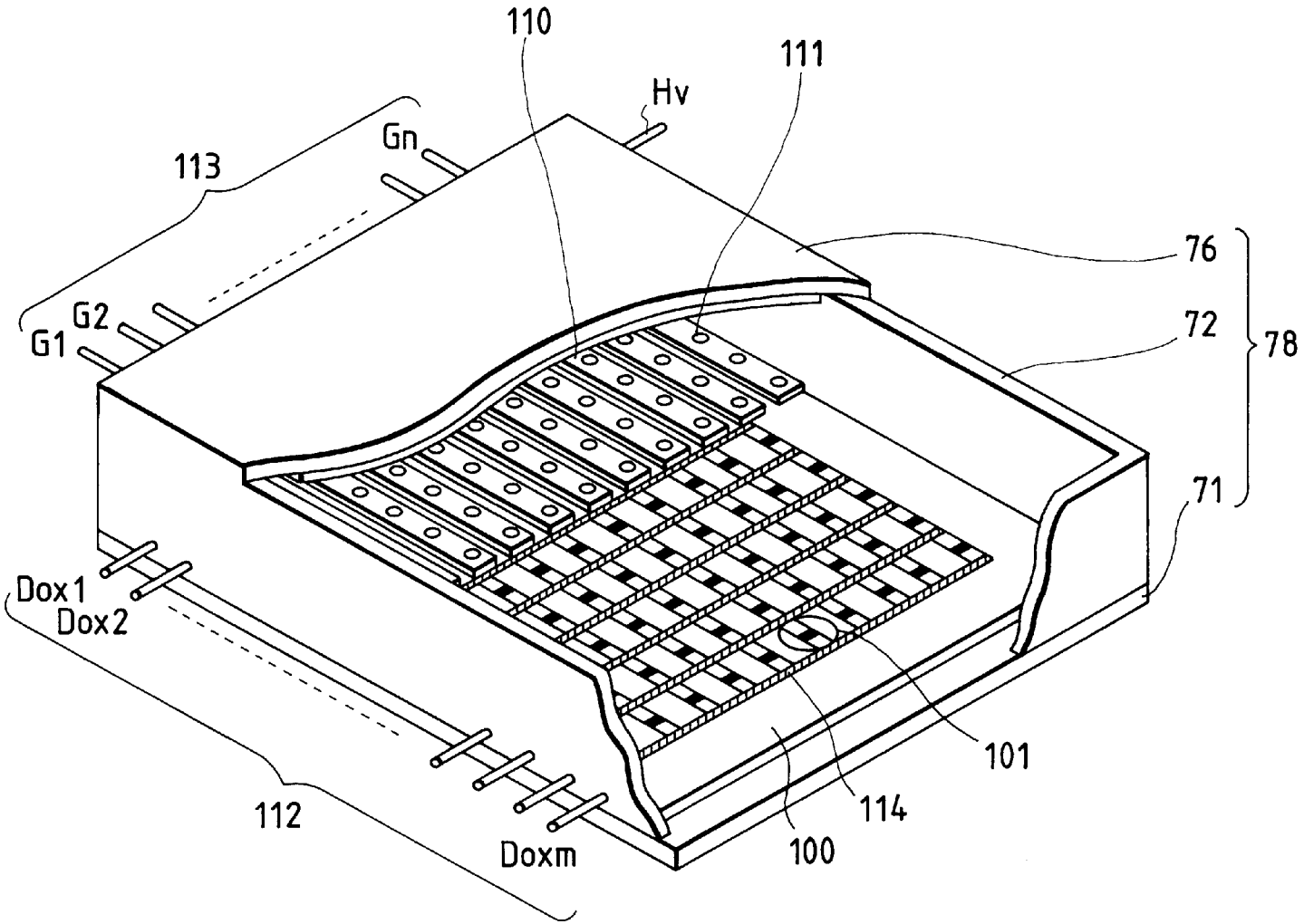
FIG. 11 is a schematic perspective view of the display panel of an image-forming apparatus according to the invention.

FIG. 11 is a schematic perspective view of the display panel of an image-forming apparatus incorporating an electron source having a ladder-like arrangement of electron-emitting devices. In FIG. 11, the display panel comprises grid electrodes 110, each provided with a number of pores 111 for allowing electrons to pass therethrough and a set of external terminals 112, or Dox1, Dox2, . . . , Doxm, along with another set of external terminals 113, or G1, G2, . . . , Gn, connected to the respective grid electrodes 110 and an electron source substrate 100. The image forming apparatus of FIG. 11 differs from the image forming apparatus with a simple matrix arrangement of FIG. 7 mainly in that the apparatus of FIG. 11 has grid electrodes 110 arranged between the electron source substrate 100 and the face plate 76.

In FIG. 11, the stripe-shaped grid electrodes 110 are arranged between the substrate 100 and the face plate 76 perpendicularly relative to the ladder-like device rows for modulating electron beams emitted from the surface conduction electron-emitting devices, each provided with through pores 111 in correspondence to respective electron-emitting devices for allowing electron beams to pass therethrough. Note that, however, while stripe-shaped grid electrodes are shown in FIG. 11, the profile and the locations of the electrodes are not limited thereto. For example, they may alternatively be provided with mesh-like openings and arranged around or close to the surface conduction electron-emitting devices.

The external terminals 112 and the external terminals 113 for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

The present invention will be described in detail with reference to examples.

EXAMPLE 1

0.12 g of monoethanolamine and 20 g of water were added to 0.1 g of palladium acetate. They were mixed by stirring to obtain a light-orange transparent solution. 5 g of isopropyl alcohol was added to the resultant solution, the resultant solution was filtered with a membrane filter having a pore size of 0.22 $\mu$m, and the filtered solution was filled in a bubble jet printer head BC-01 available from CANON INC.

A quartz substrate was used as an insulating substrate 1 and washed with an organic solvent, and device electrodes 2 and 3 consisting of platinum and having a thickness of about 1,000 Å were formed on the surface of the insulating substrate 1 (FIGS. 2A and 2B). An inter-device-electrode distance L was set to be 5 $\mu$m, and a width W1 of each device electrode was set to be 500 $\mu$m.

A drive voltage pulse was applied to the BC-01 head to eject a liquid droplet to the electrode gap portion between the device electrodes 2 and 3 of the insulating substrate 1 six times so as to adhere the liquid droplet to the electrode gap portion (FIG. 2C). When this substrate was annealed at 360° C. for 15 minutes in an electric furnace of an atmospheric atmosphere, an electroconductive film containing palladium oxide as a component was formed on the portion to which the liquid droplet was adhered (FIG. 2D). An electric resistance between the device electrodes 2 and 3 was 3.4 kΩ.

An electron-emitting region 5 was formed in such a manner that a voltage was applied across the device electrodes 2 and 3 to perform energization forming to an electron-emitting region forming thin film 4 (FIG. 2E). The voltage waveform in the forming treatment is shown in FIG. 3A.

Referring to FIG. 3A, reference symbols T1 and T2 denote the pulse width and pulse interval of the voltage waveform, respectively. In this example, T1 was set to be 1 ms; T2, 10 ms; and the peak value (peak voltage in forming treatment) of a chopping wave, 5 V. The forming treatment was performed for 60 seconds in a vacuum atmosphere of about $1\times10^{-6}$ torr.

In addition, acetone was guided into a measurement evaluation apparatus in FIG. 4, and the vacuum atmosphere of the measurement evaluation apparatus was set to be $3\times10^{-4}$ torr. Thereafter, activation was performed in such a manner that a voltage having a peak value of 14 V, T1 of 1 ms, and T2 of 10 ms was applied for 15 minutes. Subsequently, acetone was exhausted, and for the purpose of stabilization, the measurement evaluation apparatus was heated to 200° C. and kept for 5 hours while being evacuated.

The electron-emitting characteristics of the electron-emitting device formed as described above were evaluated by using the measurement evaluation apparatus in FIG. 4. Note that, in this example, the distance between an anode and the electron-emitting device was set to be 4 mm, and the potential of the anode was set to be 1 kV. The degree of vacuum in the vacuum apparatus in measurement of the electron-emitting characteristics was $10^{-8}$ torr.

The measurement evaluation apparatus described above was used, and a device voltage was applied across the electrodes 2 and 3 of the electron-emitting device. When a device current If and an emission current Ie flowing at this time were measured, current-voltage characteristics shown in FIG. 5 were obtained. In this device, the emission current Ie began to increase from a device voltage of about 6.3 V, and the device current If became 1.9 mA at the device voltage of 14 V. At this time, the emission current Ie of 0.7 $\mu$A was obtained.

EXAMPLE 2

0.12 g of diethanolamine and 20 g of water were added to 0.1 g of palladium acetate, and they were mixed by stirring to obtain a transparent solution. 5 g of isopropyl alcohol was added to the resultant solution, the resultant solution was filtered with a membrane filter having a pore size of 0.22 $\mu$m, and the filtered solution was filled in a bubble jet printer head BC-01 available from CANON INC. When an electron-emitting device was manufactured under the same conditions as those of Example 1 except that a liquid droplet was ejected by using the above head, the device having characteristics which were almost the same as those of the device in Example 1 could be obtained.

EXAMPLE 3

0.18 g of N-ethyl-N-propanolamine and 20 g of water were added to 0.1 g of palladium acetate, and they were mixed by stirring to obtain a transparent solution. 5 g of isopropyl alcohol was added to the resultant solution, the resultant solution was filtered with a membrane filter having a pore size of 0.22 μm, and the filtered solution was filled in a printer head BC-01. When an electron-emitting device was manufactured under the same conditions as those of Examples 1 and 2 except that a liquid droplet was ejected by using the above head, the device having characteristics which were almost the same as those of the device in Examples 1 and 2 could be obtained.

EXAMPLE 4

0.2 g of N-ethyl-N-pentanolamine and 20 g of water were added to 0.1 g of palladium acetate, and they were mixed by stirring to obtain a transparent solution. 5 g of isopropyl alcohol was added to the resultant solution, the resultant solution was filtered with a membrane filter having a pore size of 0.22 μm, and the filtered solution was filled in a printer head BC-01. When an electron-emitting device was manufactured under the same conditions as those of Example 1 except that a liquid droplet was ejected by using the above head, the device having characteristics which were almost the same as those of the device in Example 1 could be obtained.

EXAMPLE 5

0.12 g of monoethanolamine and 20 g of water were added to 0.11 g of palladium propionate, and they were mixed by stirring to obtain a light-orange transparent solution. 5 g of isopropyl alcohol was added to the resultant solution, the resultant solution was filtered with a membrane filter having a pore size of 0.22 μm, and the filtered solution was filled in a printer head BC-01. When an electron-emitting device was manufactured under the same conditions as those of Example 1 except that a liquid droplet was ejected by using the above head, the device having characteristics which were almost the same as those of the device in Example 1 could be obtained.

Supplemental Example 1

When 20 g of water was added to 0.1 g of palladium acetate, and they are mixed by stirring, about half of the palladium acetate added first was dissolved to obtain an orange solution. Palladium acetate which was not dissolved was precipitated on the vessel bottom. 5 g of isopropyl alcohol was added to the supernatant solution, the resultant solution was filtered with a membrane filter having a pore size of 0.22 μm, and the filtered solution was filled in a printer head BC-01. By using this head, a liquid droplet was ejected nine times to the device electrode gap portion of a quartz substrate formed in the same manner as that in Example 1 to adhere the liquid droplet to the portion. When this substrate was annealed at 360° C. for 15 minutes in an electric furnace of an atmospheric atmosphere, an electric resistance between device electrodes 2 and 3 was 210 kΩ.

Subsequent steps including energization forming were performed in the same manner as in Example 1, and the electron-emitting characteristics were evaluated. As a result, a device current of 0.13 mA, and an emission current below the limit (0.05 μA) of the measurement apparatus were observed.

Supplemental Example 2

20 g of water and 5 g of isopropyl alcohol were added to 0.16 g of potassium tetrachloropalladate, and they are mixed to obtain a solution. The resultant solution was filtered with a membrane filter having a pore size of 0.22 μm, and the filtered solution was filled in a printer head BC-01. By using this head, a liquid droplet was ejected fourteen times to the device electrode gap portion of a quartz substrate formed in the same manner as that in Example 1 to adhere the liquid droplet to the portion. When this substrate was annealed at 360° C. for 15 minutes in an electric furnace of an atmospheric atmosphere, an electric resistance between device electrodes 2 and 3 was 100 MΩ or more, and an electroconductive film was not obtained. When the surface of the device electrode gap portion was subjected to element analysis, palladium, chlorine, and potassium were detected. For this reason, it was understood that potassium tetrachloropalladate was left unbaked.

As described above, when an organic acid group, a transition metal, and an alcohol amine as represented by formula (1) or (2) were present, solubility of a transition metal in water which was higher than that in a liquid consisting of only an organic acid group and a transition metal without an alcohol amine was obtained. For this reason, it was understood that a liquid having a metal content which was sufficient to use the liquid for an electroconductive film could be obtained. In addition, in the above examples, the treatment of applying the metal-containing liquid of the present invention to the substrate and baking the substrate, generation of a metal compound crystal having a visible size was not detected. Therefore, it was shown that generation of a crystal was suppressed in the metal-containing liquid of the present invention in drying/baking treatment and that a homogeneous film could be obtained.

The reason why the solubility is improved may be follows. That is, the alcohol amine is combined to the transition metal as a ligand, an organometallic complex having high water solubility is generated in the solution. The following examples show that the complex having high water solubility is actually synthesized and isolated.

The effect that crystal generation is suppressed may be obtained because the complex is not easily crystallized.

It was shown that the metal-containing solution of the present invention could be baked at a relative low temperature, e.g., about 360° C. The low-temperature baking properties may be obtained because the thermal decomposition temperature of the organometallic complex which is estimated to be generated in the solution is low.

An example wherein an organometallic compound which contains an organic acid group, a transition metal, and an alcohol amine as represented by the above formula (1), which is easily dissolved in water, and which can be thermally decomposed at a relatively low temperature is synthesized, and preparation of an electron-emitting device manufacturing liquid of the present invention obtained by dissolving the compound in water and an electron-emitting device or an image-forming apparatus using the liquid will be described below in detail.

EXAMPLE 6

A palladium acetate-monoethanolamine complex (to be referred to as a PA-ME hereinafter) used in this example was synthesized as follows. 10 g of palladium acetate was suspended in 200 $cm^3$ of IPA, 16.6 g of monoethanolamine was added to the suspended solution, and the resultant solution was stirred at room temperature for four hours. Upon completion of reaction, IPA was removed by evaporation, the resultant solid matter was dissolved in ethanol and filtered, and PA-ME was obtained from the filtered solution by re-crystallization. The resultant crystal was subjected to element analysis and NMR analysis. As a result, this crystal is identified as a crystal in which four molecules of monoethanolamine is coordinated with palladium acetate.

As a result of thermogravimetric analysis (TG) in the air, decomposition of PA-ME was started at 100° C. and ended at 310° C. Since the weight of palladium acetate left at 350° C. was equal to a theoretical weight calculated on the basis of the charge of the palladium acetate, it was confirmed that the PA-ME had no sublimation properties.

EXAMPLE 7

A palladium acetate-diethanolamine complex (to be referred to as a PA-DE hereinafter) used in this example was synthesized as follows. 10 g of palladium acetate was suspended in 200 $cm^3$ of IPA, 24.4 g of diethanolamine was added to the suspended solution, and the resultant solution was stirred at room temperature for twelve hours. Upon completion of reaction, IPA was removed by evaporation, the resultant solid matter was dissolved in ethanol and filtered, and PA-DE was obtained from the filtered solution by re-crystallization.

As a result of TG measurement in the air, decomposition of PA-DE was started at 100° C. and ended at 305° C. It was confirmed that the PA-DE had no sublimation properties.

EXAMPLE 8

A palladium acetate-triethanolamine complex (to be referred to as a PA-TE hereinafter) used in this example was synthesized as follows. 10 g of palladium acetate was suspended in 200 $cm^3$ of IPA, 40.7 g of triethanolamine was added to the suspended solution, and the resultant solution was stirred at 35° C. for ten hours. Upon completion of reaction, IPA was removed by evaporation, the resultant solid matter was dissolved in ethanol and filtered, and PA-TE was obtained from the filtered solution by re-crystallization.

As a result of TG measurement in the air, decomposition of PA-TE was started at 135° C. and ended at 280° C. It was confirmed that the PA-TE had no sublimation properties.

Supplemental Example 3

When TG measurement of palladium acetate was performed in the atmosphere, and a decomposition start temperature of 220° C. and a decomposition end temperature of 310° C. were set, the weight of palladium acetate which was a residue at 350° C. was 94% of a theoretical weight calculated on the basis of the weight of charged palladium acetate. Therefore, 6% of palladium was lost in thermal decomposition.

Supplemental Example 4

When TG measurement of palladium acetate bis (dipropylamine) was performed in the atmosphere, and a melting point of 126° C., a weight reduction start temperature of 122° C., and a weight reduction end temperature of 250° C. were set, the weight of palladium acetate which was a residue at 350° C. was 71% of a theoretical weight calculated on the basis of the weight of charged palladium acetate bis(dipropylamine). The organometallic composition having, as a ligand, amine having no hydroxyl group was thermally decomposed and vaporized at once, and 29% of palladium was lost.

EXAMPLE 9

An electron-emitting device of a type shown in FIGS. 1A and 1B was manufactured as an electron-emitting device according to this example. A method of manufacturing the electron-emitting device of this example will be described below with reference to FIGS. 1A and 1B and FIGS. 2A to 2E. Reference numerals in these drawings follow the reference numerals in the above examples.

A quartz substrate was used as an insulating substrate 1, and the insulating substrate 1 sufficiently washed with distilled water, and dried with hot air. Device electrodes 2 and 3 consisting of Au were formed on the surface of the substrate 1 (FIGS. 2A and 2B). At this time, an inter-device-electrode interval L was set to be 3 $\mu$m, a width W of each device electrode was set to be 500 $\mu$m, and a thickness d of each device electrode was set to be 1,000 Å.

0.84 g of PA-ME was dissolved in 12 g of water to prepare an aqueous solution for bubble jet application (1.5 wtPd %).

By using a bubble jet type ink jet apparatus (bubble jet-10V available from CANON INC.), the aqueous PA-ME solution was applied to a portion between the device electrodes 2 and 3 (FIG. 2C) and dried. It was confirmed by X-ray diffraction that the thin film obtained by using the aqueous PA-ME solution as described above was non-crystallized.

The resultant structure was heated at 300° C. in an oven of in the atmosphere to decompose and deposit the PA-ME on the substrate, thereby forming a fine particle film constituted by palladium oxide fine particles (average particle size: 65 Å) as an electroconductive film 4 (FIG. 2D). It was confirmed by X-ray diffraction that the film 4 consisted of palladium oxide. The PA-ME was not melted in the heating treatment, and was thermal decomposed while keeping its thin-film state. In this case, a width W' of the electroconductive film 4 was set to be 300 $\mu$m, and the electroconductive film 4 was arranged at an almost central portion between the device electrodes 2 and 3. The thickness of the electroconductive film 4 was 100 Å, and the sheet resistance of the electroconductive film 4 was $5\times10^4\Omega/\square$.

Note that the fine particle film described here is a film obtained by assembling a plurality of fine particles. Its fine structure means not only a film in which respective fine particles are dispersed and arranged, but also a film in which fine particles are adjacent to each other or overlap (including an island-like state). The particle size means the diameter of a fine particle whose particle shape can be recognized in the above state.

As shown in FIG. 2E, an electron-emitting region 5 was formed in such a manner that a voltage was applied across the device electrodes 2 and 3 to perform energization forming to the electroconductive film 4. The voltage waveform in the forming treatment is shown in FIG. 3A.

Referring to FIG. 3A, reference symbols T1 and T2 denote the pulse width and pulse interval of the voltage waveform, respectively. In this example, T1 was set to be 1 ms; T2, 10 ms; and the peak value (peak voltage in forming treatment) of a chopping wave, 5 V. The forming treatment was performed for 60 seconds in a vacuum atmosphere of about $1\times10^{-6}$ torr. The following treatment is the same as in Example 1.

The electron-emitting characteristics of the device manufactured as described above were measured. FIG. 4 is a schematic view showing the arrangement of a measurement evaluation apparatus. Reference numerals in FIG. 4 follow the reference numerals in the above examples. Note that, in this example, the distance between an anode and the electron-emitting device was set to be 4 mm, the potential of the anode was set to be 1 KV, and the degree of vacuum in a vacuum apparatus in measurement of the electron-emitting characteristics was set to be $10^{-6}$ torr.

The measurement evaluation apparatus described above was used, and a device voltage was applied across the electrodes 2 and 3 of the electron-emitting device. When a device current If and an emission current Ie flowing at this time were measured, current-voltage characteristics shown in FIG. 5 were obtained. In the device in this example, the emission current Ie begun to sharply increase from a device voltage of about 8 V, the device current If and the emission current Ie respectively became 2.3 mA and 1.2 $\mu$A at the device voltage of 16 V, and electron-emitting efficiency $\eta$=Ie/If (%) was 0.05%.

In the example described above, when the electron-emitting region is to be formed, a chopping-wave pulse is applied across the device electrodes to perform forming treatment. However, the waveform applied across the device electrodes is not limited to the chopping wave, and a desired waveform such as a rectangular wave may be used. The peak value, pulse width, pulse intervals, and the like of the wave are not limited to the above values. If the electron-emitting region is preferably formed, the desirable values can be selected.

EXAMPLE 10

1.07 g of PA-DE serving as an organometallic complex was dissolved in 12 g of water to prepare an aqueous solution for bubble jet application (2.0 wtPd %). An electron-emitting device was manufactured in the same method as that of Example 9 except that this aqueous solution was used.

In the device obtained in this example, the emission current Ie begun to sharply increase from a device voltage of about 7.9 V, the device current If and the emission current Ie respectively became 2.4 mA and 1.3 $\mu$A at the device voltage of 16 V, and electron-emitting efficiency $\eta$=Ie/If (%) was 0.052%.

EXAMPLE 11

1.31 g of PA-TE serving as an organometallic complex was dissolved in 12 g of water to prepare an aqueous solution for bubble jet application (2.0 wtPd %). An electron-emitting device was manufactured in the same method as that of Example 9 except that this aqueous solution was used.

In the device obtained in this example, the emission current Ie begun to sharply increase from a device voltage of about 7.9 V, the device current If and the emission current Ie respectively became 2.4 mA and 1.4 $\mu$A at the device voltage of 16 V, and electron-emitting efficiency $\eta$=Ie/If (%) was 0.053%.

EXAMPLE 12

13 g of palladium valerate was suspended in 200 ml of isopropyl alcohol, 16.6 g of monoethanolamine was added to the suspended solution, and the resultant solution was stirred for six hours. The solvent was distilled off in a reduced-pressure state, and the resultant solid matter was recrystallized by a solvent mixture of ethanol and ethyl acetate. According to the results of CHN element analysis and IPC analysis of palladium, it is understood that the solid has the composition of tetrakis(monoethanolamine) palladium valerate salt. 0.92 g of this solid and 5 g of isopropyl alcohol were dissolved in 12 g of water, and this aqueous solution was used in place of the aqueous solution for bubble jet application in Example 9. In this state, an electron-emitting device was manufactured in the same manner as in Example 9, and device characteristics were measured. At a device voltage of 14 V, a device current If was 1.7 mA, and an emission current was 0.6 $\mu$A.

EXAMPLE 13

In this Example, an image-forming apparatus was manufactured in the following manner. A method of manufacturing an electron source of the image-forming apparatus of this example will be described below with reference to FIGS. 15 and 16.

Figure 15:
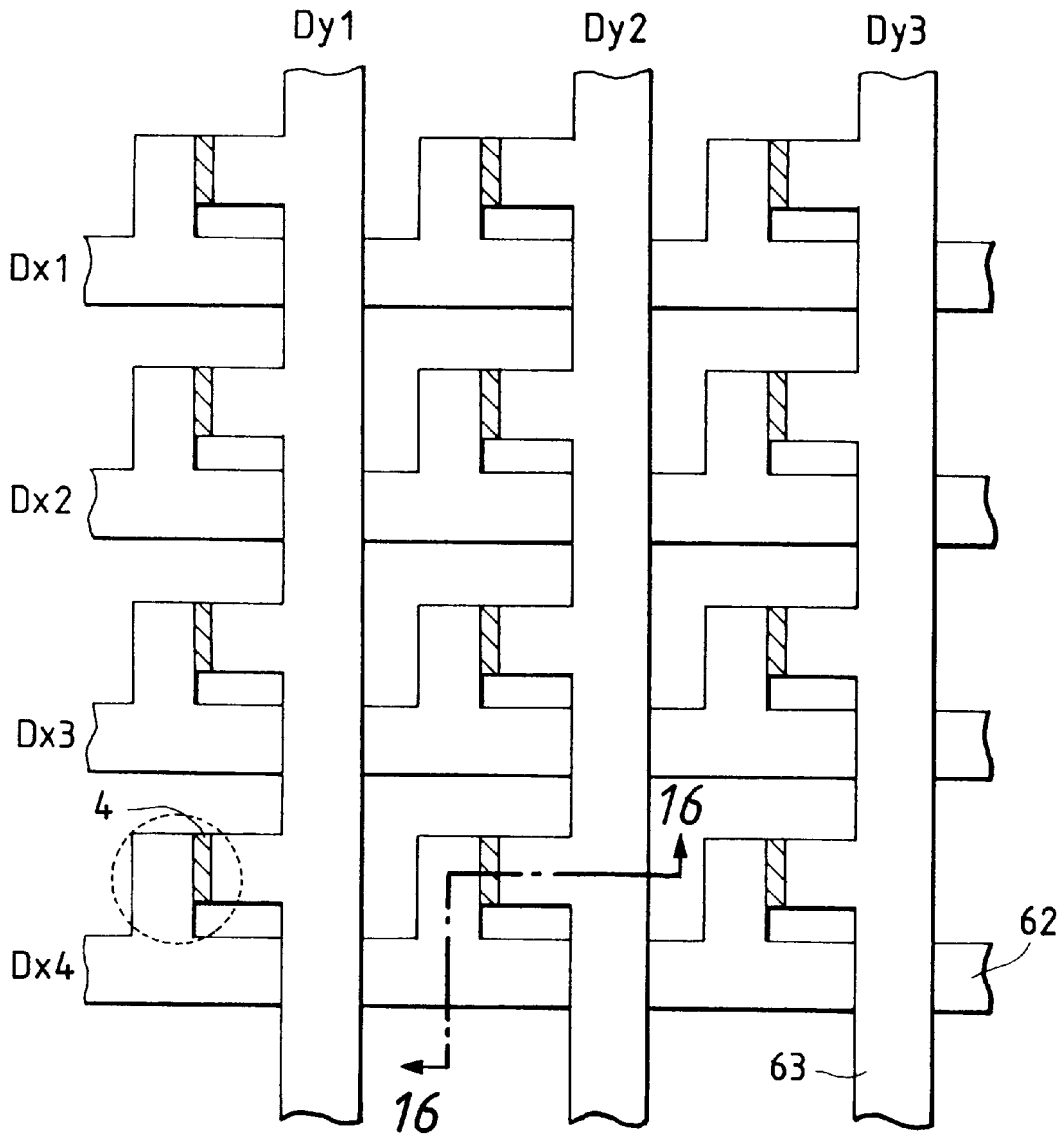
FIG. 15 is a schematic plan view of part of an electron source.
Figure 16:
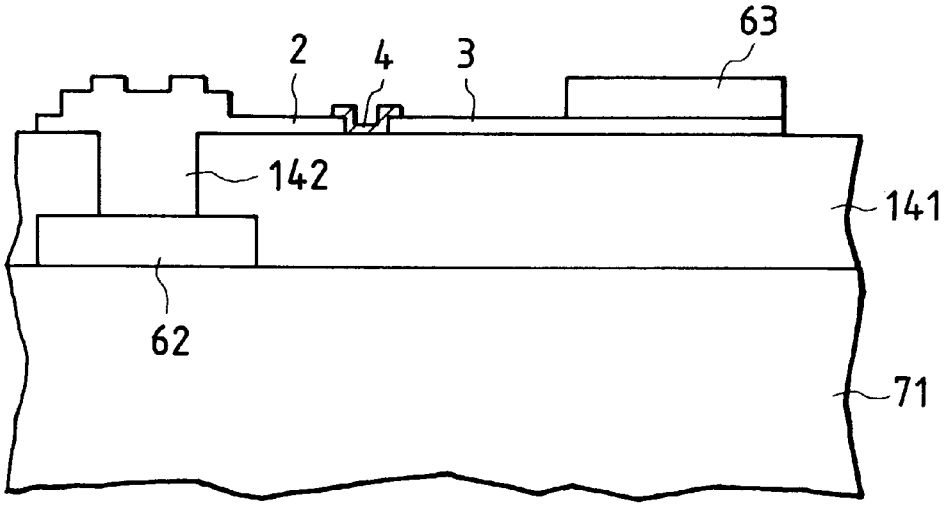
FIG. 16 is a schematic sectional view taken along line 16—16 in FIG. 15.
Figure 17:
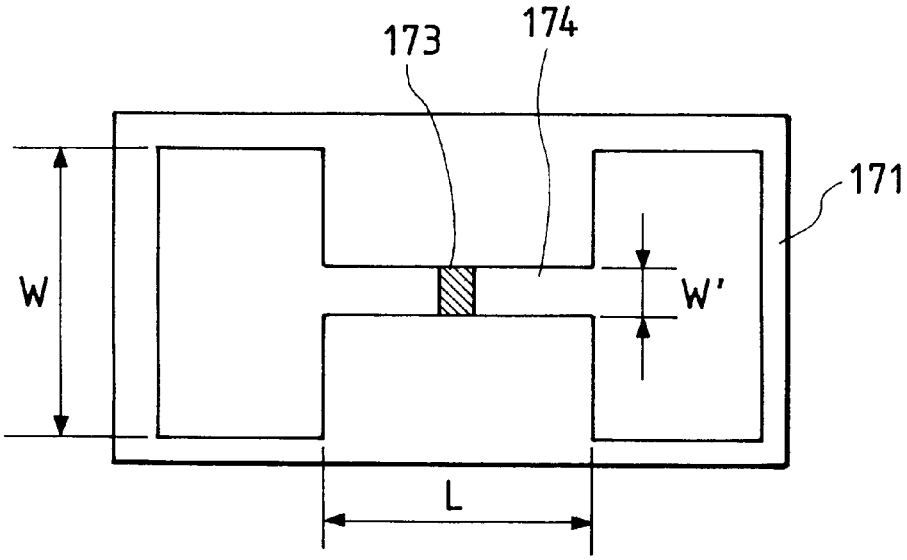
FIG. 17 is a schematic plan view of a known electron-emitting device.

FIG. 15 is a plan view showing a part of the electron source, and FIG. 16 is a sectional view showing the electron source along a line 16—16 in FIG. 15. The same reference numerals as in FIGS. 15 and 16 denote the same parts in FIGS. 15 and 16. Referring to FIGS. 15 and 16, reference numeral 71 denotes an insulating substrate; 62, an X-direction wire (also called lower wire) corresponding to Dxm in FIGS. 6 and 7; 63, an Y-direction wire (also called upper wire) corresponding to Dyn in FIGS. 6 and 7; 4, an electroconductive film; 2 and 3, device electrodes; 141, an insulating interlayer; 142, a contact hole for electrically connecting the device electrode 2 to the lower wire 62.

Step-a

A Cr film having a thickness of 50 Å and an Au film having a thickness of 6,000 Å were sequentially stacked by vacuum evaporation on the substrate 71 obtained by forming a silicon oxide film having a thickness of 0.5 $\mu$m on a cleaned soda lime glass plate by sputtering, and a photoresist (AZ1370 available from Hoechst) was spin-coated on the resultant structure by a spinner and baked. A photomask image was exposed and developed to form the resist pattern of the lower wire 62, and the Au/Cr deposition film was wet-etched to form the lower wire 62 having a desired shape.

Step-b

The insulating interlayer 141 consisting of a silicon oxide film having a thickness of 0.1 $\mu$m was deposited by an RF sputtering method.

Step-c

A photoresist pattern for forming the contact hole 142 in the silicon oxide film deposited in Step b was formed, and the insulating interlayer 141 was etched by using the photoresist pattern as a mask to form the contact hole 142. The etching was performed by RIE (Reactive Ion Etching) method using $CF_4$ and $H_2$ gases.

Step-d

Thereafter, a pattern to be the device electrodes 2 and 3 and an inter-device-electrode gap G was formed by a photoresist (RD-2000N-41 available from Hitachi Chemical Co., Ltd.), and a Ti film having a thickness of 50 Å and an Ni film having a thickness of 1,000 Å were sequentially deposited by vacuum evaporation. The photoresist pattern was dissolved by an organic solvent, and the Ni/Ti deposition film was lifted off, thereby forming the device electrodes 2 and 3 having an inter-device-electrode L of 3 $\mu$m and a width W of each device electrode of 300 $\mu$m.

Step-e

A photoresist pattern of the upper wire 63 was formed on the device electrodes 2 and 3, and a Ti film having a thickness of 50 Å and an Au film having a thickness of 5,000 Å were sequentially deposed by vacuum evaporation. An unnecessary portion was removed by a lift-off operation to form the upper wire 63 having a desired shape.

Step-f

An aqueous organometallic complex (PA-ME) solution used in Example 9 was applied to a portion between the device electrodes 2 and 3 by using a bubble jet type ink jet apparatus (bubble jet-10V available from CANON INC.), and the resultant structure was subjected to heating/baking treatment at 300° C. for 10 minutes. The electroconductive film 4 formed as described above was a thin film constituted by fine particles consisting of Pd as a main element, its film thickness was 100 Å, and its sheet resistance was $5\times10^4\Omega/\square$. Note that the fine particle film described here follows the fine particle described above.

Step-g

After a pattern for applying a resist on a portion except for the contact hole 142 portion was formed, a Ti having a thickness of 50 Å and an Au film having a thickness of 5,000 Å were sequentially formed by vacuum evaporation. An unnecessary portion was removed by a lift-off operation to bury the contact hole 142.

With the above steps, the lower wire 62, the insulating interlayer 141, the upper wire 63, the device electrodes 2 and 3, the electroconductive film 4, and the like were formed on the insulating substrate 71.

A display panel was constituted by using the electron source manufactured as described above. A method of manufacturing a display panel of the image-forming apparatus of this example will be described below with reference to FIGS. 8A and 8B. Reference numerals in FIGS. 8A and 8B are as described above.

A substrate 61 on which a large number of flat type electron-emitting devices were manufactured as described above was fixed on a rear plate 71, a face plate 76 (obtained by forming a fluorescent film 74 and a metal back 75 on the inner surface of a glass substrate 73) was arranged 5 mm above the substrate 61 through a support frame 72. Frit glass was applied to the joint portion of the face plate 76, the support frame 72, and the rear plate 71, and the resultant structure was baked in the air or a nitrogen atmosphere at 400° C. to 500° C. for 10 minutes or more to be sealed (FIG. 7). The substrate 61 was fixed to the rear plate 71 by frit glass. Referring to FIG. 7, reference numeral 64 denotes an electron-emitting device; and 62 and 63, X- and Y-direction wires, respectively.

The fluorescent film 74 consisted of only a phosphor when a monochromatic display panel was used. However, in this example, a phosphor having a stripe shape was employed. That is, black stripes were formed first, phosphors of respective colors were applied to the gap portions of the black stripes, thereby forming the fluorescent film 74. A material containing graphite as a main component ordinarily used as the material of the black stripes was used, and a slurry method was used as a method of applying the phosphor on the glass substrate 73.

The metal back 75 is ordinarily arranged on the inner surface side of the fluorescent film 74. The metal back was formed in such a manner that, after the fluorescent film was formed, smoothing treatment (generally called filming) of the inner surface of the fluorescent film 74, and Al was vacuum-evaporated on the surface.

In order to more improve conductivity of the fluorescent film 74, a transparent electrode (not shown) may be formed on the outer surface of the fluorescent film 74 in the face plate 76. However, in this example, since sufficient conductivity can be obtained by only the metal back, the transparent electrode is omitted.

In the above sealing, sufficient positional alignment was performed because the phosphors of respective colors had to correspond to electron-emitting devices in a color display panel.

The gas in the glass vessel (envelope) completed as described above was exhausted by a vacuum pump through an exhaust pipe (not shown), and a sufficient degree of vacuum was obtained. Thereafter, a voltage was applied across the device electrodes 2 and 3 of the electron-emitting device 64 through out-of-vessel terminals Dox1 to Doxm and Doy1 to Doyn, and energization forming was performed to the electroconductive film 4, thereby manufacturing the electron-emitting region 5. The voltage waveform of the forming treatment is shown in FIG. 3A.

Referring to FIG. 3A, reference symbols T1 and T2 denote the pulse width and pulse interval of the voltage waveform, respectively. In this example, T1 was set to be 1 ms; T2, 10 ms; and the peak value (peak voltage in forming treatment) of a chopping wave, 5 V. The forming treatment was performed for 60 seconds in a vacuum atmosphere of about $1\times10^{-6}$ torr. The following treatment is the same as in Example 9.

An exhaust pipe (not shown) was heated by a gas burner at a degree of vacuum of about $1\times10^{-6}$ torr to be welded, thereby sealing the envelope.

Finally, getter treatment was performed to keep the degree of vacuum after sealing. For this purpose, immediately before sealing, a getter located at a predetermined position (not shown) in the display panel was heated by a heating method such as a high-frequency heating method, and the evaporation film was formed and treated. As the getter, a getter containing Ba or the like as a main component was used.

An image display apparatus was formed by using the display panel completed as described above (drive circuit is not shown), and a scanning signal and a modulation signal were applied to the electron-emitting devices by signal generation means (not shown) through the out-of-vessel terminals Dox1 to Doxm and Doy1 to Doyn to cause the electron-emitting devices to emit electrons. A voltage of several kV or more was applied to the metal back 75 through a high-voltage terminal Hv to accelerate the electron beam, and the electron beam was caused to collide with the fluorescent film 74 to excite the fluorescent film 74 and to cause the fluorescent film 74 to emit, thereby display an image.

In order to recognize the characteristics of the flat type electron-emitting device manufactured in the above steps, at the same time, a sample of a standard electron-emitting device having the same dimensions, i.e., L, W, and W', as those of the flat type electron-emitting device shown in FIGS. 1A and 1B was manufactured, and the electron-emitting characteristics of this sample was measured by using the measurement evaluation apparatus in FIG. 4. Note that, as the measurement conditions of the sample, the distance between an anode and the electron-emitting device was set to be 4 mm, the potential of the anode was set to be 1 kV, and the degree of vacuum in a vacuum apparatus in measurement of the electron-emitting characteristics was set to be $1\times10^{-6}$ torr.

When a device voltage was applied across the electrodes 2 and 3 to measure a device current If and an emission current Ie flowing at this time, current-voltage characteristics shown in FIG. 5 were obtained. In the device obtained in this example, the emission current Ie begun to sharply increase from a device voltage of about 8 V, the device current If and the emission current Ie respectively became 2.2 mA and 1.1 $\mu$A at the device voltage of 16 V, and electron-emitting efficiency $\eta$=Ie/If (%) was 0.05%.

EXAMPLE 14

A palladium acetate-bis(N,N-dibutylethanolamine) (to be referred to as a PADBE hereinafter) used in this example was synthesized as follows.

10 g of palladium acetate was suspended in 200 $cm^3$ of diethylether, 17 g of N,N-dibutylethanolamine was added to the suspended solution, and the resultant solution was stirred at room temperature for four hours. Upon completion of reaction, diethylether was distilled off in a reduced-pressure state, the resultant solid matter was dissolved in n-hexane and filtered, and PADBE was recrystallized from the filtered solution.

As a result of TG measurement in the air, a temperature at which decomposition of PADBE was ended was 253° C.

EXAMPLE 15

A palladium acetate-di(N-butylethanolamine) (to be referred to as a PABE hereinafter) used in this example was synthesized as follows.

10 g of palladium acetate was suspended in 200 $cm^3$ of acetone, 11.5 g of N-butylethanolamine was added to the suspended solution, and the resultant solution was stirred at room temperature for four hours. Upon completion of reaction, acetone was distilled off in a reduced-pressure state, the resultant solid matter was dissolved in acetone diethylether and filtered, and PABE was recrystallized from the filtered solution.

As a result of TG measurement in the air, a temperature at which decomposition of PABE was ended was 245° C.

EXAMPLE 16

A method of manufacturing an electron-emitting device of this example will be described below with reference to FIGS. 2A to 2E.

A quartz substrate was used as an insulating substrate 1, and the insulating substrate 1 was sufficiently washed with an organic solvent and distilled water, and was dried with hot air. Device electrodes 2 and 3 consisting of Au were formed on the surface of the substrate 1 (FIGS. 2A and 2B). At this time, an inter-device-electrode interval L was set to be 3 $\mu$m, a width W of each device electrode was set to be 500 $\mu$m, and a thickness d of each device electrode was set to be 1,000 Å.

1.28 g of PADBE was dissolved in 12 g of water to prepare an aqueous solution for BJ application (1.8 wtPd %).

By using a BJ type ink jet apparatus (BJ-10V available from CANON INC.), the aqueous PADBE solution was applied to a portion between the device electrodes 2 and 3 (FIG. 2C) and dried.

The resultant structure was heated at 250° C. in an oven of in the atmosphere to decompose and deposit the PADBE on the substrate, thereby forming a fine particle film constituted by palladium oxide fine particles (average particle size: 65 Å) as an electron-emitting region forming thin film 4 (FIG. 2D). It was confirmed by X-ray diffraction that the film 4 consisted of palladium oxide. In this case, a width (width of device) of the electron-emitting region forming thin film 4 was set to be 300 $\mu$m, and the electron-emitting region forming thin film 4 was arranged at an almost central portion between the device electrodes 2 and 3. The thickness of the electron-emitting region forming thin film 4 was 100 Å, and the sheet resistance of the electron-emitting region forming thin film 4 was $5\times10^4\Omega/\square$.

The subsequent forming, activation, and stabilization were performed as in Example 1.

The electron-emitting characteristics of the device manufactured as described above were measured. FIG. 4 is a schematic view showing the arrangement of a measurement evaluation apparatus.

Note that, in this example, the distance between an anode and the electron-emitting device was set to be 4 mm, the potential of the anode was set to be 1 KV, and the degree of vacuum in a vacuum apparatus in measurement of the electron-emitting characteristics was set to be $10^{-7}$ torr.

The measurement evaluation apparatus described above was used, and a device voltage was applied across the electrodes 2 and 3 of the electron-emitting device. When a device current If and an emission current Ie flowing at this time were measured, current-voltage characteristics shown in FIG. 5 were obtained. In the device in this example, the emission current Ie begun to sharply increase from a device voltage of about 8 V, the device current If and the emission current Ie respectively became 2.4 mA and 1.2 $\mu$A at the device voltage of 16 V, and electron-emitting efficiency $\eta$=Ie/If (%) was 0.05%.

In the example described above, when the electron-emitting region is to be formed, a chopping-wave pulse is applied across the device electrodes to perform forming treatment. However, the waveform applied across the device electrodes is not limited to the chopping wave, and a desired waveform such as a rectangular wave may be used. The peak value, pulse width, pulse intervals, and the like of the wave are not limited to the above values. If the electron-emitting region is preferably formed, the desirable values can be selected.

EXAMPLE 17

1.03 g of PABE serving as an organometallic complex was dissolved in 12 g of water to prepare an aqueous solution for BJ application (1.8 wtPd %). An electron-emitting device was manufactured by the same electron-emitting device manufacturing method as that of Example 3.

In this device, the emission current Ie begun to sharply increase from a device voltage of about 7.9 V, the device current If and the emission current Ie respectively became 2.3 mA and 1.1 $\mu$A at the device voltage of 16 V, and electron-emitting efficiency $\eta$=Ie/If (%) was 0.05%.

EXAMPLE 18

FIG. 15 is a plan view showing a part of the electron source, and FIG. 16 is a sectional view showing the electron source along a line 16—16 in FIG. 15. The same reference numerals as in FIGS. 15 and 16 denote the same parts in FIGS. 15 and 16. Referring to FIGS. 15 and 16, reference numeral 71 denotes an insulating substrate corresponding to 71 in FIG. 7; 62, an X-direction wire (also called lower wire) corresponding to Dxm in FIGS. 6 and 7; 63, an Y-direction wire (also called upper wire) corresponding to Dyn in FIGS. 6 and 7; 4, a thin film including an electron-emitting region; 2 and 3, device electrodes; 141, an insulating interlayer; 142, a contact hole for electrically connecting the device electrode 2 to the lower wire 62.

Step-a

A Cr film having a thickness of 50 Å and an Au film having a thickness of 6,000 Å were sequentially stacked by vacuum evaporation on the substrate 71 obtained by forming a silicon oxide film having a thickness of 0.5 $\mu$m on a cleaned soda lime glass plate by sputtering, and a photoresist (AZ1370 available from Hoechst) was spin-coated on the resultant structure by a spinner and baked. A photomask image was exposed and developed to form the resist pattern of the lower wire 62, and the Au/Cr deposition film was wet-etched to form the lower wire 62 having a desired shape.

Step-b

The insulating interlayer 141 consisting of a silicon oxide film having a thickness of 0.1 $\mu$m was deposited by an RF sputtering method.

Step-c

A photoresist pattern for forming the contact hole 142 in the silicon oxide film deposited in Step b was formed, and the insulating interlayer 141 was etched by using the photoresist pattern as a mask to form the contact hole 142. The etching was performed by RIE (Reactive Ion Etching) method using $CF_4$ and $H_2$ gases.

Step-d

Thereafter, a pattern to be the device electrodes 2 and 3 and an inter-device-electrode gap was formed by a photoresist (RD-2000N-41 available from Hitachi Chemical Co., Ltd.), and a Ti film having a thickness of 50 Å and an Ni film having a thickness of 1,000 Å were sequentially deposited by vacuum evaporation. The photoresist pattern was dissolved by an organic solvent, and the Ni/Ti deposition film was lifted off, thereby forming the device electrodes 2 and 3 having an inter-device-electrode L of 3 $\mu$m and a width W of each device electrode of 300 $\mu$m.

Step-e

A photoresist pattern of the upper wire 63 was formed on the device electrodes 2 and 3, and a Ti film having a thickness of 50 Å and an Au film having a thickness of 5,000 Å were sequentially deposed by vacuum evaporation. An unnecessary portion was removed by a lift-off operation to form the upper wire 63 having a desired shape.

Step-f

An aqueous organometallic complex (aqueous PADBE solution) solution used in Example 16 was applied to a portion between the device electrodes 2 and 3 by using a BJ type ink jet apparatus (BJ-10V available from CANON INC.), and the resultant structure was subjected to heating/baking treatment at 250° C. for 10 minutes. The electron-emitting region forming thin film 4 formed as described above and constituted by fine particles consisting of Pd as a main element had a film thickness of 100 Å, and a sheet resistance if $5\times10^4\Omega/\square$.

Step-g

After a pattern for applying a resist on a portion except for the contact hole 142 portion was formed, a Ti having a thickness of 50 Å and an Au film having a thickness of 5,000 Å were sequentially formed by vacuum evaporation. An unnecessary portion was removed by a lift-off operation to bury the contact hole 142.

With the above steps, the lower wire 62, the insulating interlayer 141, the upper wire 63, the device electrodes 2 and 3, the electron-emitting region forming thin film, and the like were formed on the insulating substrate 71.

A display panel constituted by using the electron source manufactured as described above will be described below with reference to FIGS. 7 to 8B.

A substrate 61 on which a large number of flat type electron-emitting devices were manufactured as described above was fixed on a rear plate 71, a face plate 76 (obtained by forming a fluorescent film 74 and a metal back 75 on the inner surface of a glass substrate 73) was arranged 5 mm above the substrate 61 through a support frame 72. Frit glass was applied to the joint portion of the face plate 76, the support frame 72, and the rear plate 71, and the resultant structure was baked in the air or a nitrogen atmosphere at 400° C. to 500° C. for 10 minutes or more to be sealed (FIG. 7). The substrate 61 was fixed to the rear plate 71 by frit glass.

Referring to FIG. 6, reference numeral 64 denotes an electron-emitting device; and 62 and 63, X- and Y-direction wires, respectively.

The fluorescent film 74 consisted of only a phosphor when a monochromatic display panel was used. However, in this example, a phosphor having a stripe shape was employed. That is, black stripes were formed first, phosphors of respective colors were applied to the gap portions of the black stripes, thereby forming the fluorescent film 74. A material containing graphite as a main component ordinarily used as the material of the black stripes was used, and a slurry method was used as a method of applying the phosphor on the glass substrate 73.

The metal back 75 is ordinarily arranged on the inner surface side of the fluorescent film 74. The metal back was formed in such a manner that, after the fluorescent film was formed, smoothing treatment (generally called filming) of the inner surface of the fluorescent film 74, and Al was vacuum-evaporated on the surface.

In order to more improve conductivity of the fluorescent film 74, a transparent electrode (not shown) may be formed on the outer surface of the fluorescent film 74 in the face plate 76. However, in this example, since sufficient conductivity can be obtained by only the metal back, the transparent electrode is omitted.

In the above sealing, sufficient positional alignment was performed because the phosphors of respective colors had to correspond to electron-emitting devices in a color display panel.

The gas in the glass vessel completed as described above was exhausted by a vacuum pump through an exhaust pipe (not shown), and a sufficient degree of vacuum was obtained. Thereafter, a voltage was applied across the device electrodes 2 and 3 of the electron-emitting device 64 through out-of-vessel terminals Dox1 to Doxm and Doy1 to Doyn, and energization forming was performed to the electron-emitting region forming thin film 4, thereby manufacturing the electron-emitting region 5. The voltage waveform of the forming treatment is shown in FIG. 3A.

Referring to FIG. 3A, reference symbols T1 and T2 denote the pulse width and pulse interval of the voltage waveform, respectively. In this example, T1 was set to be 1 ms; T2, 10 ms; and the peak value (peak voltage in forming treatment) of a chopping wave, 5 V. The forming treatment was performed for 60 seconds in a vacuum atmosphere of about $1\times10^{-6}$ torr.

Forming was performed, and acetone was guided to the glass vessel to set a degree of vacuum of $10^{-4}$ torr, thereby forming the electron-emitting region 5. In this manner, the electron-emitting device 64 was manufactured.

Stabilization was performed in a degree of vacuum of $10^{-7}$ torr at 150° C. for five hours, and the exhaust pipe (not shown) was heated by a gas burner to be welded, thereby sealing the envelope.

Finally, getter treatment was performed to keep the degree of vacuum after sealing. For this purpose, immediately before sealing, a getter located at a predetermined position (not shown) in the display panel was heated by a heating method such as a high-frequency heating method, and the evaporation film was formed and treated. As the getter, a getter containing Ba or the like as a main component was used.

In an image display apparatus according to the present invention completed as described above, a scanning signal and a modulation signal were applied to the electron-emitting devices by signal generation means (not shown) through the out-of-vessel terminals Dox1 to Doxm and Doy1 to Doyn to cause the electron-emitting devices to emit electrons. A voltage of several kV or more was applied to the metal back 75 through a high-voltage terminal Hv to accelerate the electron beam, and the electron beam was caused to collide with the fluorescent film 74 to excite the fluorescent film 74 and to cause the fluorescent film 74 to emit, thereby display an image.

In order to recognize the characteristics of the flat type electron-emitting device manufactured in the above steps, at the same time, a sample of a standard electron-emitting device having the same dimensions, i.e., L, W, and W', as those of the flat type electron-emitting device shown in FIGS. 1A and 1B was manufactured, and the electron-emitting characteristics of this sample was measured by using the measurement evaluation apparatus in FIG. 4.

Note that, as the measurement conditions of the sample, the distance between an anode and the electron-emitting device was set to be 4 mm, the potential of the anode was set to be 1 kV, and the degree of vacuum in a vacuum apparatus in measurement of the electron-emitting characteristics was set to be $1\times10^{-6}$ torr.

When a device voltage was applied across the electrodes 2 and 3 to measure a device current If and an emission current Ie flowing at this time, current-voltage characteristics shown in FIG. 5 were obtained.

In the device obtained in this example, the emission current Ie begun to sharply increase from a device voltage of about 8 V, the device current If and the emission current Ie respectively became 2.0 mA and 1.1 $\mu$A at the device voltage of 16 V, and electron-emitting efficiency $\eta$=Ie/If (%) was 0.05%.

EXAMPLES 19 TO 29

Palladium complexes described in Table 1 were synthesized by palladium acetate and amino alcohols in the same manner as in Example 14. These palladium complexes were confirmed as target materials by CHN element analysis and an ICP metal analysis. Temperatures at which thermal decomposition was ended and solubilities in water are described in Table 1. The electron-emitting efficiencies of electron-emitting devices manufactured in the same manner as in FIG. 16 are also described in Table 1.

EXAMPLE 30

An electron-emitting device forming complex, i.e., nickel formate-tris(ethanolamine)-2-hydrate (to be referred to as NFME hereinafter), was synthesized as follows.

10 g of nickel formate 2-hydrate was added to 9.92 g of ethanolamine, and the resultant solution was sufficiently stirred at room temperature to be a blue transparent solution containing no insoluble matter, thereby obtaining NFME. As a result of TG measurement in the air, a temperature at which decomposition of NFME was ended was 403° C.

EXAMPLE 31

An electron-emitting device forming complex, i.e., nickel acetate-bis(3-amino-propanol) (to be referred to as NAMP hereinafter), was synthesized as follows.

20 ml of isopropanol (IPA) was added to 1.0 g of nickel acetate 4-hydrate and 1.21 g of 3-amino-propanol, and the resultant solution was stirred at room temperature for five hours. Upon completion of reaction, the reacted mixture was filtered, and the filtered solution was distilled off in a reduced-pressure state. When the residue was added with acetone/hexane and stirred, a solution having high viscosity was precipitated on the flask wall. When acetone/hexane was removed by decantation, and the solution was added with acetone and stirred, the solution was crystallized. This crystal was filtered out, and the obtained crystal was added with acetone and sufficiently stirred. The resultant solution was filtered to filter a crystal out. This treatment was repeated, and the resultant crystal was sufficiently washed with acetone, thereby obtaining NAMP. As a result of TG measurement in the air, a temperature at which decomposition of NAMP was ended was 393° C.

EXAMPLE 32

An electron-emitting device forming complex, i.e., nickel acetate-bis(1-amino-2-propanol) (to be referred to as NAMiP hereinafter), was synthesized as follows.

20 ml of IPA was added to 1.0 g of nickel acetate 4-hydrate and 0.91 g of 1-amino-2-propanol, and the resultant solution was stirred at room temperature for five hours. Upon completion of reaction, the same after treatment as in Example 31. The resultant crystal was sufficiently washed with acetone, thereby obtaining NAMiP. As a result of TG measurement in the air, a temperature at which decomposition of NAMiP was ended was 406° C.

EXAMPLE 33

An electron-emitting device forming complex, i.e., nickel acetate-bis(N-methylethanolamine) (to be referred to as NANME hereinafter), was synthesized as follows.

20 ml of IPA was added to 1.0 g of nickel acetate 4-hydrate and 1.21 g of N-methylethanolamine, and the resultant solution was stirred at room temperature for five hours. Upon completion of reaction, the reacted mixture was filtered, and the filtered solution was distilled off in a reduced-pressure state. The residue was washed with diethylether, and a crystal was filtered out. The crystal was added with diethylether, and the resultant solution was sufficiently stirred. The resultant solution was filtered to filter a crystal out. This treatment was repeated, and the resultant crystal was sufficiently washed with diethylether, thereby obtaining NANME. As a result of TG measurement in the air, a temperature at which decomposition of NANME was ended was 379° C.

EXAMPLE 34

An electron-emitting device forming complex, i.e., nickel acetate-bis(N-butylethanolamine) (to be referred to as NABE hereinafter), was synthesized as follows.

20 ml of IPA was added to 1.0 g of nickel acetate 4-hydrate and 1.89 g of N-butylethanolamine, and the resultant solution was stirred at room temperature for five hours. Upon completion of reaction, the same after treatment as in Example 33. The resultant crystal was sufficiently washed with diethylether, thereby obtaining NABE. As a result of TG measurement in the air, a temperature at which decomposition of NABE was ended was 395° C.

EXAMPLE 35

An electron-emitting device of a type shown in FIGS. 1A and 1B was manufactured as an electron-emitting device according to this example. FIG. 1A is a plan view, and FIG. 1B is a sectional view. Referring to FIGS. 1A and 1B, reference numeral 1 denotes an insulating substrate; 2 and 3, device electrodes for applying a voltage to the device; 4, a thin film including an electron-emitting region; and 5, an electron-emitting region. Note that, in FIG. 1A, a reference symbol L denotes an interval between the device electrodes 2 and 3; W, a width of each device electrode; d, the thickness of each device electrode; and W', the width of the device.

A method of manufacturing an electron-emitting device according to this example will be described below with reference to FIGS. 1A and 1B and FIGS. 2A to 2E.

A quartz substrate was used as the insulating substrate 1 and sufficiently washed with an organic solvent, and the device electrodes 2 and 3 consisting of platinum were formed on the surface of the insulating substrate 1 (FIGS. 2A and 2B). At this time, the inter-device-electrode interval L was set to be 10 μm, the width W of each device electrode was set to be 500 μm, and the thickness d of each device electrode was set to be 1,000 Å. A Cr film having a thickness of 1,000 Å was formed outside a rectangular region having a width W of 320 μm and a length of 160 μm with the gap portion of the device electrodes 2 and 3 in the center.

Water was added to 2.83 g of NFME, 0.05 g of 86% saponified poly(vinyl alcohol) (average degree of polymerization of 500), 25 g of isopropyl alcohol, and 1.0 g of ethylene glycol to prepare a nickel compound solution having a total weight of 100 g.

This nickel compound solution was spin-coated at 1,000 rpm for 60 seconds to form a film on the insulating substrate 1 on which said device electrodes 2 and 3 were formed. When the resultant structure was heated at 350° C. in an oven of in the atmosphere for 15 minutes to decompose and deposit the metal compound on the substrate, a fine particle film constituted by nickel oxide fine particles. The nickel oxide fine particle film formed on the Cr film and the Cr film were removed by an acid etchant, the remaining nickel oxide fine particle film having a rectangular shape was annealed in an air flow of 98 vol % nitrogen and 2 vol % hydrogen at 400° C. for one hour to be reduced, thereby forming the electron-emitting region forming thin film 4.

As shown in FIG. 2E, the electron-emitting region 5 was formed in such a manner that a voltage was applied across the device electrodes 2 and 3 to perform energization forming to the electron-emitting region forming thin film 4. The voltage waveform in the forming treatment is shown in FIG. 3A.

Referring to FIG. 3A, reference symbols T1 and T2 denote the pulse width and pulse interval of the voltage waveform, respectively. In this example, T1 was set to be 1 ms; T2, 10 ms; and the peak value (peak voltage in forming treatment) of a chopping wave, 5 V. The forming treatment was performed for 60 seconds in a vacuum atmosphere of about $1\times10^{-6}$ torr. Then the same steps subsequent to energization forming were performed as in Example 1.

The electron-emitting characteristics of the device manufactured as described above were measured in the same manner as in Example 1.

The measurement evaluation apparatus described above was used, and a device voltage was applied across the electrodes 2 and 3 of the electron-emitting device. When a device current If and an emission current Ie flowing at this time were measured, current-voltage characteristics shown in FIG. 5 were obtained. In this device, the emission current Ie begun to sharply increase from a device voltage of about 8 V, the device current If and the emission current Ie respectively became 2.6 mA and 1.0 μA at the device voltage of 16 V, and electron-emitting efficiency $\eta$=Ie/If (%) was 0.038%.

In place of an anode 44, a face plate having a fluorescent film and a metal back was arranged in the vacuum apparatus. When electron emission of the electron source was tried, the fluorescent film partially emitted, and the intensity of the emission changed depending on the emission current Ie. In this manner, it was understood that this device functioned as a light-emitting display device.

In the example described above, when the electron-emitting region is to be formed, a chopping-wave pulse is applied across the device electrodes to perform forming treatment. However, the waveform applied across the device electrodes is not limited to the chopping wave, and a desired waveform such as a rectangular wave may be used. The peak value, pulse width, pulse intervals, and the like of the wave are not limited to the above values. If the electron-emitting region is preferably formed, the desirable values can be selected.

EXAMPLES 36 TO 56

Aqueous nickel carboxylate complex solutions having concentrations described in Table 2 were prepared, these solutions were used in place of an aqueous nickel complex in Example 35, and the same treatment as in Example 35 was performed to form electron-emitting devices. Any solutions could be easily coated on a substrate surface. After the devices were formed, an electron-emitting phenomenon was detected at device voltages 14 to 18 V.

EXAMPLE 57

A quartz substrate was used as the insulating substrate 1 and sufficiently washed with an organic solvent, and device electrodes 2 and 3 consisting of Pt were formed on the surface of the insulating substrate 1. At this time, an inter-device-electrode interval L was set to be 20 μm, a width W of each device electrode was set to be 500 μm, and a thickness d of each device electrode was set to be 1,000 Å.

Water was added to 3.86 g of NANME, 0.05 g of 86% saponified poly(vinyl alcohol) (average degree of polymerization of 500), 25 g of isopropyl alcohol, and 1.0 g of ethylene glycol to prepare a nickel compound solution having a total weight of 100 g. This aqueous Ni complex solution was filtered with a membrane filter and filled in a bubble jet head BC-01 available from CANON INC., and an external DC voltage of 20 V was applied to the heater in the head for 7 μs, thereby ejecting the aqueous Ni complex solution to the gap portion between the device electrodes 2 and 3 of the quartz substrate. The ejecting was repeated five times while keeping the positions of the head and the substrate. Each liquid droplet had an almost circular shape having a diameter of about 110 μm (FIG. 2C).

When this substrate was heated at 350° C. for 15 minutes to thermally decompose the Ni compound, nickel oxide was generated. This nickel oxide was subjected to annealing at 400° C. for 1 hour in a nitrogen current containing 2 vol % of hydrogen to be reduced, thereby forming an electron-emitting region forming thin film.

Predetermined energization forming and activation were performed in the same manner as in Example 35 to evaluate the device as an electron-emitting device. Electron-emitting efficiency at a device voltage of 16 V was 0.039%.

EXAMPLES 58 TO 71

Aqueous nickel carboxylate complex solutions having concentrations described in Table 3 were prepared, these solutions were used in place of an aqueous nickel complex in Example 57, and the same treatment as in Example 57 was performed to form electron-emitting devices. An electron-emitting phenomenon was detected at a device voltage 16 V.

Next, synthesis of an organometallic compound which contains an organic acid group, a transition metal, and alcohol amine according to formula 2 described above, is easily dissolved in water, and can be thermally decomposed at a relatively low temperature, an electron-emitting device manufacturing liquid according to the present invention obtained by dissolving the compound in water, and a method of manufacturing an electron-emitting device or an image-forming apparatus using the electron-emitting device manufacturing liquid will be described below.

EXAMPLE 72

A palladium acetate-(2-amino-2-methyl-1,3-propanediol) complex was synthesized as follows.

While stirring 25 ml of isopropyl alcohol added with 0.5 g of palladium acetate, 1.0 g of 2-amino-2-methyl-1,3-propanediol was added to the solution, and the resultant solution was stirred at room temperature for four hours. Upon completion of reaction, the reacted mixture was filtered, and the filtered solution was distilled off in a reduced-pressure state. The residue was added with acetone and crystallized to filter a crystal out. The crystal was added with acetone, and the resultant solution was sufficiently stirred to filter a crystal out again. This treatment was repeated five times, and the resultant crystal was sufficiently washed with acetone and dried in a vacuum state, thereby obtaining a palladium acetate-(2-amino-2-methyl-1,3-propanediol) complex. As a result of TG measurement in the air, a temperature at which decomposition of the palladium acetate-(2-amino-2-methyl-1,3-propanediol) complex was ended was 159 to 240° C.

EXAMPLE 73

A palladium acetate-(trishydroxymethylaminomethane) complex was synthesized as follows.

While stirring 25 ml of isopropyl alcohol added with 0.5 g of palladium acetate, 1.11 g of trishydroxymethylaminomethane was added to the solution, and the resultant solution was stirred at room temperature for four hours. Upon completion of reaction, an insoluble matter was filtered out. The crystal was added with acetone and sufficiently stirred to be filtered out. In addition, the crystal was added with acetone and sufficiently stirred again to be filtered out. This treatment was repeated five times, and the resultant crystal was sufficiently washed with acetone and dried in a vacuum state, thereby obtaining a palladium acetate-(trishydroxymethylaminomethane) complex. As a result of TG measurement in the air, a temperature at which decomposition of the palladium acetate-(trishydroxymethylaminomethane) complex was ended was 159 to 296° C.

EXAMPLE 74

A palladium acetate-(2-amino-2-methyl-1-propanol) complex was synthesized as follows.

While stirring 25 ml of isopropyl alcohol added with 0.5 g of palladium acetate, 0.9 g of 2-amino-2-methyl-1-propanol was added to the solution, and the resultant solution was stirred at room temperature for four hours. Upon completion of reaction, the reacted mixture was filtered, and the filtered solution was distilled off in a reduced-pressure state. The residue was added with acetone and crystallized to filter a crystal out. The crystal was added with acetone, and the resultant solution was sufficiently stirred to filter a crystal out again. This treatment was repeated five times, and the resultant crystal was sufficiently washed with acetone and dried in a vacuum state, thereby obtaining a palladium acetate-(2-amino-2-methyl-1-propanol) complex. As a result of TG measurement in the air, a temperature at which decomposition of the palladium acetate-(2-amino-2-methyl-1-propanol) complex was ended was 171 to 222° C.

EXAMPLE 75

A method of manufacturing an electron-emitting device according to this example will be described below with reference to FIGS. 2A to 2E.

A quartz substrate was used as the insulating substrate 1 and sufficiently washed with an organic solvent, and the device electrodes 2 and 3 consisting of platinum were formed on the surface of the insulating substrate 1 (FIGS. 2A and 2B). At this time, an inter-device-electrode interval L was set to be 10 μm, a width W of each device electrode was set to be 500 μm, and a thickness d of each device electrode was set to be 1,000 Å.

Water was added to 1.0 g of a palladium acetate-(2-amino-2-methyl-1,3-propanediol) complex, 0.05 g of 80% saponified poly(vinyl alcohol) (average degree of polymerization of 450), 25 g of ethyl alcohol, and 1.0 g of ethylene glycol to prepare a palladium compound solution having a total weight of 100 g. This palladium compound solution was filtered with a membrane filter having a pore size of 0.25 μm and filled in a bubble jet printer head BC-01 available from CANON INC., and an external DC voltage of 20 V was applied to the heater in the head for 7 μs, thereby ejecting the palladium compound solution to the gap portion between the device electrodes 2 and 3 of the quartz substrate. The ejecting was repeated five times while keeping the positions of the head and the substrate. Each liquid droplet had an almost circular shape having a diameter of about 100 μm (FIG. 2C).

When this substrate was heated at 350° C. for 12 minutes to thermally decompose the palladium compound, a uniform palladium oxide film was formed without precipitating crystal (FIG. 2D). The electric resistance between the device electrodes 2 and 3 became 11 kΩ.

As shown in FIG. 2E, the electron-emitting region 5 was formed in such a manner that a voltage was applied across the device electrodes 2 and 3 to perform steps subsequent to energization forming to the electroconductive film 4. The steps subsequent to the forming treatment are the same as those in Example 1.

The electron-emitting characteristics of the device manufactured as described above were measured in the same manner as in Example 1.

When a device voltage was applied across the electrodes 2 and 3 of the electron-emitting device, and a device current If and an emission current Ie flowing at this time were measured, current-voltage characteristics shown in FIG. 5 were obtained. In this device, the emission current Ie begun to sharply increase from a device voltage of about 7.4 V, the device current If and the emission current Ie respectively became 2.4 mA and 1.0 μA at the device voltage of 16 V, and electron-emitting efficiency $\eta = Ie/If$ (%) was 0.042%.

In place of an anode 44, a face plate having the fluorescent film and metal back described above was arranged in the vacuum apparatus. When electron emission of the electron source was tried, the fluorescent film partially emitted, and the intensity of the emission changed depending on the emission current Ie. In this manner, it was understood that this device functioned as a light-emitting display device.

Supplemental Example 5

A metal compound solution was prepared under the same conditions as those in Example 75 except that a palladium acetate alanine complex was used in place of a palladium acetate-(2-amino-2-methyl-1,3-propanediol) complex. This metal compound solution was ejected onto a device electrode substrate by using a bubble jet printer head. When this substrate was annealed in the same manner as in Example 1, it was observed with an optical microscope that a large number of needle crystals were nonuniformly dispersed in the electroconductive film. Therefore, this device was improper as an electron-emitting device.

EXAMPLE 76

A quartz substrate was used as an insulating substrate 1 and sufficiently washed with an organic solvent, and device electrodes 2 and 3 consisting of Pt were formed on the surface of the insulating substrate 1. An inter-device-electrode interval L was set to be 20 μm, a width W of each device electrode was set to be 500 μm, and a thickness d of each device electrode was set to be 1,000 Å.

Water was added to 1.2 g of a palladium acetate-(trishydroxymethylaminomethane) complex, 0.05 g of 86% saponified poly(vinyl alcohol) (average degree of polymerization of 500), 25 g of isopropyl alcohol, and 0.8 g of diethylene glycol to prepare a palladium compound solution having a total weight of 100 g. The same treatment as in Example 75 was performed by using this palladium compound solution to form an electron-emitting device. After the baking step in which this device was heated at 350° C. for 12 minutes, the device was observed with an optical microscope. As a result, a uniform palladium oxide film was formed without precipitating crystal. When the electron-emitting device was estimated as an electron-emitting device, electron-emitting efficiency at a device voltage of 16 V was 0.054%.

Supplemental Example 7

A metal compound solution was prepared under the same conditions as those in Example 75 except that a tetramonoethanolamine complex was used in place of a palladium acetate-(2-amino-2-methyl-1,3-propanediol) complex. This metal compound solution was ejected onto a device electrode substrate by using a bubble jet printer head. When this substrate was annealed in the same manner as in Example 1, it was observed with an electron microscope that small aggregates were nonuniformly dispersed in the electroconductive film. When energization forming was performed to this electroconductive film to manufacture an electron-emitting device, and the emission current from the electron-emitting device was examined. As a result, the emission current was small, and this device was to be improved as an electron-emitting device.

EXAMPLE 77

By using a bubble jet type ink jet apparatus, the liquid droplet of an organometallic compound solution was applied to the counter electrodes on a substrate (FIG. 6), on which 16×16, i.e., 256, device electrodes and a matrix wire were formed, in the same manner as in Example 75. The substrate was baked, and steps subsequent to forming treatment was performed, thereby obtaining an electron source substrate.

A rear plate 71, a support frame 72, and a face plate 76 were connected to the electron source substrate, and the resultant structure was sealed in a vacuum state, thereby an image-forming apparatus according to the concept view in FIG. 7. A predetermined voltage was applied to the devices through terminals Dox1 to Dox16 and terminals Doy1 to Doy16 in a time-division manner, and a high voltage was applied to the metal back through an terminal Hv, so that an arbitrary image pattern could be displayed.

As described above, it was shown that, as an organometallic compound containing an organic acid group, a metal, and alcohol amine according to formula 1 or 2 described above, a liquid which could be thermally decomposed at a relatively low temperature, was easily dissolved in water, and contained a metal content which was sufficient to manufacture an electron-emitting device could be used. In addition, when the liquid was dried and baked, crystal generation was suppressed. Therefore, it was shown that a uniform baked film was formed.

An electron-emitting device manufacturing liquid according to the present invention which contains an organometallic complex and alcohol amine according to formula 2 described above, and an electron-emitting device and an image-forming apparatus which are formed by using the electron-emitting device manufacturing liquid will be described below.

EXAMPLE 78

A method of manufacturing an electron-emitting device according to this example will be described below with reference to FIGS. 2A to 2E.

A quartz substrate was used as the insulating substrate 1 and sufficiently washed with an organic solvent, and the device electrodes 2 and 3 consisting of platinum were formed on the surface of the insulating substrate 1 (FIGS. 2A and 2B). At this time, an inter-device-electrode interval L was set to be 10 μm, a width W of each device electrode was set to be 500 μm, and a thickness d of each device electrode was set to be 1,000 Å.

Figure 14A:
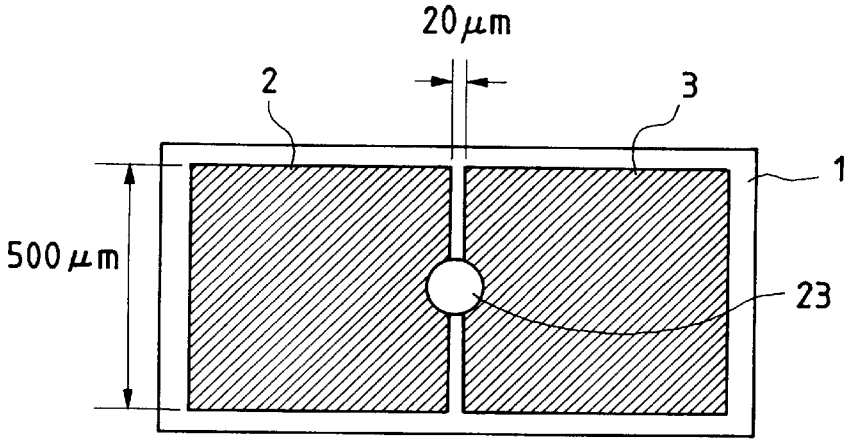
FIGS. 14A through 14C are schematic illustrations of a patterning operation by ejecting liquid drops.

Water was added to 1.0 g of tetramonoethanolamine palladium acetate ($Pd(H_2NC_2H_4OH)_4(CH_3COO)_2$), 0.05 g of 80% saponified poly(vinyl alcohol) (average degree of polymerization of 450), 25 g of ethyl alcohol, and 1.0 g of aminomethylpropanediol to prepare a palladium compound solution having a total weight of 100 g. This palladium compound solution was filtered with a membrane filter having a pore size of 0.25 μm and filled in a bubble jet printer head BC-01 available from CANON INC., and an external DC voltage of 20 V was applied to the heater in the head for 7 μs, thereby ejecting the palladium compound solution to the gap portion between the device electrodes 2 and 3 of the quartz substrate. The ejecting was repeated five times while keeping the positions of the head and the substrate. Each liquid droplet had an almost circular shape having a diameter of about 110 μm (FIG. 14A).

When this substrate was air-dried for two hours and heated at 350° C. for 12 minutes to thermally decompose the palladium compound, a uniform palladium oxide film was formed without precipitating crystal. The electric resistance between the device electrodes 2 and 3 became 11 kΩ.

As shown in FIG. 2D, an electron-emitting region 5 was formed in such a manner that a voltage was applied across the device electrodes 2 and 3 to perform steps subsequent to energization forming to an electroconductive film 4 in the same manner as in Example 1.

The electron-emitting characteristics of the device manufactured as described above were measured in the same manner as in Example 1.

When a device voltage was applied across the electrodes 2 and 3 of the electron-emitting device, and a device current If and an emission current Ie flowing at this time were measured, current-voltage characteristics shown in FIG. 5 were obtained. In this device, the emission current Ie begun to sharply increase from a device voltage of about 7.4 V, the device current If and the emission current Ie respectively became 2.4 mA and 1.0 μA at the device voltage of 16 V, and electron-emitting efficiency $\eta$=Ie/If (%) was 0.042%.

In place of an anode 44, a face plate having the fluorescent film and metal back described above was arranged in the vacuum apparatus. When electron emission of the electron source was tried, the fluorescent film partially emitted, and the intensity of the emission changed depending on the emission current Ie. In this manner, it was understood that this device functioned as a light-emitting display device.

Supplemental Example 8

A metal compound solution was prepared under the same conditions as those in Example 78 except that aminomethylpropanediol was not used. This metal compound solution was ejected onto a device electrode substrate by using a bubble jet printer head. When this substrate was annealed in the same manner as in Example 1, it was observed with an optical microscope that a large number of needle crystals were precipitated and nonuniformly dispersed in the electroconductive film. Therefore, this device was improper as an electron-emitting device.

EXAMPLE 79

A quartz substrate was used as the insulating substrate 1 and sufficiently washed with an organic solvent, and the device electrodes 2 and 3 consisting of Pt were formed on the surface of the insulating substrate 1. An inter-device-electrode interval L was set to be 20 $\mu$m, a width W of each device electrode was set to be 500 $\mu$m, and a thickness d of each device electrode was set to be 1,000 Å.

Water was added to 0.6 g of tetramonoethanolamine palladium acetate ($Pd(H_2NC_2H_4OH)_4(CH_3COO)_2$), 0.05 g of 86% saponified poly(vinyl alcohol) (average degree of polymerization of 500), 25 g of isopropyl alcohol, 1 g of ethylene glycol, and 0.1 g of trishydroxymethylaminomethane to prepare a palladium compound solution having a total weight of 100 g. The same treatment as in Example 78 was performed by using this palladium compound solution to form an electron-emitting device. After the formation of the device, the device was evaporated as an electron-emitting device, electron-emitting efficiency at a device voltage of 16 V was 0.054%.

Supplemental Example 9

A metal compound solution was prepared under the same conditions as those in Example 79 except that trishydroxymethylaminomethane was not used. This metal compound solution was ejected onto a device electrode substrate by using a bubble jet printer head. When this substrate was annealed in the same manner as in Example 79, as in Supplemental example 8, a large number of large needle crystals were precipitated in the electroconductive film. Therefore, this device was improper as an electron-emitting device.

EXAMPLES 80 TO 82

Palladium compound solutions having compositions according to Table 4 were prepared, these solutions were used in place of the palladium complex solution in Example 78, and the same treatment as in Example 78 was performed to form electron-emitting devices. After formation of these devices, an electron-emitting phenomenon was detected at device voltages 14 to 18 V.

Supplemental Examples 10 to 12

Metal compound solutions according to Supplemental examples 10 to 12 were prepared under the same conditions as those of the examples in Table 1 except that amino alcohol was not used. When each metal compound solution was ejected by using a bubble jet printer head in the same manner as in Example 78, and annealing was performed, it was observed with an optical microscope that a large number of needle crystals were precipitated and nonuniformly dispersed in an electroconductive film. Therefore, this device was improper as an electron-emitting device.

Supplemental Example 13

A metal compound solution was prepared in the same manner as in Example 79 except that the content of trishydroxymethylaminomethane was set to be 0.005 g. This metal compound solution was ejected onto a device electrode substrate by using a bubble jet printer head. When this substrate was annealed in the same manner as in Example 79, as in Supplemental example 8, a large number of large needle crystals were precipitated in the electroconductive film. Therefore, this device was improper as an electron-emitting device.

Supplemental Example 14

A metal compound solution was prepared in the same manner as in Example 78 except that trishydroxymethylethane was used in place of aminomethylpropanediol. This metal compound solution was ejected onto a device electrode substrate by using a bubble jet printer head. When this substrate was annealed in the same manner as in Example 78, it was observed with an optical microscope that a large number of large needle crystals were precipitated in the electroconductive film. Therefore, this device was improper as an electron-emitting device.

Supplemental Example 15

A metal compound solution was prepared in the same manner as in Example 78 except that glucose was used in place of aminomethylpropanediol. This metal compound solution was ejected onto a device electrode substrate by using a bubble jet printer head. When this substrate was annealed in the same manner as in Example 78, no needle crystals were precipitated in the electroconductive film, but the electroconductive film was made nonuniform. Therefore, this device was improper as an electron-emitting device.

Supplemental Example 16

A metal compound solution was prepared under the same conditions as those in Example 78 except that monoethanolamine was used in place of aminomethylpropanediol. This metal compound solution was ejected onto a device electrode substrate by using a bubble jet printer head. When this substrate was annealed in the same manner as in Example 78, it was observed with an electron microscope that small aggregates were nonuniformly dispersed in the electroconductive film. When energization forming was performed to this electroconductive film to manufacture an electron-emitting device, and the emission current from the electron-emitting device was examined. As a result, the emission current was small, and this device was to be improved as an electron-emitting device.

Supplemental Example 17

A metal compound solution was prepared under the same conditions as those in Example 78 except that urea was used in place of aminomethylpropanediol. When this metal compound solution was ejected onto a device electrode substrate by using a bubble jet printer head, ejecting properties were unstable, an ejection amount considerably varied, or a ejecting direction was shifted. Therefore, a preferable electroconductive film could not be formed.

EXAMPLE 83

By using a bubble jet type ink jet apparatus, the liquid droplet of an organometallic compound solution was applied to the counter electrodes on a substrate (FIG. 6), on which 16×16, i.e., 256, device electrodes and a matrix wire were formed, in the same manner as in Example 78. The substrate was baked and subjected to forming treatment, thereby obtaining an electron source substrate.

A rear plate 71, a support frame 72, and a face plate 76 were connected to the electron source substrate, and the resultant structure was sealed in a vacuum state, thereby an image-forming apparatus according to the concept view in FIG. 7. A predetermined voltage was applied to the devices through terminals Dox1 to Dox16 and terminals Doy1 to Doy16 in a time-division manner, and a high voltage was applied to the metal back through an terminal Hv, so that an arbitrary image pattern could be displayed.

As is apparent from the above examples, when the electron-emitting device manufacturing liquid prepared by using the alcohol amine according to formula 2 described above and the organometallic complex is applied to a substrate and left and air-dried for a long time, and then baked, suppression of crystal generation is improved.

This may be because some ligands are substituted for the added alcohol amine according formula 2 to set a state where organometallic complexes of a plurality of types are present at once. Many complexes each having the alcohol amine according to formula 2 as a ligand have high hygroscopicity. For this reason, even if the solution is air-dried, crystal may not be easily generated. A regular arrangement of complex molecules in the state where organometallic complexes of a plurality of types are present at once by substituting some ligands may be hardly obtained compared with a regular arrangement of complex molecules in a state wherein only a complex of a single type is present. Therefore, it is supposed that generation of large crystals is suppressed.

Next, a metal-containing liquid, which is improved by being added with a water soluble resin to suppress permeation to a printed electrode, for manufacturing an electron-emitting device according to the present invention, and an electron-emitting device and an image-forming apparatus which are manufactured by using this metal-containing liquid will be described below.

EXAMPLE 84

A method of manufacturing an electron-emitting device according to this example will be described below with reference to FIGS. 2A to 2E.

A quartz substrate was used as an insulating substrate 1, and the insulating substrate 1 was sufficiently washed with an organic solvent and distilled water and dried with hot air at 200° C. Device electrodes 2 and 3 were formed on the surface of the substrate 1 by offset printing. In this example, as an ink, an Au resinated paste consisting of an organic metal was used. When the ink on the glass substrate was dried at about 70° C. and baked at about 580° C., the ink could be used as a device electrode consisting of Au. The thickness of the Au electrode after baking could be small, i.e., about 1,000 Å. In this case, as the pattern shape of the device electrode, the dimension of an inter-device-electrode portion on which an electron-emitting member was arranged was set to be about 30 microns.

0.84 g of palladium acetate-monoethanolamine was dissolved in 12 g of water, and the solution was added with poly(vinyl alcohol) to adjust its solution viscosity to 20 CP (centipoise), thereby prepare an aqueous solution for BJ application. The PA-ME was synthesized as follows.

10 g of palladium acetate was suspended in 200 $cm^3$ of IPA, 16.6 g of monoethanolamine was added to the suspended solution, and the resultant solution was stirred at room temperature for four hours. Upon completion of reaction, IPA was removed by evaporation, the resultant solid matter was dissolved in ethanol and filtered, and PA-ME was obtained from the filtered solution by re-crystallization.

As a result of scanning type differential thermal analysis in the air, the decomposition temperature of PA-ME was 272° C. As poly(vinyl alcohol), poly(vinyl alcohol) having a degree of saponification of 98% was used.

The aqueous PA-ME solution was applied the portion between the device electrodes 2 and 3 by using a BJ type ink jet apparatus (BJ-10V available from CANON INC.) (FIG. 2C) and dried. When a liquid droplet was applied to a plurality of devices, the liquid droplet applied to the electrodes did not permeate the electrodes, and the liquid droplet could be applied with good reproducibility.

The resultant structure was heated at 300° C. in an oven of in the atmosphere to decompose and deposit the PA-ME and PVA on the substrate, thereby forming a fine particle film constituted by palladium oxide fine particles (average particle size: 65 Å) as an electron-emitting region forming thin film 4 (FIG. 2D). It was confirmed by X-ray diffraction that the film 4 consisted of palladium oxide. In this case, a width W' of the electron-emitting region forming thin film 4 was set to be 300 $\mu$m, and the electron-emitting region forming thin film 4 was arranged at an almost central portion between the device electrodes 2 and 3. The thickness of the electron-emitting region forming thin film 4 was 100 Å, and the sheet resistance of the electron-emitting device forming thin film 4 was $5\times10^4\Omega/\square$.

Note that the fine particle film described here is a film obtained by assembling a plurality of fine particles. Its fine structure means not only a film in which respective fine particles are dispersed and arranged, but also a film in which fine particles are adjacent to each other or overlap (including an island-like state). The particle size means the diameter of a fine particle whose particle shape can be recognized in the above state.

As shown in FIG. 2E, an electron-emitting region 5 was formed in such a manner that a voltage was applied across the device electrodes 2 and 3 to perform energization forming to the electron-emitting region forming thin film 4. The voltage waveform in the forming treatment is shown in FIG. 3A.

Referring to FIG. 3A, reference symbols T1 and T2 denote the pulse width and pulse interval of the voltage waveform, respectively. In this example, T1 was set to be 1 ms; T2, 10 ms; and the peak value (peak voltage in forming treatment) of a chopping wave, 5 V. The forming treatment was performed for 60 seconds in a vacuum atmosphere of about $1\times10^{-6}$ torr.

In addition, palladium oxide was reduced by reduction treatment into metal palladium.

The electron-emitting region 5 formed as described above had a state wherein fine particles containing palladium element as a main component were dispersed and arranged. The average particle size of the fine particles was 28 Å.

The electron-emitting characteristics of the electron-emitting device manufactured as described above were measured by the apparatus in FIG. 4 in the same manner as in Example 1.

When device voltage was applied across the electrodes 2 and 3 of the electron-emitting device to measure a device current If and an emission current Ie flowing at this time, current-voltage characteristics shown in FIG. 5 were obtained. In the device in this example, the emission current Ie begun to sharply increase from a device voltage of about 8 V, the device current If and the emission current Ie respectively became 1.6 mA and 0.8 $\mu$A at the device voltage of 16 V, and electron-emitting efficiency $\eta$=Ie/If (%) was 0.05%.

EXAMPLE 85

Offset printing was performed by a resinated paste ink on a substrate constituted by a well-cleaned soda lime glass plate, and the ink was baked to pattern-form an Au device electrode having a thickness of 1,000 Å.

1.07 g of palladium acetate-diethanolamine was dissolved in 12 g of water, and the solution was added with methylcellulose to adjust its solution viscosity to 20 CP (centipoise), thereby prepare an aqueous solution for BJ application. The liquid droplet applied onto the substrate did not permeate the electrode. Therefore, a liquid droplet having reproducibility in shape and quantity could be applied to the electrode portion. Thereafter, an electron-emitting device was manufactured in the same electron-emitting device manufacturing method as that in Example 84.

In this device, an emission current Ie begun to sharply increase from a device voltage of about 7.9 V, the device current If and the emission current Ie respectively became 1.6 mA and 0.8 $\mu$A at the device voltage of 16 V, and electron-emitting efficiency $\eta$=Ie/If (%) was 0.052%.

EXAMPLE 86

FIG. 15 is a plan view showing a part of the electron source, and FIG. 16 is a sectional view showing the electron source along a line 16—16 in FIG. 15. The same reference numerals as in FIGS. 15 and 16 denote the same parts in FIGS. 15 and 16. Referring to FIGS. 15 and 16, reference numeral 71 denotes an insulating substrate; 62, an X-direction wire (also called lower wire) corresponding to Dxm in FIG. 7; 63, an Y-direction wire (also called upper wire) corresponding to Dyn in FIG. 7; 4, an electroconductive film including an electron-emitting region; 2 and 3, device electrodes; 141, an insulating interlayer; 142, a contact hole for electrically connecting the device electrode 2 to the lower wire 62.

Step-a

Offset printing was performed by a resinated paste ink on a substrate constituted by a well-cleaned soda lime glass plate, and the ink was baked to pattern-form the Au device electrodes 2 and 3 each having a thickness of 1,000 Å. An Ag paste ink was screen-printed on the resultant structure and then baked to form the lower printed wire 62 having a width of 300 $\mu$m and a thickness of 7 $\mu$m.

Step-b

A glass paste ink was screen-printed on the resultant structure and then baked to form the insulating 141 having a width of 500 $\mu$m and a thickness of about 20 $\mu$m and the contact hole 142 having an opening size of 100 $\mu$m squares.

Step-c

An Ag paste ink was screen-printed on the insulating 141 and then baked to form the upper wire 63 having a width of 300 $\mu$m and a thickness of 10 $\mu$m.

Step-d

An aqueous solution, used in Example 84, for BJ application was applied to a portion between the device electrodes 2 and 3 by using a bubble jet type ink jet apparatus (BJ-10V available from CANON INC.), and the resultant structure was subjected to heating/baking treatment at 300° C. for 10 minutes. The electron-emitting region forming thin film 4 formed as described above was a thin film constituted by fine particles consisting of Pd as a main element, its film thickness was 100 Å, and its sheet resistance was $5\times10^4\Omega/\square$. Note that the fine particle film described here is a film obtained by assembling a plurality of fine particles. Its fine structure means not only a film in which respective fine particles are dispersed and arranged, but also a film in which fine particles are adjacent to each other or overlap (including an island-like state). The particle size means the diameter of a fine particle whose particle shape can be recognized in the above state.

With the above steps, the lower wire 62, the insulating interlayer 141, the upper wire 63, the device electrodes 2 and 3, the electroconductive film, and the like were formed on the insulating substrate 71.

A display apparatus constituted by using the electron source manufactured as described above will be described below with reference to FIGS. 7 to 8B.

A substrate 61 on which a large number of flat type electron-emitting devices were manufactured as described above was fixed on a rear plate 71, a face plate 76 (obtained by forming a fluorescent film 74 and a metal back 75 on the inner surface of a glass substrate 73) was arranged 5 mm above the substrate 61 through a support frame 72. Frit glass was applied to the joint portion of the face plate 76, the support frame 72, and the rear plate 71, and the resultant structure was baked in the air or a nitrogen atmosphere at 400° C. to 500° C. for 10 minutes or more to be sealed (FIG. 7). The substrate 61 was fixed to the rear plate 71 by frit glass.

Referring to FIG. 7, reference numeral 64 denotes an electron-emitting device; and 62 and 63, X- and Y-direction wires, respectively.

The fluorescent film 74 consisted of only a phosphor when a monochromatic display device was used. However, in this example, a phosphor having a stripe shape was employed. That is, black stripes were formed first, phosphors of respective colors were applied to the gap portions of the black stripes, thereby forming the fluorescent film 74. A material containing graphite as a main component ordinarily used as the material of the black stripes was used, and a slurry method was used as a method of applying the phosphor on the glass substrate 73.

The metal back 75 is ordinarily arranged on the inner surface side of the fluorescent film 74. The metal back was formed in such a manner that, after the fluorescent film was formed, smoothing treatment (generally called filming) of the inner surface of the fluorescent film 74, and Al was vacuum-evaporated on the surface.

In order to more improve conductivity of the fluorescent film 74, a transparent electrode (not shown) may be formed on the outer surface of the fluorescent film 74 in the face plate 76. However, in this example, since sufficient conductivity can be obtained by only the metal back, the transparent electrode is omitted.

In the above sealing, sufficient positional alignment was performed because the phosphors of respective colors had to correspond to electron-emitting devices in a color display panel.

The gas in the glass vessel completed as described above was exhausted by a vacuum pump through an exhaust pipe (not shown), and a sufficient degree of vacuum was obtained. Thereafter, a voltage was applied across the device electrodes 2 and 3 of the electron-emitting device 64 through out-of-vessel terminals (Dox1 to Doxm and Doy1 to Doyn), and energization forming was performed to the electron-emitting region forming thin film 4, thereby manufacturing the electron-emitting region 5. The voltage waveform of the forming treatment is shown in FIG. 3A.

Referring to FIG. 3A, reference symbols T1 and T2 denote the pulse width and pulse interval of the voltage waveform, respectively. In this example, T1 was set to be 1 ms; T2, 10 ms; and the peak value (peak voltage in forming treatment) of a chopping wave, 5 V. The forming treatment was performed for 60 seconds in a vacuum atmosphere of about $1\times10^{-6}$ torr.

Steps subsequent to forming were performed in the same manner as in Example 18 to form the electron-emitting region 5, thereby manufacturing the electron-emitting device 64.

In a degree of vacuum of $10^{-6}$ torr, the exhaust pipe (not shown) was heated by a gas burner to be welded, thereby sealing the envelope.

Finally, getter treatment was performed to keep the degree of vacuum after sealing. For this purpose, immediately before sealing, a getter located at a predetermined position (not shown) in the display panel was heated by a heating method such as a high-frequency heating method, and the evaporation film was formed and treated. As the getter, a getter containing Ba or the like as a main component was used.

In an image display apparatus according to the present invention completed as described above, a scanning signal and a modulation signal were applied to the electron-emitting devices by signal generation means (not shown) through the out-of-vessel terminals Dox1 to Doxm and Doy1 to Doyn to cause the electron-emitting devices to emit electrons. A voltage of several kV or more was applied to the metal back 75 through a high-voltage terminal Hv to accelerate the electron beam, and the electron beam was caused to collide with the fluorescent film 74 to excite the fluorescent film 74 and to cause the fluorescent film 74 to emit, thereby display an image.

Supplemental Example 18

Device electrodes 2 and 3 were formed on an insulating substrate by offset printing in the same manner as in Example 84.

Palladium acetate-monoethanolamine was dissolved in 12 g of water to prepare an aqueous solution for BJ application. This aqueous solution was applied to a portion between the device electrodes 2 and 3. When a liquid droplet was applied to a plurality of devices, the liquid droplet permeated electrodes in a small number of elements. Each of the small number of devices had a baked film which was thinner than that of an element having an electrode in which no liquid droplet permeated.

Next, a metal-containing liquid, for manufacturing an electron-emitting device according to the present invention, which contains partially esterified poly(vinyl alcohol) to improve the wettability of a substrate when a liquid droplet is applied to the substrate and to improve pattern formability of a liquid when the liquid is applied as a liquid droplet to the substrate by an ink jet means will be described below in detail.

EXAMPLE 87

An electron-emitting device of a type shown in FIGS. 1A and 1B was manufactured as an electron-emitting device according to this example. FIG. 1A is a plan view, and FIG. 1B is a sectional view. Referring to FIGS. 1A and 1B, reference numeral 1 denotes an insulating substrate; 2 and 3, device electrodes for applying a voltage to the device; 4, a thin film including an electron-emitting region; and 5, an electron-emitting region. Note that, in FIG. 1A, a reference symbol L denotes an interval between the device electrodes 2 and 3; W, a width of each device electrode; d, the thickness of each device electrode; and W', the width of the device.

A method of manufacturing an electron-emitting device according to this example will be described below with reference to FIGS. 2A to 2E.

Figure 12A:
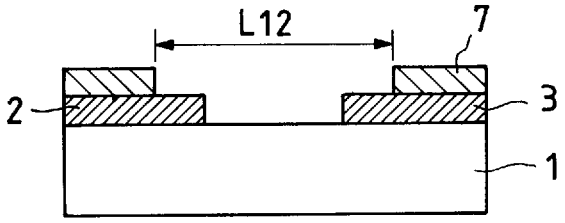
FIGS. 12A and 12B are schematic illustrations showing masks to be used for patterning a thin film.
Figure 12B:
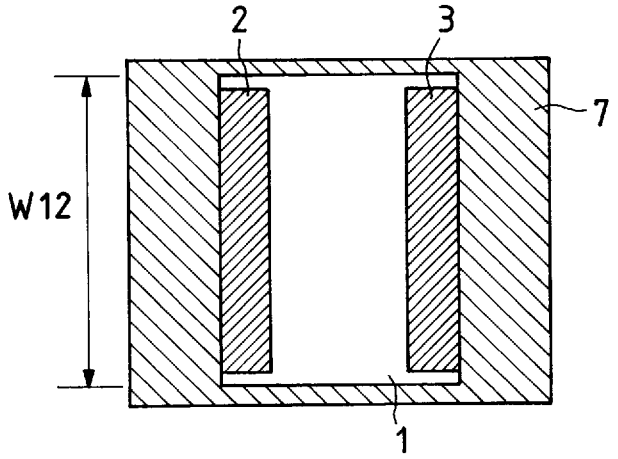

A quartz substrate was used as the insulating substrate 1 and sufficiently washed with an organic solvent, and the device electrodes 2 and 3 consisting of platinum were formed on the surface of the insulating substrate 1 (FIGS. 2A and 2B). At this time, the inter-device-electrode interval L was set to be 10 $\mu$m, the width W of each device electrode was set to be 500 $\mu$m, and the thickness d of each device electrode was set to be 1,000 Å. A Cr film having a thickness of 1,000 Å was formed outside a rectangular region having a width W of 320 $\mu$m and a length L12 of 160 $\mu$m with the gap portion of the device electrodes 2 and 3 (FIGS. 12A and 12B).

Water was added to 3.2 g of tetramonoethanolamine palladium acetate ($Pd(H_2NC_2H_4OH)_4(CH_3COO)_2$), 0.05 g of 86% saponified poly(vinyl alcohol) (average degree of polymerization of 500), and 25 g of isopropyl alcohol to prepare a palladium compound solution having a total weight of 100 g.

This palladium compound solution was spin-coated at 1,000 rpm for 60 seconds to form a film on the insulating substrate 1 on which said device electrodes 2 and 3 were formed. When the resultant structure was heated at 350° C. in an oven of in the atmosphere for 15 minutes to decompose and deposit the metal compound on the substrate, a fine particle film constituted by palladium oxide fine particles (in this example, average particle diameter: 85A). The palladium oxide fine particle film formed on the Cr film and the Cr film were removed by an acid etchant, and the remaining palladium oxide fine particle film having a rectangular shape was used as an electroconductive film 4 (FIG. 2D).

As shown in FIG. 2E, an electron-emitting region 5 was formed in such a manner that a voltage was applied across the device electrodes 2 and 3 to perform steps subsequent to energization forming to the electroconductive film 4. The following treatment is the same as in Example 1.

The electron-emitting characteristics of the device manufactured as described above were measured by the measurement evaluation apparatus in FIG. 4.

When device voltage was applied across the electrodes 2 and 3 of the electron-emitting device to measure a device current If and an emission current Ie flowing at this time, current-voltage characteristics shown in FIG. 5 were obtained. In this device, the emission current Ie begun to sharply increase from a device voltage of about 7.4 V, the device current If and the emission current Ie respectively became 2.4 mA and 1.0 $\mu$A at the device voltage of 16 V, and electron-emitting efficiency $\eta$=Ie/If (%) was 0.042%.

In place of an anode 44, a face plate having the fluorescent film and metal back described above was arranged in the vacuum apparatus. When electron emission of the electron source was tried, the fluorescent film partially emitted, and the intensity of the emission changed depending on the emission current Ie. In this manner, it was understood that this device functioned as a light-emitting display device.

EXAMPLES 88 TO 94

Aqueous palladium compound solutions having compositions according to Table 5 were prepared, these solutions were used in place of the palladium compound solution in Example 81, and the same treatment as in Example 81 was performed to form electron-emitting devices. Any solutions could be easily coated on a substrate surface. After the devices were formed, an electron-emitting phenomenon was detected at device voltages 14 to 18 V.

Supplemental Examples 18 to 23

Metal compound solutions having compositions according to Table 6 were prepared, coating on the same substrate as that used in Example 87 was tried by using these solutions in place of the palladium compound solution in Example 87. The test was performed under spin coating conditions which were set within the range of 400 to 2,000 rpm and the range of 20 to 300 seconds. In any case, a preferable coating could not be obtained. When each coating was observed with a microscope, a film was not stably formed on the metal electrode, and the coating on the metal electrode side tended to be lost near the boundary between the metal electrode and the quartz substrate. Therefore, the film was improper to formation of an electron-emitting device.

EXAMPLES 95 TO 99

Figure 13:
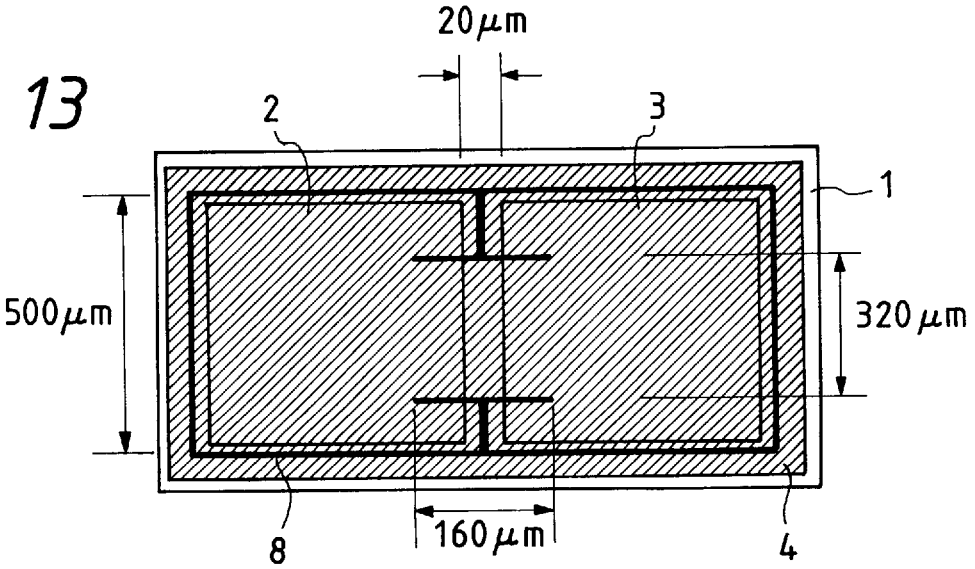
FIG. 13 is a schematic illustration of a patterning operation using laser.

Metal compound solutions having compositions according to Table 7 were prepared, and, in place of the palladium compound solution in Example 87, each metal compound solution was coated on a quartz substrate having a surface on which the same device electrode pair as those in Example 87 were formed. This substrate was annealed in the air at 440° C. for 15 minutes to thermally decompose metal compound, thereby forming an electroconductive film. By using the second harmonic (532 nm) of a YAG laser, pattern plotting shown in FIG. 13 was performed under the conditions, i.e., lamp current: 27A, Q-switch frequency: 10 kHz, processing speed: 10 mm/sec, to remove the electroconductive film on the plotted portion. The resultant structure was subjected to the same forming and activation as those in Example 87 to manufacture an electron-emitting device. An electron-emitting phenomenon was detected at device voltages 13 to 18 V.

EXAMPLES 100 TO 101

Metal compound solutions having compositions according to Table 8 were prepared, and, in place of the metal compound solutions in Examples 89 to 93, each metal compound solution was coated on a quartz substrate having a surface on which the same device electrode pair as those in Example 87 were formed. This substrate was annealed in the air at 440° C. for 15 minutes to thermally decompose metal compound, thereby forming an electroconductive film. Laser processing was performed in the same manner as in Examples 95 to 99. Thereafter, the substrate was heated to 320° C. in a degree of vacuum of $1\times10^{-6}$ torr for 30 minutes. The resultant structure was subjected to the same forming and activation as those in Example 87 to manufacture an electron-emitting device. An electron-emitting phenomenon was detected at device voltages 13 to 18 V.

EXAMPLES 102 TO 112

Metal compound solutions having compositions according to Table 9 were prepared, and, in place of the palladium compound solution in Example 87, each metal compound solution was coated on a quartz substrate having a surface on which the same device electrode pair as those in Example 87 were formed. Any solution could be easily coated on the substrate surface. This substrate was annealed in a helium atmosphere, containing 2% of hydrogen, at 440° C. for 20 minutes to thermally decompose metal compound, thereby forming an electroconductive film. By using the second harmonic (532 nm) of an YAG laser, pattern plotting shown in FIG. 13 was performed under the conditions, i.e., lamp current: 27A, Q-switch frequency: 10 kHz, processing speed: 10 mm/sec, to remove the electroconductive film on the plotted portion. The resultant structure was subjected to the same forming and activation as those in Example 87 to manufacture an electron-emitting device. An electron-emitting phenomenon was detected at device voltages 13 to 18 V.

EXAMPLE 113

A quartz substrate was used as the insulating substrate 1 and sufficiently washed with an organic solvent, and the device electrodes 2 and 3 consisting of Pt were formed on the surface of the substrate 1. An inter-device-electrode interval L was set to be 20 μm, a width W of each device electrode was set to be 500 μm, and a thickness d of each device electrode was set to be 1,000 Å.

Water was added to 0.6 g of tetramonoethanolamine palladium acetate ($Pd(H_2NC_2H_4OH)_4(CH_3COO)_2$), 0.05 g of 86% saponified poly(vinyl alcohol) (average degree of polymerization of 500), 25 g of isopropyl alcohol, and 1 g of ethylene glycol to prepare a palladium compound solution having a total weight of 100 g. This palladium compound solution was filtered with a membrane filter having a pore size of 0.25 μm and filled in a bubble jet printer head BC-01 available from CANON INC., and an external DC voltage of 20 V was applied to the heater in the head for 7 μs, thereby ejecting the palladium compound solution to the gap portion between the device electrodes 2 and 3 of the quartz substrate. The ejecting was repeated five times while keeping the positions of the head and the substrate. Each liquid droplet had an almost circular shape having a diameter of about 110 μm (FIG. 14A).

When this substrate was heated at 350° C. for 12 minutes to thermally decompose the palladium compound, palladium oxide was precipitated. The electric resistance between the device electrodes 2 and 3 became 11 kΩ.

Energization forming and activation were performed in the same manner as in Example 87 to evaluate the device as an electron-emitting device. Electron-emitting efficiency at a device voltage of 16 V was 0.046%.

EXAMPLES 114 TO 121

Metal compound solutions having compositions according to Table 10 were prepared, and the same treatment as in Example 107 was performed by using these compound solution in place of the palladium compound solution in Example 107 to manufacture electron-emitting devices. An electron-emitting phenomenon was detected at device voltage 16 V.

EXAMPLES 122 TO 126

Metal compound solutions having compositions according to Table 11 were prepared, and, in place of the palladium compound solution in Example 113, each metal compound solution was ejected to the gap portion between device electrodes by a bubble jet scheme in the same manner as in Example 113. This substrate was annealed in a helium atmosphere, containing 2% of hydrogen, at 400° C. for 20 minutes to thermally decompose metal compound, thereby forming an electroconductive film. The resultant structure was subjected to the same forming and activation as those in Example 87 to manufacture an electron-emitting device. An electron-emitting phenomenon was detected at device voltage 16 V.

EXAMPLE 127

Pentakis(3-amino-propanol)aquacobalt(III) acetic acid salt was prepared as follows. 5.1 g of 3-amino-propanol, 80 ml of isopropanol, and 0.97 g of acetic acid were added to 4 g of synthetic cobalt (II) acetate (4-hydrate), and the resultant liquid was stirred for 6 hours with flowing air in the liquid to be mixed with each other. The reacted liquid was filtered, and the filtered liquid was decompressed to remove a solvent. The resultant solid matter was recrystallized with an ethyl acetate/hexane mixture solvent cobalt acetate. As the results of CHN element analysis and ICP analysis of cobalt, it was confirmed that this solid had a target composition.

0.5 g of this solid was added with 46 g of water, 3 g of isopropyl alcohol, 0.5 g of ethylene glycol, 25 mg of 86% saponified poly(vinyl alcohol) (average degree of polymerization of 500), and the resultant solution was stirred to obtain a transparent solution. When an electron-emitting device was manufactured in the same manner as in Example except that the solution was used as a liquid for substrate application, an electron-emitting phenomenon was detected.

EXAMPLES 128 TO 129

Metal compound solutions having compositions according to Table 12 were prepared, and, in place of the palladium compound in Example 113, each metal compound solution was ejected to the gap portion between device electrodes by a bubble jet scheme in the same manner as in Example 87. This substrate was annealed in a helium atmosphere, containing 2% of hydrogen, at 400° C. for 20 minutes to thermally decompose metal compound, thereby forming an electroconductive film. The resultant structure was subjected to the same forming and activation as those in Example 87 to manufacture an electron-emitting device. An electron-emitting phenomenon was detected at device voltage 16 V.

EXAMPLE 130

Figure 14B:
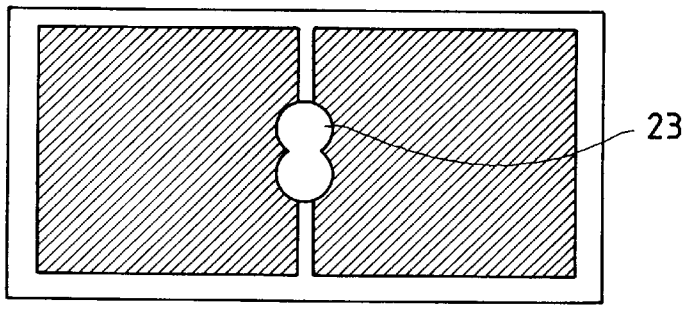

Device electrodes 2 and 3 were formed on a quartz substrate in the same manner as in Example 113. The palladium compound solution used in Example 113 was filled in a bubble jet printer head BC-01 available from CANON INC., and an external DC voltage of 20 V was applied to the heater in the head for 7 μs, thereby ejecting the palladium compound solution to the gap portion between the device electrodes 2 and 3 of the quartz substrate six times. Immediately, the substrate was moved by 70 μm in the direction of the gap portion, and the palladium compound solution was ejected to the substrate by the head six times (FIG. 14B).

When this substrate was heated at 350° C. for 12 minutes to thermally decompose the palladium compound, palladium oxide was precipitated. The electric resistance between the device electrodes 2 and 3 became 7 kΩ.

Predetermined energization forming and activation were performed in the same manner as in Example 87 to evaluate the device as an electron-emitting device. Electron-emitting efficiency at a device voltage of 16 V was 0.044%.

EXAMPLES 131 TO 138

By using metal compound solutions having compositions according to Table 6 used in Examples 108 to 115 in place of the palladium compound solution in Example 130, the same treatment as in Example 130 was performed to manufacture electron-emitting devices. An electron-emitting phenomenon was detected at device voltage 16 V.

EXAMPLE 139

Figure 14C:
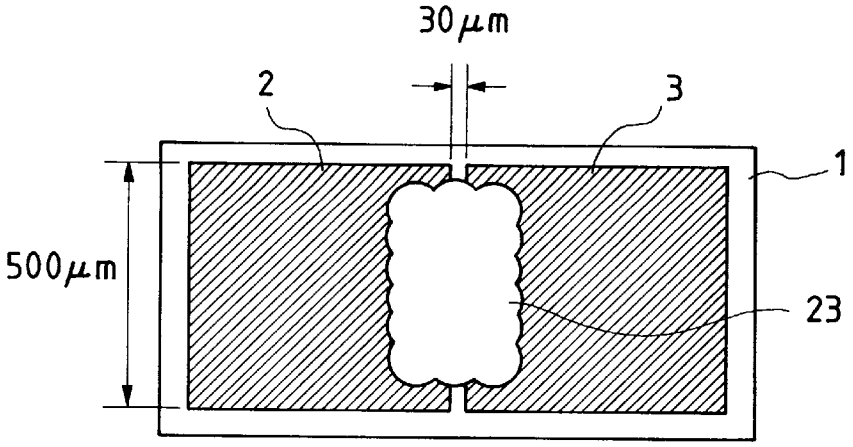

A quartz substrate was used as the insulating substrate 1 and sufficiently washed with an organic solvent, and the device electrodes 2 and 3 consisting of Pt were formed on the surface of the insulating substrate 1. An inter-device-electrode interval L was set to be 30 μm, a width W of each device electrode was set to be 500 μm, and a thickness d of each device electrode was set to be 1,000 Å. The palladium compound solution was filtered with a membrane filter having a pore size of 0.25 μm and filled in a bubble jet printer head BC-01 available from CANON INC. The head was fixed on a plane moving stage to be kept at a position having a height of 1.6 mm from the substrate such a manner that the direction of the device electrode gap of the substrate coincided with the direction of the array of ejecting holes. While the head was moved at a speed of 280 mm/sec in a direction perpendicular to the device electrode gap by the moving stage, an external DC voltage of 20 V was applied to five predetermined adjacent heaters in the head for 7 μs at intervals of 180 μsec three times. In this manner, a rectangular pattern constituted by a total of 15 liquid droplets was formed with the electrode gap of the substrate in the center (FIG. 14C).

When this substrate was heated at 350° C. for 12 minutes to thermally decompose the palladium compound, a uniform palladium oxide film was formed on the rectangular pattern portion. The electric resistance between the device electrodes 2 and 3 became 3 kΩ.

Predetermined energization forming and activation were performed in the same manner as in Example 87 to evaluate the device as an electron-emitting device. Electron-emitting efficiency at a device voltage of 14 V was 0.04%.

EXAMPLES 140 TO 145

By using metal compound solutions having compositions according to Table 13 in place of the palladium compound solution in Example 139, the same treatment as in Example 139 was performed to manufacture electron-emitting devices. An electron-emitting phenomenon was detected at device voltage 16 V.

Supplemental Example 24

A metal compound solution was prepared under the same conditions as those in Example 139 except that poly(vinyl alcohol) was not used, and this metal compound solution was ejected on a device electrode substrate to have a rectangular shape. When this substrate was annealed in the same manner as in Example 139, it was observed with an optical microscope that a large number of electroconductive films were present in the central portion in the rectangular shape, and nonuniformly dispersed in the peripheral portion of the rectangular shape. This substrate was not optimum as an electron-emitting device.

Supplemental Example 25

A metal compound solution was prepared by using 86% saponified poly(vinyl alcohol) (average degree of polymerization of 300) in place of poly(vinyl alcohol) in Example 139, and this metal compound solution was ejected on a device electrode substrate in the same manner as in Example 139 to have a rectangular shape. When this substrate was annealed in the same manner as in Example 139, it was observed with an optical microscope that a large number of electroconductive films were present in the central portion in the rectangular shape, and nonuniformly dispersed in the peripheral portion of the rectangular shape. This substrate was not optimum as an electron-emitting device.

Supplemental Example 26

A metal compound solution was prepared by using 98.5% saponified poly(vinyl alcohol) (average degree of polymerization of 500) in place of poly(vinyl alcohol) in Example 139, and this metal compound solution was ejected on a device electrode substrate in the same manner as in Example 139 to have a rectangular shape. As the liquid having the rectangular shape was dried on the substrate, a portion where the liquid was present gradually contracted, and the rectangular portion became a circular portion having a diameter of 70 $\mu$m. When this substrate was annealed in the same manner as in Example 139, a conductive film whose central portion had a large thickness was formed on the circular portion, and the conductive film was rarely present on the peripheral portion. When forming was tried, a large current was required. Even if an electron-emitting device was manufactured by using this film, an electron-emitting phenomenon was rarely detected.

Supplemental Example 27

A metal compound solution was prepared by using 86% saponified poly(vinyl alcohol) (average degree of polymerization of 2,400) in place of poly(vinyl alcohol) in Example 139, and this metal compound solution was ejected on a device electrode substrate in the same manner as in Example 139 to have a rectangular shape. This solution could not be ejected with good reproducibility, and some nozzle sometimes failed to eject the liquid droplet, or some nozzle did not eject the liquid droplet. Therefore, a target rectangular patter could not be formed by the metal compound solution with good reproducibility.

Supplemental Example 28

A metal compound solution in the same manner as in Example 139 except that 0.7 g of 86% saponified poly(vinyl alcohol) (average degree of polymerization of 500) was used, and this solution was filled in a BC-01 head as in the same manner as in Example 139. When a predetermined voltage was applied to the head immediately after the solution was filled, a liquid droplet was ejected. However, when the ejecting was stopped for 3 seconds, the head did not eject a liquid droplet even if the predetermined voltage was applied to the head. Immediately after the ejecting surface of the head was wiped with filter paper, the head could eject a liquid droplet again. However, several seconds after, the head could not eject a liquid droplet. In this manner, the metal compound solution described above was improper as a solution coated on a substrate by ejecting performed by a bubble jet scheme.

EXAMPLES 146 TO 148

Metal compound solutions having compositions according to Table 14 were prepared, in place of the palladium compound solution in Example 139, each of the metal compound solutions was ejected by a bubble jet scheme on a portion having the gap portion of a device electrode as the center in the same manner as in Example 139 to have a rectangular shape. This substrate was annealed in a helium atmosphere, containing 2% of hydrogen, at 400° C. for 20 minutes to thermally decompose metal compound, thereby forming an electroconductive film. The resultant structure was subjected to the same forming and activation as those in Example 1 to manufacture an electron-emitting device. An electron-emitting phenomenon was detected at device voltage 16 V.

EXAMPLE 149

1 g of complete-saponified poly(vinyl alcohol) (99% saponification, average degree of polymerization of 500) was added to 80 ml, and the resultant solution was stirred with keeping away from humidity. This mixture was added with triethylamine and cooled by ice. 1.8 g of acetyl chloride was dropped on the mixture. The resultant mixture was stirred 2 hours while being cooled. The reacted mixture was dissolved in 350 ml of water, and the resultant solution was added with 150 g of a desalting ion-exchange resin and stirred. The resin was filtered out, thereby obtaining a liquid. This solution was added with 100 g of a desalting ion-exchange resin and stirred, and the resin was filtered out, thereby obtaining a liquid. The resultant liquid was slowly decompressed and contracted, and the resultant liquid was added with water to obtain about 30 ml of a solution. This solution was frozen and dried in a vacuum state. As a result, 0.8 g of polymer could be obtained. As the result of CHN element analysis, it was estimated that the acetylation rate of poly(vinyl alcohol) was 8.2%.

Water was added to 0.5 g of this polymer, 0.6 g of tetramonoethanolamine palladium acetate (Pd $(H_2NC_2H_4OH)_4(CH_3COO)_2$), 25 g of isopropyl alcohol, and 1 g of ethylene glycol to prepare a palladium compound solution having a total weight of 100 g. By using this palladium compound solution in place of the palladium compound solution in Example 139, the same treatment as in Example 139 was performed to manufacture an electron-emitting device. An electron-emitting phenomenon was detected at device voltage 16 V.

EXAMPLES 150 TO 156

Supplemental Examples 25 to 27

Poly(vinyl alcohol)ester according to Table 15 were synthesized by the method according to Example 149. By using the obtained polymers, electron-emitting devices were manufactured in the same manner as in Example 149. Table 15 also shows the types and amounts of used esterifying agents, estimation values of esterification rates based on element analysis, and evaluation of good/no good of the electroconductive film portions of the obtained devices. Note that, as signs for evaluation, ⊚: good, ○: fair, and x: no good are used.

EXAMPLES 157 TO 163

Supplemental Examples 15 to 17

Polyhydric alcohols shown in Table 16 and each having weights shown in Table 16 were used in place of ethylene glycol (1 g) of the palladium compound solution used in Example 139 to prepare solutions. Note that, when the amount of polyhydric alcohol used in this case was different from 1 g, an amount of water was changed to obtain a total weight of 100 g. By using each of the solutions was used in place of the palladium compound solution in Example 139, the same treatment as in Example 139 was performed to manufacture an electron-emitting device. Table 16 also shows evaluation of good/no good of the electroconductive film portions of the obtained devices. Note that, as signs for evaluation, ◎: good, ○: fair, and x: no good are used.

A device which is evaluated as no good in Table 16 is as follows. That is, palladium compound coated on an electrode substrate to have a rectangular shape is aggregated on the central portion to have a circular shape in drying/baking steps, so that a rectangular electroconductive film could not obtained; or the palladium compound has a rectangular shape but has a central portion having a thickness which is apparently larger than that of a peripheral portion.

EXAMPLE 164

By using a bubble jet type ink jet apparatus, the liquid droplet of an organometallic compound solution were applied to counter electrodes on a substrate (FIG. 6), on which 16×16, i.e., 256, device electrodes and a matrix wire were formed, in the same manner as in Example 113. The substrate was baked and subjected to forming treatment, thereby obtaining an electron source substrate.

A rear plate 71, a support frame 72, and a face plate 76 were connected to the electron source substrate, and the resultant structure was sealed in a vacuum state, thereby an image-forming apparatus according to the concept view in FIG. 7. A predetermined voltage was applied to the devices through terminals Dox1 to Dox16 and terminals Doy1 to Doy16 in a time-division manner, and a high voltage was applied to the metal back through an terminal Hv, so that an arbitrary image pattern could be displayed.

Effect of the Invention

As has been described above, a metal composition, containing partially esterified poly(vinyl alcohol), for manufacturing an electron-emitting device according to the present invention is a metal composition which can be coated on a substrate with good substrate wettability to obtain a coating having a uniform thickness. When this metal compound is heated and baked, an electroconductive film having a uniform thickness can be formed. In particular, this metal composition is effectively used in the steps in manufacturing a thin film for forming the electron-emitting region of a surface conduction electron-emitting device.

When a metal composition for manufacturing an electron-emitting device according to the present invention is coated on a substrate to have a pattern, a coating having a predetermined pattern can be obtained. When this metal composition is heated and baked, an electroconductive film having a predetermined pattern and a uniform thickness can be formed. Therefore, the steps in manufacturing a thin film for forming the electron-emitting region of a surface conduction electron-emit can be simplified, and an amount of metal material used for forming an electron-emitting region can be reduced.

According to a method of manufacturing an electron-emitting device using a metal composition for manufacturing an electron-emitting device according to the present invention, an electron-emitting region having an arbitrary shape and an arbitrary size can be simply formed, and an electron-emitting device can be freely designed.

Since the electron-emitting device using the metal composition for manufacturing an electron-emitting device has a uniform thin film for forming an electron-emitting region, an electron-emitting device having stable characteristics can be obtained at low cost.

A display device using the electron-emitting device and having stable characteristics can be obtained at low cost.

In a conventional electron source or an image-forming apparatus having a large area, in the steps in manufacturing the electroconductive film of an electron-emitting device, (1) since a vacuum technique and a photolithography technique are used to deposit an electroconductive film and process the electroconductive film into a desired shape, an apparatuses for these techniques are expensive, and the manufacturing cost is high.

(2) As a method of depositing a conductive thin film, a method of applying a metal-containing liquid to a substrate and drying and baking it to manufacture an electroconductive film without using a vacuum technique, in a process from the drying step after the metal-containing liquid is applied to the substrate to the baking step, a material for forming the electroconductive film in the metal-containing liquid forms nonuniform crystal, in the baking step to perform thermal decomposition or the like required to give conductivity to the material for forming the electroconductive film in the metal-containing liquid, by volatilization or sublimation of the material for forming the electroconductive film, nonuniformity may occurs in the thickness of the electroconductive film. As a result, problems such as degradation of the electric characteristics of an electron-emitting device or variations in electric characteristics of electron-emitting devices are posed.

A temperature of the baking step is preferably set to be a low temperature in consideration of a material, e.g., glass, constituting an electron source or an image-forming apparatus.

(3) In a method of applying a metal-containing liquid to a substrate to manufacture an electroconductive film, a simple method of manufacturing a metal-containing liquid is preferably used, and water rather than an organic solvent is preferably used as a solvent of the metal-containing liquid in consideration of environment. When water is used as the solvent, a metal serving as a material for forming an electroconductive film must have a sufficient concentration and stability not to precipitate crystal or not to deposit crystal.

(4) In a method of applying a metal-containing liquid to a substrate to manufacture an electroconductive film, in particular, in a method of applying a liquid droplet of a metal-containing liquid to a substrate by using an ink jet method or the like to manufacture an electroconductive film, in order to manufacture an electroconductive film having a desired shape without using a photolithography technique, it is important the shape of a liquid droplet is controlled when the liquid droplet of the metal-containing liquid to the substrate.

In particular, when a liquid droplet is to be applied by a bubble jet method of ink jet methods, in order to heat the liquid droplet and apply the liquid droplet to the substrate, when the thermal decomposition temperature of a material for forming an electroconductive film in the metal-containing liquid in an ink jet nozzle is a low temperature, a metal is precipitated, and the ink jet nozzle is clogged. For this reason, the liquid droplet cannot be applied to the substrate, or a proper amount of droplet cannot be controlled. Therefore, it is desired that the material for forming an electroconductive film in the metal-containing liquid has a proper decomposition temperature.

(5) As a method of manufacturing a pair of opposing device electrodes formed on a substrate, when the device electrodes are manufactured by offset printing or screen printing using a printing paste suitable for an electron source or an image-forming apparatus having a large area, each device electrode has a large number of pores, the device electrode adsorbs the droplet of a metal-containing liquid, and variations in resistance of electroconductive films occurs. As a result, problems such as degradation of the electric characteristics of the electron-emitting device or variations in electric characteristics of the electron-emitting devices are posed.

Although the above problems are posed, according to the present invention, a method of manufacturing a metal-containing liquid characterized by containing an organic acid group, a transition metal, alcohol amine of one or more type, and water, comprises the step of mixing the metal-containing liquid with a compound containing an organic acid group, a metal compound, and alcohol amine, or the step of dissolving an organometallic complex containing an organic acid group, a metal, and alcohol amine as components in a liquid. In this manner, the metal-containing liquid can be dissolved in water serving as a solvent at a sufficient metal concentration, and can have excellent stability. In addition, the thermal decomposition temperature of the organometallic compound serving as a material for forming an electroconductive film can correspond to a proper temperature of the baking step, and the metal-containing liquid can be constituted by an organometallic compound having a low decomposition temperature which can be applied to an ink jet method, and can be realized by a simple manufacturing method.

Since a metal-containing liquid containing alcohol amine of one or more type, nonuniform crystal of the organometallic compound serving as the material for forming an electroconductive film which is conventionally formed in a process from the drying step after the metal-containing liquid is applied to the substrate to the baking step can be suppressed from being formed.

Since the metal-containing liquid contains water soluble polymer, even if a device electrode has a large number of pores, adsorption of liquid droplet of the metal-containing liquid to the device electrode can be suppressed, and variations in resistance of electroconductive films can be reduced. In particular, partially esterified poly(vinyl alcohol) is used as the water soluble polymer, wettability of the metal-containing liquid to the substrate can be improved, and a uniform liquid droplet of the metal-containing liquid can be formed.

When polyhydric alcohol is added to the metal-containing liquid, according to the present invention, containing an organic acid group, a transition metal, and alcohol amine of one or more type, the film thickness of a liquid droplet can be made homogeneous. When monohydric alcohol is added to the metal-containing liquid, even if a liquid droplet is applied a plurality of time, surface energy is suppressed, the liquid droplet can be controlled to have a desired shape, and an electroconductive film having a desired shape can be formed. Therefore, an electroconductive film having a desired shape can be formed without using a photolithography technique whose apparatus is expensive and whose manufacturing cost is high.

As described above, according to the metal-containing liquid of the present invention and the method of manufacturing the metal-containing liquid, an optimum electroconductive film, for an electron-emitting device, which has excellent stability, excellent electron-emitting characteristics, and small variation can be manufactured. According to the metal-containing liquid of the present invention, an optimum low-cost manufacturing method can be provided as a method of forming an electroconductive film for an electron-emitting device in an electron source or an image-forming apparatus having a large area.

TABLE 1

| | n | 1 | $R^1$ | $R^3$ | Decomp. Start. (° C.) | Solubility (Pdwt %) | Abbr. | If (mA) | Ie (mA) | Ie/If |
|---|---|---|---|---|---|---|---|---|---|---|
| Ex. 19 | 2 | 4 | —$(CH_2)_3$— | — | 173 | 14.2 | PAMP | 2.7 | 1.1 | 0.041% |
| Ex. 20 | | | —$(CH_2)_4$— | — | 186 | 10.5 | PAMB | 2.3 | 1.2 | 0.052 |
| Ex. 21 | | | —$(CH_2CH(CH_3)$— | — | 146 | 14.2 | PAMI | 2.2 | 1.1 | 0.050 |
| Ex. 22 | 1 | 2 | —$(CH_2)_2$— | —$CH_3$ | 155 | 16.0 | PANME | 2.9 | 1.3 | 0.045 |
| Ex. 23 | | | | —$CH_2CH_3$ | 153 | 8.4 | PAEE | 2.6 | 1.1 | 0.042 |
| Ex. 24 | | | | —$CH_2CH_2CH_3$ | 154 | 4.0 | PAPE | 2.6 | 1.0 | 0.038 |
| Ex. 25 | | | | —$CH(CH_3)_2$ | 155 | 3.7 | PAIE | 2.8 | 1.1 | 0.039 |
| Ex. 26 | | | | —$C(CH_3)_3$ | 166 | 0.7 | PATBE | 2.5 | 1.0 | 0.040 |
| Ex. 27 | 0 | 2 | —$(CH_2)_2$— | —$CH_3$ | 126 | 18.9 | PADME | 2.2 | 1.0 | 0.045 |
| Ex. 28 | | | | —$CH_2CH_3$ | 132 | 16.4 | PADEE | 2.6 | 1.2 | 0.045 |
| Ex. 29 | | | | —$CH(CH_3)_2$ | 141 | 1.4 | PADIE | 2.6 | 1.3 | 0.050 |

$(R^2COO)_mM\{NH_nR^3_k(R^1OH)_{(3-n-k)}\}_1 \Longrightarrow$ $R^2 = CH_3$; m = 2; M = Pd;

$$\boxed{(CH_3COO)_2Pd[NH_nR^3_{(2-n)}(R^1OH)]_1}$$

TABLE 2

| Example | Nickel carboxylate complex | Conc. (Ni wt %) |
|---|---|---|
| 36 | $(CH_3COO)_2Ni(H_2NCH_2CH_2CH_2CH_2OH)_2$ | 0.35 |
| 37 | $(CH_3COO)_2Ni(H_2NCH_2CH_2OH)_2$ | 0.45 |
| 38 | $(C_2H_5COO)_2Ni(H_2NCH_2CH_2CH_2OH)_2$ | 0.40 |
| 39 | $(HCOO)_2Ni(H_2NCH_2CH_2CH_2CH_2OH)_2$ | 0.40 |
| 40 | $(HCOO)_2Ni(H_2NCH_2CH(CH_3)OH)_2$ | 0.70 |
| 41 | $(C_4H_9COO)_2Ni(H_2NCH_2CH_2OH)_2$ | 0.35 |
| 42 | $(C_4H_9COO)_2Ni(H_2NCH_2CH(CH_3)OH)_2$ | 0.50 |
| 43 | $(C_3H_7COO)_2Ni(H_2NCH_2CH_2OH)_2$ | 0.45 |
| 44 | $(C_3H_7COO)_2Ni(H_2NCH_2CH_2CH_2OH)_2$ | 0.35 |
| 45 | $(CH_3COO)_2Ni(HN(CH_3)CH_2CH_2OH)_2$ | 0.70 |
| 46 | $(HCOO)_2Ni(HN(C_2H_5)CH_2CH_2OH)_2$ | 0.60 |
| 47 | $(C_2H_5COO)_2Ni(HN(C_3H_7)CH_2CH_2OH)_2$ | 0.50 |
| 48 | $(C_4H_9COO)_2Ni(HN(CH_3)CH_2CH_2OH)_2$ | 0.40 |
| 49 | $(HCOO)_2Ni(N(CH_3)_2CH_2CH_2OH)_2$ | 0.40 |
| 50 | $(CH_3COO)_2Ni(N(CH_3)_2CH_2CH_2OH)_2$ | 0.50 |
| 51 | $(CH_3COO)_2Ni(N(C_2H_5)_2CH_2CH_2OH)_2$ | 0.40 |
| 52 | $(C_4H_9COO)_2Ni(N(CH_3)_2CH_2CH_2OH)_2$ | 0.40 |
| 53 | $(HCOO)_2Ni(N(C_2H_5)_2CH_2CH_2OH)_2$ | 0.50 |

TABLE 2-continued

| Example | Nickel carboxylate complex | Conc. (Ni wt %) |
|---|---|---|
| 54 | $(HCOO)_2Ni(N(C_4H_9)_2CH_2CH_2OH)_2$ | 0.50 |
| 55 | $(HCOO)_2Ni(H_2NCH_2CH_2OH)_3 \cdot 2H_2O$ | 1.00 |
| 56 | $(CH_3COO)_2Ni(H_2NCH_2CH_2OH)_2$ | 2.00 |

TABLE 3

| Example | Nickel carboxylate complex | Conc. (Ni wt %) |
|---|---|---|
| 58 | $(C_2H_5COO)_2Ni(H_2NCH_2CH_2CH_2OH)_2$ | 0.60 |
| 59 | $(CH_3COO)_2Ni[HN(CH_3)CH_2CH_2OH]_2$ | 0.50 |
| 60 | $(C_3H_7COO)_2Ni(H_2NCH_2CH_2CH_2CH_2OH)_2$ | 0.40 |
| 61 | $(HCOO)_2Ni[N(C_2H_5)_2CH_2CH_2OH]_2$ | 0.70 |
| 62 | $(C_4H_9COO)_2Ni(H_2NCH_2CH_2OH)_2$ | 0.45 |
| 63 | $(HCOO)_2Ni(_2NCH_2CH_2OH)_3 \cdot 2H_2O$ | 0.90 |
| 64 | $(CH_3COO)_2Ni[N(C_4H_9)_2CH_2CH_2OH]_2$ | 0.30 |
| 65 | $(C_2H_5COO)_2Ni[HN(C_3H_7)CH_2CH_2OH]_2$ | 0.50 |
| 66 | $(C_3H_7COO)_2Ni[HN(CH_3)CH_2CH_2OH]_2$ | 0.55 |
| 67 | $(HCOO)_2Ni(H_2NCH_2CH_2CH_2OH)_2$ | 0.40 |
| 68 | $(C_4H_9COO)_2Ni[HN(CH_3)CH_2CH_2OH]_2$ | 0.55 |
| 69 | $(CH_3COO)_2Ni(H_2NCH_2CH_2OH)_2$ | 0.70 |
| 70 | $(C_2H_5COO)_2Ni[N(CH_3)_2CH_2CH_2OH]_2$ | 0.40 |
| 71 | $(HCOO)_2Ni[H_2NCH_2CH(CH_3)OH]_2$ | 0.40 |

TABLE 4

| | |
|---|---|
| Example 80 | |
| Tetramonoethanolamine palladium acetate ($Pd(H_2NC_2H_4OH)_4(CH_3COO)_2$) | 0.8 g |
| 80%-sapanified polyvinyl alcohol (av. M.W. 400) | 0.1 g |
| t-butyl alcohol | 20.0 g |
| diethylene glycol | 1.0 g |
| aminomethylpropanol | 0.5 g |
| water | 77.6 g |
| Example 82 | |
| di(diethanolamine)palladium acetate ($Pd(HN(C_2H_4OH)_2)_2(CH_3COO)_2$) | 1.5 g |
| 86%-saponified polyvinyl alcohol (AV. M.W. 500) | 0.05 g |
| n-propyl alcohol | 25.0 g |
| 2-amino-1-propanol | 2.0 g |
| water | 71.45 g |

TABLE 5

| | |
|---|---|
| Example 88 | |
| $Pd(H_2NC_2H_4OH)_4(CH_3COO)_2$ | 8.8 g |
| 86%-saponified polyvinyl alcohol (av. M.W. 400) | 0.2 g |
| water | 98.2 g |
| Example 89 | |
| $Pd(H_2NC_2H_4OH)_4(CH_3COO)_2$ | 4.4 g |
| 86%-saponified polyvinyl alcohol (av. M.W. 450) | 0.2 g |
| water | 98.2 g |
| Example 90 | |
| $Pd(H_2NC_2H_4OH)_4(CH_3COO)_2$ | 3.2 g |
| 86%-saponified polyvinyl alcohol (av. M.W. 500) | 0.5 g |
| water | 98.2 g |
| Example 91 | |
| $Pd(H_2NC_2H_4OH)_4(CH_3COO)_2$ | 3.2 g |
| 86%-saponified polyvinyl alcohol (av. M.W. 1000) | 0.2 g |

TABLE 5-continued

| | |
|---|---|
| isopropyl alcohol | 5.0 g |
| water | 93.2 g |
| Example 92 | |
| $Pd(H_2NC_2H_4OH)_4(CH_3COO)_2$ | 4.0 g |
| 80%-saponified polyvinyl alcohol (av. M.W. 2000) | 0.1 g |
| ethyl alcohol | 7.0 g |
| water | 91.2 g |
| Example 93 | |
| $Pd(H_2NC_2H_4OH)_4(CH_3COO)_2$ | 4.0 g |
| 80%-saponified polyvinyl alcohol (av. M.W. 1000) | 0.1 g |
| isopropyl alcohol | 10.0 g |
| ethylene glycol | 3.0 g |
| water | 84.9 g |
| Example 94 | |
| $Pd(H_2NC_2H_4OH)_4(CH_3COO)_2$ | 4.4 g |
| 80%-saponified polyvinyl alcohol (av. M.W. 500) | 0.1 g |
| isopropyl alcohol | 35.0 g |
| glycerin | 1.0 g |
| water | 77.7 g |

TABLE 6

| | |
|---|---|
| Supplemental Example 18 | |
| $Pd(H_2NC_2H_4OH)_4(CH_3COO)_2$ | 3.2 g |
| isopropyl alcohol | 25.0 g |
| water | 73.4 g |
| Supplemental Example 19 | |
| $Pd(H_2NC_2H_4OH)_4(CH_3COO)_2$ | 3.2 g |
| 98.5%-saponified polyvinyl alcohol (av. M.W. 1000) | 0.05 g |
| isopropyl alcohol | 25.0 g |
| water | 73.3 g |
| Supplemental Example 20 | |
| $Pd(H_2NC_2H_4OH)_4(CH_3COO)_2$ | 3.2 g |
| water | 98.4 g |
| Supplemental Example 21 | |
| $Pd(H_2NC_2H_4OH)_4(CH_3COO)_2$ | 3.2 g |
| 86%-saponified polyvinyl alcohol (av. M.W. 300) | 0.2 g |
| water | 98.2 g |
| Supplemental Example 22 | |
| $Pd(H_2NC_2H_4OH)_4(CH_3COO)_2$ | 3.2 g |
| isopropyl alcohol | 5.0 g |
| water | 93.4 g |
| Supplemental Example 23 | |
| $Pd(H_2NC_2H_4OH)_4(CH_3COO)_2$ | 4.0 g |
| isopropyl alcohol | 10.0 g |
| ethylene glycol | 3.0 g |
| water | 85.0 g |

TABLE 7

| | |
|---|---|
| Example 95 | |
| ruthenium acetate | 0.8 g |
| 86%-saponified polyvinyl alcohol (av. M.W. 500) | 0.2 g |
| water | 99.0 g |
| Example 96 | |
| ruthenium acetate | 0.8 g |
| 86%-saponified polyvinyl alcohol (av. M.W. 1000) | 0.2 g |
| isopropyl alcohol | 5.0 g |
| water | 94.0 g |
| Example 97 | |

TABLE 7-continued

| | |
|---|---|
| silver acetate | 0.4 g |
| 86%-saponified polyvinyl alcohol (av. M.W. 500) | 0.2 g |
| water | 99.4 g |
| Example 98 | |
| tin (II) acetate | 1.6 g |
| antimony acetate | 0.1 g |
| 86%-saponified polyvinyl alcohol (av. M.W. 500) | 0.2 g |
| water | 98.2 g |
| Example 99 | |
| iron (II) acetate | 2.0 g |
| 86%-saponified polyvinyl alcohol (av. M.W. 500) | 0.2 g |
| glycerin | 2.0 g |
| water | 84.9 g |

TABLE 8

| | |
|---|---|
| Example 100 | |
| zinc acetate | 2.0 g |
| palladium acetate | 0.05 g |
| 86%-saponified polyvinyl alcohol (av. M.W. 500) | 0.3 g |
| water | 97.7 g |
| Example 101 | |
| tin (II) acetate | 1.6 g |
| antimony acetate | 0.1 g |
| 86%-saponified polyvinyl alcohol (av. M.W. 500) | 0.2 g |
| water | 98.2 g |

TABLE 9

| | |
|---|---|
| Example 102 | |
| chromium (III) acetate hydroxide | 0.7 g |
| 86%-saponified polyvinyl alcohol (av. M.W. 500) | 0.2 g |
| water | 99.1 g |
| Example 103 | |
| tetraoxotriamminechromium | 0.5 g |
| 86%-saponified polyvinyl alcohol (av. M.W. 500) | 0.2 g |
| water | 99.3 g |
| Example 104 | |
| ammonium tetracyanatoaurate (III) | 0.5 g |
| 86%-saponified polyvinyl alcohol (av. M.W. 500) | 0.2 g |
| water | 99.3 g |
| Example 105 | |
| copper (II) acetate | 0.4 g |
| 86%-saponified polyvinyl alcohol (av. M.W. 450) | 0.3 g |
| water | 99.3 g |
| Example 106 | |
| tin (II) acetate | 1.6 g |
| 66%-saponified polyvinyl alcohol (av. M.W. 500) | 0.2 g |
| water | 98.2 g |
| Example 107 | |
| lead (II) acetate | 1.6 g |
| 86%-saponified polyvinyl alcohol (av. M.W. 500) | 0.2 g |
| water | 98.2 g |
| Example 108 | |
| zinc acetate | 2.0 g |
| 86%-saponified polyvinyl alcohol (av. M.W. 500) | 0.2 g |
| ethyl alcohol | 7.0 g |
| water | 90.8 g |
| Example 109 | |
| iron (II) acetate | 2.0 g |
| 86%-saponified polyvinyl alcohol (av. M.W. 500) | 0.2 g |

TABLE 9-continued

| | |
|---|---|
| water | 97.8 g |
| Example 110 | |
| ammonium tetrathiocyanatopalladate | 1.2 g |
| 86%-saponified polyvinyl alcohol (av. M.W. 500) | 0.2 g |
| water | 98.6 g |
| Example 111 | |
| potassium hexatantalate | 0.8 g |
| 86%-saponified polyvinyl alcohol (av. M.W. 500) | 0.2 g |
| water | 99.0 g |
| Example 112 | |
| ammonium tungstate | 0.8 g |
| 86%-saponified polyvinyl alcohol (av. M.W. 1000) | 0.2 g |
| water | 99.0 g |

TABLE 10

| | |
|---|---|
| Example 114 | |
| $Pd(H_2NC_2H_4OH)_4(CH_3COO)_2$ | 0.8 g |
| 86%-saponified polyvinyl alcohol (av. M.W. 500) | 0.07 g |
| isopropyl alcohol | 5.0 g |
| ethylene glycol | 0.2 g |
| water | 93.9 g |
| Example 115 | |
| $Pd(H_2NC_2H_4OH)_4(CH_3COO)_2$ | 0.5 g |
| 86%-saponified polyvinyl alcohol (av. M.W. 500) | 0.07 g |
| n-propyl alcohol | 15.0 g |
| water | 84.4 g |
| Example 116 | |
| $Pd(H_2NC_2H_4OH)_4(CH_3COO)_2$ | 0.6 g |
| 80%-saponified polyvinyl alcohol (av. M.W. 500) | 0.01 g |
| isopropyl alcohol | 20.0 g |
| water | 79.4 g |
| Example 117 | |
| $Pd(H_2NC_2H_4OH)_4(CH_3COO)_2$ | 0.6 g |
| 86%-saponified polyvinyl alcohol (av. M.W. 500) | 0.05 g |
| isopropyl alcohol | 25.0 g |
| glycerin | 1.0 g |
| water | 73.4 g |
| Example 118 | |
| $Pd(H_2NC_2H_4OH)_4(CH_3COO)_2$ | 0.6 g |
| 86%-saponified polyvinyl alcohol (av. M.W. 500) | 0.07 g |
| isopropyl alcohol | 5.0 g |
| ethylene glycol | 0.2 g |
| water | 94.1 g |
| Example 119 | |
| $Pd(H_2NC_2H_4OH)_4(CH_3COO)_2$ | 0.6 g |
| 86%-saponified polyvinyl alcohol (av. M.W. 500) | 0.07 g |
| ethyl alcohol | 10.0 g |
| ethylene glycol | 0.5 g |
| water | 88.8 g |
| Example 120 | |
| $Pd(H_2NC_2H_4OH)_4(CH_3COO)_2$ | 0.6 g |
| 86%-saponified polyvinyl alcohol (av. M.W. 500) | 0.07 g |
| methanol | 10.0 g |
| ethylene glycol | 5.0 g |
| water | 89.1 g |
| Example 121 | |
| $Pd(H_2NC_2H_4OH)_4(CH_3COO)_2$ | 0.6 g |
| 80%-saponified polyvinyl alcohol (av. M.W. 500) | 0.01 g |
| 2-butanol | 5.0 g |
| water | 94.4 g |

TABLE 11

| | |
|---|---|
| Example 122 | |
| chromium (III) acetate hydroxide | 0.5 g |
| 86%-saponified polyvinyl alcohol (av. M.W. 500) | 0.05 g |
| isopropyl alcohol | 5.0 g |
| ethylene glycol | 1.0 g |
| water | 93.5 g |
| Example 123 | |
| copper (II) acetate | 0.4 g |
| 86%-saponified polyvinyl alcohol (av. M.W. 500) | 0.05 g |
| isopropyl alcohol | 5.0 g |
| ethylene glycol | 1.0 g |
| water | 93.6 g |
| Example 124 | |
| iron (II) acetate | 1.2 g |
| 86%-saponified polyvinyl alcohol (av. M.W. 500) | 0.05 g |
| isopropyl alcohol | 7.0 g |
| ethylene glycol | 1.0 g |
| water | 90.7 g |
| Example 125 | |
| potassium hexatantalate | 0.5 g |
| 86%-saponified polyvinyl alcohol (av. M.W. 500) | 0.05 g |
| isopropyl alcohol | 7.0 g |
| ethylene glycol | 1.0 g |
| water | 91.5 g |
| Example 126 | |
| ammonium tungstate | 0.5 g |
| 86%-saponified polyvinyl alcohol (av. M.W. 500) | 0.05 g |
| isopropyl alcohol | 7.0 g |
| ethylene glycol | 1.0 g |
| water | 91.5 g |

TABLE 12

| | |
|---|---|
| Example 128 | |
| $Pt(H_2NC_2H_4OH)_4(CH_3COO)_2$ | 0.62 g |
| 86%-saponified polyvinyl alcohol (av. M.W. 500) | 0.05 g |
| t-butyl alcohol | 5.0 g |
| water | 94.0 g |
| Example 129 | |
| $Pt(H_2NCH(CH_3)CH_2OH)_2(CH_3COO)_2$ | 0.7 g |
| 86%-saponified polyvinyl alcohol (av. M.W. 500) | 0.05 g |
| t-butyl alcohol | 5.0 g |
| water | 94.0 g |

TABLE 13

| | |
|---|---|
| Example 140 | |
| $Pd(H_2NC_2H_4OH)_4(CH_3COO)_2$ | 0.8 g |
| 86%-saponified polyvinyl alcohol (av. M.W. 400) | 0.2 g |
| n-propyl alcohol | 20.0 g |
| ethylene glycol | 2.0 g |
| water | 77.0 g |
| Example 141 | |
| $Pd(H_2NC_2H_4OH)_4(CH_3COO)_2$ | 0.5 g |
| 86%-saponified polyvinyl alcohol (av. M.W. 500) | 0.1 g |
| isopropyl alcohol | 18.0 g |
| water | 81.4 g |
| Example 142 | |
| $Pd(H_2NC_2H_4OH)_4(CH_3COO)_2$ | 0.6 g |
| 80%-saponified polyvinyl alcohol (av. M.W. 500) | 0.03 g |
| isopropyl alcohol | 35.0 g |
| water | 64.4 g |
| Example 143 | |

TABLE 13-continued

| | |
|---|---|
| $Pd(H_2NC_2H_4OH)_4(CH_3COO)_2$ | 0.6 g |
| 86%-saponified polyvinyl alcohol (av. M.W. 500) | 0.05 g |
| isopropyl alcohol | 22.0 g |
| glycerin | 1.4 g |
| water | 76.0 g |
| Example 144 | |
| $Pd(H_2NC_2H_4OH)_4(CH_3COO)_2$ | 0.6 g |
| 86%-saponified polyvinyl alcohol (av. M.W. 500) | 0.07 g |
| ethanol | 15.0 g |
| propylene glycol | 1.2 g |
| water | 83.1 g |
| Example 145 | |
| $Pd(H_2NC_2H_4OH)_4(CH_3COO)_2$ | 0.6 g |
| 86%-saponified polyvlnyl alcohol (av. M.W. 1200) | 0.05 g |
| methanol | 10.0 g |
| ethylene glycol | 2.0 g |
| water | 87.4 g |

TABLE 14

| | |
|---|---|
| Example 146 | |
| chromium (III) acetate hydroxide | 0.5 g |
| 86%-saponified polyvinyl alcohol (av. M.W. 500) | 0.05 g |
| isopropyl alcohol | 18.0 g |
| ethylene glycol | 1.0 g |
| water | 80.5 g |
| Example 147 | |
| iron (II) acetate | 1.2 g |
| 86%-saponified polyvinyl alcohol (av. M.W. 500) | 0.05 g |
| isopropyl alcohol | 20.0 g |
| ethylene glycol | 1.0 g |
| water | 77.8 g |
| Example 148 | |
| ammonium tungstate | 0.5 g |
| 86%-saponified polyvinyl alcohol (av. M.W. 500) | 0.05 g |
| isopropyl alcohol | 16.0 g |
| ethylene glycol | 1.0 g |
| water | 82.5 g |

TABLE 15

| | Acylating agent | Add. Amt. | Esterified rate | Eval. |
|---|---|---|---|---|
| Suppl. Ex. 29 | acetyl chloride | 80 mg | 2.4% | x |
| Suppl. Ex. 30 | acetyl chloride | 110 mg | 4.1% | x |
| Example 150 | acetyl chloride | 130 mg | 5.3% | ○ |
| Example 151 | acetyl chloride | 210 mg | 9.9% | ◎ |
| Example 152 | acetyl chloride | 460 mg | 21.5% | ◎ |
| Example 153 | acetyl chloride | 530 mg | 24.6% | ○ |
| Suppl. Ex. 27 | acetyl chloride | 590 mg | 26.6% | x |
| Example 154 | propionyl chloride | 250 mg | 8.8% | ◎ |
| Example 155 | propionyl chloride | 350 mg | 12.7% | ◎ |
| Example 156 | isobutyryl chloride | 290 mg | 8.3% | ◎ |

TABLE 16

| | Polyol | Add. amount | Evaluation |
|---|---|---|---|
| Example 157 | | 0.0g | ○ |
| Example 158 | ethylene glycol | 0.2g | ◎ |
| Example 159 | ethylene glycol | 3.0g | ◎ |
| Example 160 | ethylene glycol | 5.0g | ○ |
| Suppl. Ex. 31 | ethylene glycol | 7.0g | x |
| Suppl. Ex. 32 | ethylene glycol | 10.0g | x |
| Example 161 | glycerin | 0.3g | ◎ |
| Example 162 | glycerin | 2.5g | ◎ |

TABLE 16-continued

| | Polyol | Add. amount | Evaluation |
|---|---|---|---|
| Suppl. Ex. 33 | glycerin | 6.0g | x |
| Example 163 | propylene glycol | 1.0g | ⊙ |

What is claimed is:

1. A metal-containing solution for forming an electron-emitting device having an electroconductive film which comprises electroconductive fine particles, said solution comprising a compound containing an organic acid group, a transition metal and an alcohol amine, and water.

2. A metal-containing solution for forming an electron-emitting device according to claim 1, wherein said alcohol amine is expressed by chemical formula (1) below;

$$NH_mR1_n(R2OH)_{3-m-n} \quad (1)$$

where R1 is an alkyl group having 1 to 4 carbon atoms, R2 is an alkyl carbon chain having 1 to 4 carbon atoms and m and n are integers of 0 to 2 that satisfy the relationship of (m+n)<3.

3. A metal-containing solution for forming an electron-emitting device according to claim 2, wherein m=2 and n=0 in said formula (1) of the alcohol amine.

4. A metal-containing solution for forming an electron-emitting device according to claim 2, wherein R2 is $C_2H_4$ in said formula (1) of the alcohol amine.

5. A metal-containing solution for forming an electron-emitting device according to claim 4, wherein m=2 and n=0 are used in said formula (1) of the alcohol amine.

6. A metal-containing solution for forming an electron-emitting device according to any of claims 1 through 5, wherein the content of said transition metal is between 0.01 and 10 wt %.

7. A metal-containing solution for forming an electron-emitting device according to any of claims 1 through 5, further comprising a water soluble polymer.

8. A metal-containing solution for forming an electron-emitting device according to claim 7, wherein the weight-average molecular weight of said water soluble polymer is between 20,000 and 100,000.

9. A metal-containing solution for forming an electron-emitting device according to claim 7, wherein the average degree of polymerization of said water soluble polymer is between 450 and 1,200.

10. A metal-containing solution for forming an electron-emitting device according to claim 7, wherein the content of said water soluble polymer is between 0.01 and 3 wt %.

11. A metal-containing solution for forming an electron-emitting device according to claim 7, wherein the content of said transition metal is between 0.01 and 10 wt %.

12. A metal-containing solution for forming an electron-emitting device according to claim 7, wherein said water soluble polymer is polyvinylalcohol or methylcellulose.

13. A metal-containing solution for forming an electron-emitting device according to claim 7, wherein said water soluble polymer is partially esterified polyvinylalcohol.

14. A metal-containing solution for forming an electron-emitting device according to claim 13, wherein the rate of esterification of said partially esterified polyvinylalcohol is between 5 and 25%.

15. A metal-containing solution for forming an electron-emitting device according to claim 13, wherein said partially esterified polyvinylalcohol is polyvinylacetatecarboxylate.

16. A metal-containing solution for forming an electron-emitting device according to claim 15, wherein the carboxylic acid group of said carboxylate has 2 to 5 carbon atoms.

17. A metal-containing solution for forming an electron-emitting device according to any of claims 1 through 5, further comprising water soluble polyhydric alcohol.

18. A metal-containing solution for forming an electron-emitting device according to claim 17, wherein the content of said water soluble polyhydric alcohol is between 0.2 and 3 wt %.

19. A metal-containing solution for forming an electron-emitting device according to claim 17, wherein the content of said transition metal is between 0.01 and 10 wt %.

20. A metal-containing solution for forming an electron-emitting device according to claim 17, wherein said water soluble polyhydric alcohol has 2 to 4 carbon atoms and is liquid at room temperature.

21. A metal-containing solution for forming an electron-emitting device according to claim 17, wherein said water soluble polyhydric alcohol is ethyleneglycol, propyleneglycol or glycerol.

22. A metal-containing solution for forming an electron-emitting device according to claim 17, further comprising a water soluble polymer.

23. A metal-containing solution for forming an electron-emitting device according to any of claims 1 through 5, further comprising a monohydric alcohol.

24. A metal-containing solution for forming an electron-emitting device according to claim 23, wherein the content of said monohydric alcohol is between 5 and 35 wt %.

25. A metal-containing solution for forming an electron-emitting device according to claim 23, wherein the content of said transition metal is between 0.01 and 10 wt %.

26. A metal-containing solution for forming an electron-emitting device according to claim 23, wherein said monohydric alcohol has 1 to 4 carbon atoms and is liquid at room temperature.

27. A metal-containing solution for forming an electron-emitting device according to claim 23, wherein said monohydric alcohol is methanol, ethanol, 1-propanol, 2-propanol or 2-butanol.

28. A metal-containing solution for forming an electron-emitting device according to claim 23, further comprising a water soluble polymer.

29. A metal-containing solution for forming an electron-emitting device according to claim 1, wherein said alcohol amine is expressed by chemical formula (2) below;

$$NH_2CR3R4CHR5(CH_2)_kOH \quad (2)$$

where R3 is a substituent selected from H, $CH_3$, $CH_2OH$ and $CH_2CH_3$, R4 is H or $CH_2OH$, R5 is H or $CH_3$ and k is an integer of 0 to 2, the composition containing three to five carbon atoms in a molecule.

30. A metal-containing solution for forming an electron-emitting device according to claim 29, wherein R3 is $CH_2OH$, R4 is $CH_2OH$ and R5 is H in said formula (2) of the alcohol amine.

31. A metal-containing solution for forming an electron-emitting device according to claim 29, wherein said alcohol amine is aminomethylpropanol, aminomethylpropanediol, trishydroxymethylaminomethane, 1-amino-2-propanol, 3-amino-1-propanol, 2-amino-1-propanol, 2-amino-1-butanol or 4-amino-1-butanol.

32. A metal-containing solution for forming an electron-emitting device according to claim 31, wherein said alcohol amine is trishydroxymethylaminomethane.

33. A metal-containing solution for forming an electron-emitting device according to claim 29, further comprising an alcohol amine expressed by formula (1) below;

$$NH_mR1_n(R2OH)_{3-m-n} \quad (1)$$

where R1 is an alkyl group having 1 to 4 carbon atoms, R2 is an alkyl carbon chain having 1 to 4 carbon atoms and m and n are integers of 0 to 2 that satisfy the relationship of (m+n)<3.

34. A metal-containing solution for forming an electron-emitting device according to claim 33, wherein m=2 and n=0 in said formula (1) of the alcohol amine.

35. A metal-containing solution for forming an electron-emitting device according to claim 33, wherein R2 is $C_2H_4$ in said formula (1) of the alcohol amine.

36. A metal-containing solution for forming an electron-emitting device according to claim 35, wherein m=2 and n=0 are used in said formula (1) of the alcohol amine.

37. A metal-containing solution for forming an electron-emitting device according to any of claims 29 through 36, wherein the content of said transition metal is between 0.01 and 10 wt %.

38. A metal-containing solution for forming an electron-emitting device according to any of claims 29 through 36, further comprising a water soluble polymer.

39. A metal-containing solution for forming an electron-emitting device according to claim 38, wherein the weight-average molecular weight of said water soluble polymer is between 20,000 and 100,000.

40. A metal-containing solution for forming an electron-emitting device according to claim 38, wherein the average degree of polymerization of said water soluble polymer is between 450 and 1,200.

41. A metal-containing solution for forming an electron-emitting device according to claim 38, wherein the content of said water soluble polymer is between 0.01 and 3 wt %.

42. A metal-containing solution for forming an electron-emitting device according to claim 38, wherein the content of said transition metal is between 0.01 and 10 wt %.

43. A metal-containing solution for forming an electron-emitting device according to claim 38, wherein said water soluble polymer is polyvinylalcohol or methylcellulose.

44. A metal-containing solution for forming an electron-emitting device according to claim 38, wherein said water soluble polymer is partially esterified polyvinylalcohol.

45. A metal-containing solution for forming an electron-emitting device according to claim 44, wherein the rate of esterification of said partially esterified polyvinylalcohol is between 5 and 25%.

46. A metal-containing solution for forming an electron-emitting device according to claim 44, wherein said partially esterified polyvinylalcohol is polyvinylacetatecarboxylate.

47. A metal-containing solution for forming an electron-emitting device according to claim 46, wherein the carboxylic acid group of said carboxylate has 2 to 5 carbon atoms.

48. A metal-containing solution for forming an electron-emitting device according to any of claims 29 through 36, further comprising water soluble polyhydric alcohol.

49. A metal-containing solution for forming an electron-emitting device according to claim 48, wherein the content of said water soluble polyhydric alcohol is between 0.2 and 3 wt %.

50. A metal-containing solution for forming an electron-emitting device according to claim 48, wherein the content of said transition metal is between 0.01 and 10 wt %.

51. A metal-containing solution for forming an electron-emitting device according to claim 48, wherein said water soluble polyhydric alcohol has 2 to 4 carbon atoms and is liquid at room temperature.

52. A metal-containing solution for forming an electron-emitting device according to claim 48, wherein said water soluble polyhydric alcohol is ethyleneglycol, propyleneglycol or glycerol.

53. A metal-containing solution for forming an electron-emitting device according to claim 48, further comprising a water soluble polymer.

54. A metal-containing solution for forming an electron-emitting device according to any of claims 29 through 36, further comprising a monohydric alcohol.

55. A metal-containing solution for forming an electron-emitting device according to claim 54, wherein the content of said monohydric alcohol is between 5 and 35 wt %.

56. A metal-containing solution for forming an electron-emitting device according to claim 54, wherein the content of said transition metal is between 0.01 and 10 wt %.

57. A metal-containing solution for forming an electron-emitting device according to claim 54, wherein said monohydric alcohol has 1 to 4 carbon atoms and is liquid at room temperature.

58. A metal-containing solution for forming an electron-emitting device according to claim 54, wherein said monohydric alcohol is methanol, ethanol, 1-propanol, 2-propanol or 2-butanol.

59. A metal-containing solution for forming an electron-emitting device according to claim 54, further comprising a water soluble polymer.

60. A metal-containing solution for forming an electron-emitting device according to claim 1, wherein said organic acid group is alkylcarboxylic acid group having 1 to 5 carbon atoms.

61. A metal-containing solution for forming an electron-emitting device according to claim 60, wherein said alkylcarboxylic acid group is acetic acid group.

62. A metal-containing solution for forming an electron-emitting device according to claim 1, wherein said transition metal is a metal of the VIII group.

63. A metal-containing solution for forming an electron-emitting device according to claim 1, wherein said transition metal is a metal of the platinum group.

64. A metal-containing solution for forming an electron-emitting device according to claim 63, wherein said metal of the platinum group is Pd or Pt.

65. A metal-containing solution for forming an electron-emitting device according to claim 1, wherein said transition metal is a metal of the iron group.

66. A metal-containing solution for forming an electron-emitting device according to claim 65, wherein said metal of the iron group is Ni or Co.

67. A metal-containing solution for forming an electron-emitting device according to claim 1, wherein said transition metal is at least a metal selected from palladium, platinum, ruthenium, gold, silver, copper, chromium, tantalum, nickel, iron, cobalt, tungsten, lead, zinc and tin.

68. A metal-containing solution for forming an electron-emitting device according to claim 1, prepared by a method comprising a step of dissolving organic metal compound composed of organic acid group, a metal and an aminoalcohol to a water.

69. A metal-containing solution for forming an electron-emitting device according to claim 1, prepared by a method comprising a step of adding a compound comprising a metal, a compound comprising a organic acid group and a compound comprising an aminoalcohol to the water.

70. A metal-containing solution for forming an electron-emitting device according to claim 7, further comprising a monohydric alcohol and water soluble polyhydric alcohol.

71. A metal-containing solution for forming an electron-emitting device according to claim 17, further comprising a monohydric alcohol.

72. A metal-containing solution for forming an electron-emitting device according to claim 1, wherein the compound is represented by the following formula (3):

$$(R^2COO)_mM\{NH_n(R^1OH)_{(3-n)}\}_1 \quad (3)$$

where $R^1$ is an alkylene or polymethylene group having 1 to 4 carbon atoms, $R^2$ is an alkyl group having 1 to 4 carbon atoms, 1 and m are integers of 1 to 4, n is an integer of 0 to 2 and M is a metal element.

73. A metal-containing solution for forming an electron-emitting device according to claim 1, wherein the compound is represented by the following formula (4):

$$(R^2COO)_mM\{NH_nR^3_k(R^1OH)_{(3-n-k)}\}_1 \quad (4)$$

where each of $R^1$, $R^2$ and $R^3$ is an alkyl group having 1 to 4 carbon atoms, 1 is an integer of 2 to 4, m is an integer of 1 to 4, k is an integer of 1 to 2, n is an integer of 0 to 1 and M is a metal element.

74. A metal-containing solution for forming an electron-emitting device according to claim 1, wherein the compound is represented by the following formula (5):

$$(R^1COO)_nNi\{NH_1(R^2)_{3-m-l}(R^3OH)_m\}_e \quad (5)$$

where $R^1$ a hydrogen atom or an alkyl group having 1 to 4 carbon atoms, $R^2$ is an alkyl group having 1 to 4 carbon atoms, $R^3$ is an alkylene group having 2 to 4 carbon atoms, n is an integer of 1 to 4, m is an integer of 1 to 3, 1 is an integer of 0 to 2 and n is an integer of 2 to 4.

* * * * *

UNITED STATES PATENT AND TRADEMARK OFFICE

CERTIFICATE OF CORRECTION

PATENT NO. : 6,12[illegible],876

DATED : September 26, 2000

INVENTOR(S) : SHIN KOBAYASHI ET AL.

It is certified that error appears in the above-identified patent and that said Letters Patent is hereby corrected as shown below:

ON THE TITLE PAGE [56] References Cited:

FOREIGN PATENT DOCUMENTS,
"1031332 7/1987 should read --64-31332
2257552 3/1989 2-257552
1283749 11/1989" 1-283749--.

COLUMN 2:

Line 23, "such" should read --such as--.

COLUMN 11:

Line 51, "dimethyethylene" should read --dimethylethylene--.

COLUMN 15:

Line 36, "complexes," should read --complex,--; and
Line 65, "assumes" should read --assume--.

COLUMN 18:

Line 17, "satisfactory" should read --satisfactorily--;
Line 38, "exceed" should read --exceeds--; and
Line 65, "advantages" should read --advantage--.

COLUMN 19:

Line 22, "to" should read --for--.

UNITED STATES PATENT AND TRADEMARK OFFICE

CERTIFICATE OF CORRECTION

PATENT NO. : 6,123,876

DATED : September 26, 2000

INVENTOR(S) : SHIN KOBAYASHI ET AL.

It is certified that error appears in the above-identified patent and that said Letters Patent is hereby corrected as shown below:

COLUMN 20:

Line 29, "an" should read --a--; and
Line 48, "the" (first occurrence) should read --that--.

COLUMN 21:

Line 50, "excessive" should read --excessively--.

COLUMN 22:

Line 11, "means" should read --mean--.

COLUMN 31:

Line 28, "is" should read --can--.

COLUMN 34:

Line 43, "an" should read --a--.

COLUMN 38:

Line 34, "be" should read --be as--.

COLUMN 40:

Line 28, "of in the atmosphere" should read --of an atmosphere--.

UNITED STATES PATENT AND TRADEMARK OFFICE

CERTIFICATE OF CORRECTION

PATENT NO. : 6,123,876

DATED : September 26, 2000

INVENTOR(S) : SHIN KOBAYASHI ET AL.

It is certified that error appears in the above-identified patent and that said Letters Patent is hereby corrected as shown below:

COLUMN 41:

Line 12, "begun" should read --began--;
Line 36, "begun" should read --began--; and
Line 51, "begun" should read --began--.

COLUMN 44:

Line 58, "begun" should read --began--.

COLUMN 45:

Line 48, "of in the atmosphere" should read --of an atmosphere--.

COLUMN 47:

Line 36, "if" should read --of--.

COLUMN 51:

Line 21, "of in the atmosphere" should read --of an atmosphere--; and
Line 53, "begun" should read --began--.

COLUMN 54:

Line 49,"begun" should read --began--.

COLUMN 60:

Line 20, "the" should read --to the--; and
Line 28, "of in the atmosphere" should read --of an atmosphere--.

UNITED STATES PATENT AND TRADEMARK OFFICE

CERTIFICATE OF CORRECTION

PATENT NO. : 6,123,876

DATED : September 26, 2000

INVENTOR(S) : SHIN KOBAYASHI ET AL.

It is certified that error appears in the above-identified patent and that said Letters Patent is hereby corrected as shown below:

COLUMN 64:

Line 35, "of in the atmosphere" should read --of an atmosphere--; and
Line 56, "begun" should read --began--.

COLUMN 66:

Line 55, "these" should read --this--.

COLUMN 67:

Line 28, "Example" should read --Example 87--.

COLUMN 70:

Line 17, "with" should read --while--.

COLUMN 71:

Line 1, "was" should be deleted; and
Line 12, "not" should read --not be--.

COLUMN 72:

Line 8, "an" should be deleted.

UNITED STATES PATENT AND TRADEMARK OFFICE

CERTIFICATE OF CORRECTION

PATENT NO. : 6,123,876

DATED : September 26, 2000

INVENTOR(S) : SHIN KOBAYASHI ET AL.

It is certified that error appears in the above-identified patent and that said Letters Patent is hereby corrected as shown below:

COLUMN 75:

Line 19, "$(HCOO)_2Ni(_2NCH_2(CH_2OH)_3 \cdot 2H_2O$" should read --$(HCOO)_2Ni(H_2NCH_2CH_2OH)_3 \cdot 2H_2O$--; and
Line 42, "(A.V.M.W.500)" should read --(av.M.W.500)--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*